US005762117A

United States Patent [19]

Law

[11] Patent Number: 5,762,117

[45] Date of Patent: Jun. 9, 1998

[54] VENTED POUR SPOUT AUTOMATICALLY ACCOMMODATING OF TRANSFERRED FLUID VISCOSITY

[76] Inventor: Verl Law, 3033 Van Deussen Rd., Emmett, Id. 83617

[21] Appl. No.: 422,552

[22] Filed: Apr. 14, 1995

Related U.S. Application Data

[63] Continuation-in-part of Ser. No. 227,855, Apr. 15, 1994, abandoned, and Ser. No. 133,433, Oct. 5, 1993, Pat. No. 5,419,378, said Ser. No. 277,855, is a continuation-in-part of Ser. No. 133,433, which is a division of Ser. No. 704,429, May 23, 1991, Pat. No. 5,249,611, which is a continuation-in-part of Ser. No. 361,590, May 30, 1989, Pat. No. 5,076,333, which is a continuation-in-part of Ser. No. 27,014, Mar. 16, 1987, Pat. No. 4,834,151.

[51] Int. Cl.[6] ..... B65C 3/00

[52] U.S. Cl. ..... 141/198; 141/292; 141/296; 141/352; 141/286; 222/189.07; 222/547; 222/564

[58] Field of Search ..... 141/192, 193, 141/198, 286, 291, 296, 297, 301, 308, 309, 335, 344, 345, 351–354, 292; 222/547, 564, 189.07

[56] References Cited

U.S. PATENT DOCUMENTS

| | | | |
|---|---|---|---|
| 245,401 | 8/1881 | Raynor et al. | 141/353 |
| 365,227 | 6/1887 | Beach et al. | 222/189.07 |
| 525,744 | 9/1894 | Roth | 141/353 |
| 612,510 | 10/1898 | Walker et al. | 141/335 |
| 790,052 | 5/1905 | Hardie et al. | 222/189.07 |
| 1,327,532 | 1/1920 | Duvall | 222/189.07 |
| 1,345,965 | 7/1920 | Shute | 221/16 |
| 1,456,854 | 5/1923 | McGhee et al. | 141/286 X |
| 1,820,197 | 8/1931 | McGhee et al. | 141/129 |
| 2,106,453 | 1/1938 | Ekdahl | 222/189.07 X |
| 2,154,583 | 4/1939 | Rodgers | 141/392 |
| 2,164,314 | 7/1939 | Edwards | 215/79 |
| 2,341,950 | 2/1944 | Schepps | 141/387 |
| 2,370,668 | 3/1945 | Johnson | 222/189.07 |
| 2,445,130 | 7/1948 | Turner | 222/482 |
| 2,471,189 | 5/1949 | Bartels | 222/189.07 |
| 2,593,634 | 4/1952 | Vosburg | 222/514 |
| 2,681,759 | 6/1954 | Risser | 141/293 |
| 2,701,078 | 2/1955 | Bowman | 222/117 |

(List continued on next page.)

FOREIGN PATENT DOCUMENTS

| | | | |
|---|---|---|---|
| 11818/76 | 3/1976 | Australia . | |
| 456612 | 11/1991 | European Pat. Off. . | |
| 580416 | 1/1994 | European Pat. Off. . | |
| 1179560 | 5/1959 | France . | |
| 2303730 | 3/1976 | France . | |
| 218222 | 7/1909 | Germany . | |
| 851610 | 8/1952 | Germany . | |
| 851610 | 10/1952 | Germany . | |
| 3602101 | 7/1987 | Germany . | |
| 368214 | 3/1932 | United Kingdom . | |
| 1014483 | 12/1965 | United Kingdom | 141/286 |
| 1569872 | 6/1980 | United Kingdom . | |
| WO92/20590 | 11/1909 | WIPO . | |

*Primary Examiner*—J. Casimer Jacyna
*Attorney, Agent, or Firm*—Trask, Britt & Rossa

[57] ABSTRACT

A hollow tube attachable at one end to a container of fluid is provided at the other end with a fluid conduit termination disk separated from the end of the hollow tube by a space that defines a fluid discharge opening. A slide valve on the exterior of the tube is biased into a closed position engaging the fluid conduit termination disk and precluding fluid transfer until the discharge opening is inside a receiving vessel. A barricade is disposed across the interior of the tube at an inclination relative to the longitudinal axis thereof. Formed through the barricade is at least one elongated aperture extending continuously from a first longitudinal position in the tube to a second longitudinal position in the tube that is located further from the container of fluid than is the first longitudinal position. When the slide valve is opened, fluid passes through the barrier at the first longitudinal position, while air is simultaneously exchanged therethrough at the second longitudinal position, venting the container of fluid.

137 Claims, 26 Drawing Sheets

U.S. PATENT DOCUMENTS

| | | | |
|---|---|---|---|
| 2,743,047 | 4/1956 | Clarke | 141/193 |
| 3,005,475 | 10/1961 | Beall, Jr. | 141/198 |
| 3,091,373 | 5/1963 | Kirschenbaum | 222/547 X |
| 3,181,576 | 5/1965 | Pellerino et al. | 141/198 X |
| 3,207,190 | 9/1965 | Silbereis et al. | 141/198 |
| 3,263,711 | 8/1966 | Laub | 141/40 |
| 3,289,712 | 12/1966 | Smith | 141/295 |
| 3,540,402 | 11/1970 | Kocher | 141/198 |
| 3,595,281 | 7/1971 | Laub, III | 141/46 |
| 3,741,263 | 6/1973 | Waxlax | 141/286 X |
| 3,994,323 | 11/1976 | Takahata et al. | 141/302 |
| 4,176,694 | 12/1979 | Dickerson | 141/198 X |
| 4,314,657 | 2/1982 | Perakis et al. | 222/162 |
| 4,555,336 | 11/1985 | Nugent et al. | 222/189.07 |
| 4,588,111 | 5/1986 | Hestehave | 222/479 |
| 4,598,743 | 7/1986 | Milling | 141/296 |
| 4,667,710 | 5/1987 | Wu | 141/198 |
| 4,834,151 | 5/1989 | Law | 141/198 |
| 4,848,602 | 7/1989 | Yoshimura et al. | 222/564 |
| 4,924,921 | 5/1990 | Simmel et al. | 141/286 |
| 4,982,881 | 1/1991 | Amrein | 141/335 X |
| 5,076,333 | 12/1991 | Law | 141/198 |
| 5,228,487 | 7/1993 | Thiermann et al. | 141/293 |
| 5,234,038 | 8/1993 | Mitchell et al. | 141/291 X |
| 5,249,611 | 10/1993 | Law | 141/198 |
| 5,406,994 | 4/1995 | Mitchell et al. | 141/198 |
| 5,419,378 | 5/1995 | Law | 141/198 |

VENTED POUR SPOUT AUTOMATICALLY ACCOMMODATING OF TRANSFERRED FLUID VISCOSITY

RELATED APPLICATIONS

This is a continuation-in-part application of the following United States patent applications:

(1) U.S. Ser. No. 227,855 filed Apr. 15, 1994, (hereinafter "the '855 Application") now abandoned; and (2) U.S. Ser. No. 133,433 filed on Oct. 5, 1993, now U.S. Pat. No. 5,419,378 (hereinafter "the '433 Application").

The '855 Application is a continuation-in-part application of the '433 Application. The '433 Application in turn is a divisional application of U.S. patent application Ser. No. 704,429 filed on May 23, 1991, and issued on Oct. 5, 1993, as U.S. Pat. No. 5,249,611, which was a continuation-in-part application of U.S. patent application Ser. No. 361,590 filed on May 30, 1989, and issued on Dec. 31, 1991, as U.S. Pat. No. 5,076,333, which was a continuation-in-part application of U.S. patent application Ser. No. 27,014 filed on Mar. 16, 1987, and issued on May 30, 1989, as U.S. Pat. No. 4,834,151.

This application is also related to an application having an identical specification and drawings that is being filed simultaneously herewith, and that is a continuation-in-part application of both the '855 Application and the '433 Application.

BACKGROUND

1. The Field of the Invention

This invention relates to pour spouts for containers of fluid, and more particularly to pour spouts which permit transfers of fluid under the influence of gravity into a receiving vessel without the risk of spills or overflow.

2. Background Art

The instances are numerous in which a receiving vessel or tank must be filled with a fluid and the environment in which this is accomplished or the nature of the fluid itself demands that spills be minimized or totally eliminated.

A common example involves the widespread use of internal combustion engines in lawn mowers, chain saws, tractors, motorized recreational vehicles, outboard motors, and other gasoline-powered machinery employed on farms and construction sites. It is undesirable that in filling the fuel reservoirs for such devices gasoline in any appreciable quantity should be spilled. Uncontained gasoline presents health and safety risks to persons nearby, as well as a source of environmental pollution generally. Associated with other fluids, such as cooking or machine oils, pesticides, fertilizers, cleaning fluids, sealants, and even food substances are similar concerns for minimizing spills when fluids are transferred from one container to another.

In such fluid transfers, the opportunity for spills have several causes. First, where the opening into the receiving vessel is narrow, it is often the case that a stream of fluid directed thereinto will stray outside of that opening, either due to its size or to an unsteady hand. Where no facilitating pour spout or funnel is employed and the exit of the container of fluid never actually enters the opening to the receiving vessel, this problem is a continuing one throughout the entire pouring process.

Second, containers of fluid, whether or not equipped with facilitating pour spouts or used with funnels, must be tilted toward the receiving vessel in order to initiate a flow of fluid. When this tilting must occur prior to entry of the pour spout into the neck of the receiving vessel or the top of the funnel, spills are common.

In addition, many spills occur when the receiving vessel to which fluid is being transferred fills and overflows before pouring can be terminated. Such a situation is extremely common in receiving vessels having narrow-necked openings. In such structures, it is difficult for one to visually verify the level of fluid in the receiving container as pouring is occurring. Also, once fluid in the receiving vessel reaches the level of the intake neck of the receiving vessel, additional incoming fluid, must be received in the intake neck only. This results in an abrupt increase in the rate of rise in the level of fluid, enhancing the likelihood of an overflow.

Another source of difficulty in controlling transferred fluids to prevent waste and spilling is that frequently the container from which the fluid is being poured is not effectively vented during the pouring process. This can result in an uneven flow of fluid, and even surges of flow which render impossible a reliable prediction of the level of the fluid in the receiving vessel. Surges of fluid flow can also cause splashing. If occurring when the receiving vessel is almost full such surges will certainly cause overflows. In addition, the turbulence created by such surges of flow in the container from which fluid is being poured can shift the weight of that container making it difficult to hold steady.

A further problem related to ineffective venting during pouring is the development of an airlock wherein a total absence of venting in combination with specific volume and viscosity parameters can result in a fluid which will not pour once its container is inverted. On occasion the air lock can be dissipated by righting the container, but such activity causes splashing of the fluid in its container. The necessity to reenter the pour spout into the receiving vessel thereafter increases the opportunities for spills.

While a funnel or a narrow-necked pour spout on a fluid container can to a degree reduce spills, such devices without more do not adequately eliminate spills arising due to all of the causes described above. This is particularly true in relation to overflow control in the type of fluid transfers in which fluid flows from a container into a receiving vessel under the influence of gravity exclusively, rather than under circumstances in which pumping motivates motion in the transferred fluid.

The overflow control mechanisms commonly used in service stations for controlling overflow in filling the gas tank of a vehicle are of this latter type. The effectiveness of such systems is derived from the fact that the fluid transferred is being moved due to pressure, rather than gravity. By contrast, only gravity is used, for example, to induce the flow of kerosene when that fuel is transferred from a storage container at a campsite into a lantern or a cook stove. It is to such gravity-induced types of fluid transfers that the present invention pertains, and it has been found that prior to this invention, no known satisfactory configuration for a pour spout had been achieved which could consistently facilitate spill-free, clean fluid transfers.

Additional difficulties are encountered relative to venting during pouring because the viscosity of the fluid being poured has a significant impact upon the effectiveness of any venting structure used therewith. While a pour spout may be equipped with a venting structure that is suitable for fluids of low viscosity, that same venting structure will be increasingly less effective as fluids of heavier viscosity are transferred through the pour spout. The heavier the viscosity of the fluid being transferred, the slower will be the rate of outflow. Correspondingly, a venting structure adapted for fluids of heavy viscosity may function much less advantageously when used with fluids of a much lower viscosity.

OBJECTS OF THE INVENTION

One object of the present invention is to produce a pour spout for a container of fluid which will preclude the overflow of any receiving vessel into which that fluid is transferred.

Another object of the present invention is to produce such a pour spout which is conducive to a uniform, even-flowing of fluid into the receiving vessel, a fluid flow lacking surges which could splash fluid out of the receiving vessel or override the effects of an otherwise operable overflow prevention system.

Still another object of the present invention is to produce a pour spout such as that described above which eliminates spills of the fluid being transferred when the container from which it is to be poured has been inverted, but the pour spout has not yet been received within the opening to a receiving vessel.

It is yet an additional object of the present invention to make available for the benefit of the public a pour spout as described above which precludes the formation in an upturned container of fluid of any air lock which could interfere with the initiation of fluid flow.

Yet another object of the present invention is to produce a pour spout as described above that is efficient to manufacture.

The cumulative purpose of all the above-described objects of the present invention is to produce a pour spout permitting transfers from a container of fluid to a receiving vessel under circumstances which minimize the opportunities for spills or losses of fluid. It is the objective of the present invention to accomplish this in an environment in which the impetus for fluid flow is gravity exclusively.

It is an additional object of the present invention to permit a single pour spout to achieve the objects listed above regardless of whether that pour spout is used to transfer a fluid having a heavy viscosity or a light viscosity.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

SUMMARY OF THE INVENTION

To achieve the foregoing objects, and in accordance with the invention as embodied and broadly described herein, a pour spout is provided for permitting transfer of a fluid from a container of the fluid to a receiving vessel. The pour spout comprises a fluid conduit opening at one end thereof into the container of fluid. At a location remote from the container, the fluid conduit is provided with a fluid discharge opening through which fluid from the container is transferred into the receiving vessel.

According to one aspect of the present invention, the pour spout provided comprises baffle means located in the fluid conduit both for admitting air into the interior space within the fluid conduit and the container at a first longitudinal position in the fluid conduit, and for maintaining the point of zero static head pressure in the fluid flowing through the baffle means at a second longitudinal position located further from the container of fluid than the first longitudinal position.

In one embodiment of a baffle means incorporating teachings of the present invention, a barrier is disposed across the interior of the fluid conduit at an inclination relative to the longitudinal axis of the fluid conduit. An air vent aperture and a distinct fluid aperture are formed through the barrier, with the air vent aperture located inside the fluid conduit closer to the container of fluid than the fluid aperture. Alternatively, the baffle means can take the form of a fluid conduit end cap attached to and at least partially closing the end of the fluid conduit remote from the container of fluid. A fluid discharge passageway and an air inlet passageway are formed through the end cap. Alternatively, the baffle means may take the form of a fluid conduit end cap attached to and at least partially closing the end of the fluid conduit remote from the container of fluid in combination with an air vent tube communicating between the exterior of the fluid conduit and the interior space within the fluid conduit and the fluid container.

According to another aspect of the present invention, a barricade disposed across the interior of the fluid conduit obstructs the flow of fluid through the fluid conduit from the container and is provided with viscosity accommodating transfer means formed in the barricade for smoothly and continuously exchanging through the barricade air in the fluid conduit from the side of the barricade opposite from the fluid container and fluid from the container at a rate determined by the viscosity thereof. In one embodiment of a viscosity accommodating transfer means incorporating teachings of the present invention, at least one elongated aperture is formed through the barricade extending continuously from the first longitudinal position in the fluid conduit to the second longitudinal position.

The barricade may comprise a plate disposed in the fluid conduit at an inclination to the longitudinal axis thereof with a plurality of elongated apertures formed therethrough in parallel relationship to the longitudinal axis of the plate.

Alternatively, the barricade may take the form of a cone disposed in the fluid conduit with the small end of the cone oriented toward the container of fluid and the large end of the cone engaging the interior of the fluid conduit. At least one elongated aperture is formed through the cone extending continuously from the first longitudinal position in the fluid conduit to the second longitudinal position.

In yet another form, the barricade can comprise a plurality of elongated obstacles secured in planar, spaced-apart relationship within the fluid conduit at an inclination relative to the longitudinal axis thereof.

In a final form, the barricade can take the form of screen or mesh mounted in the fluid conduit at an inclination to the longitudinal axis thereof. The uniform array of windows through the screen or mesh functions substantially like a single or a plurality of elongated apertures inclined relative to the longitudinal axis of the fluid conduit, while the wires or other materials between the apertures are the functional equivalent of an array of spaced-apart obstacles of fine dimension. Air passes through this barrier through the uppermost portion thereof closest to the fluid container, while fluid goes through the barrier in the opposite direction at the lower portions thereof that are more remote from the fluid container.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DESCRIPTION OF THE PREFERRED EMBODIMENT

Figure 1:
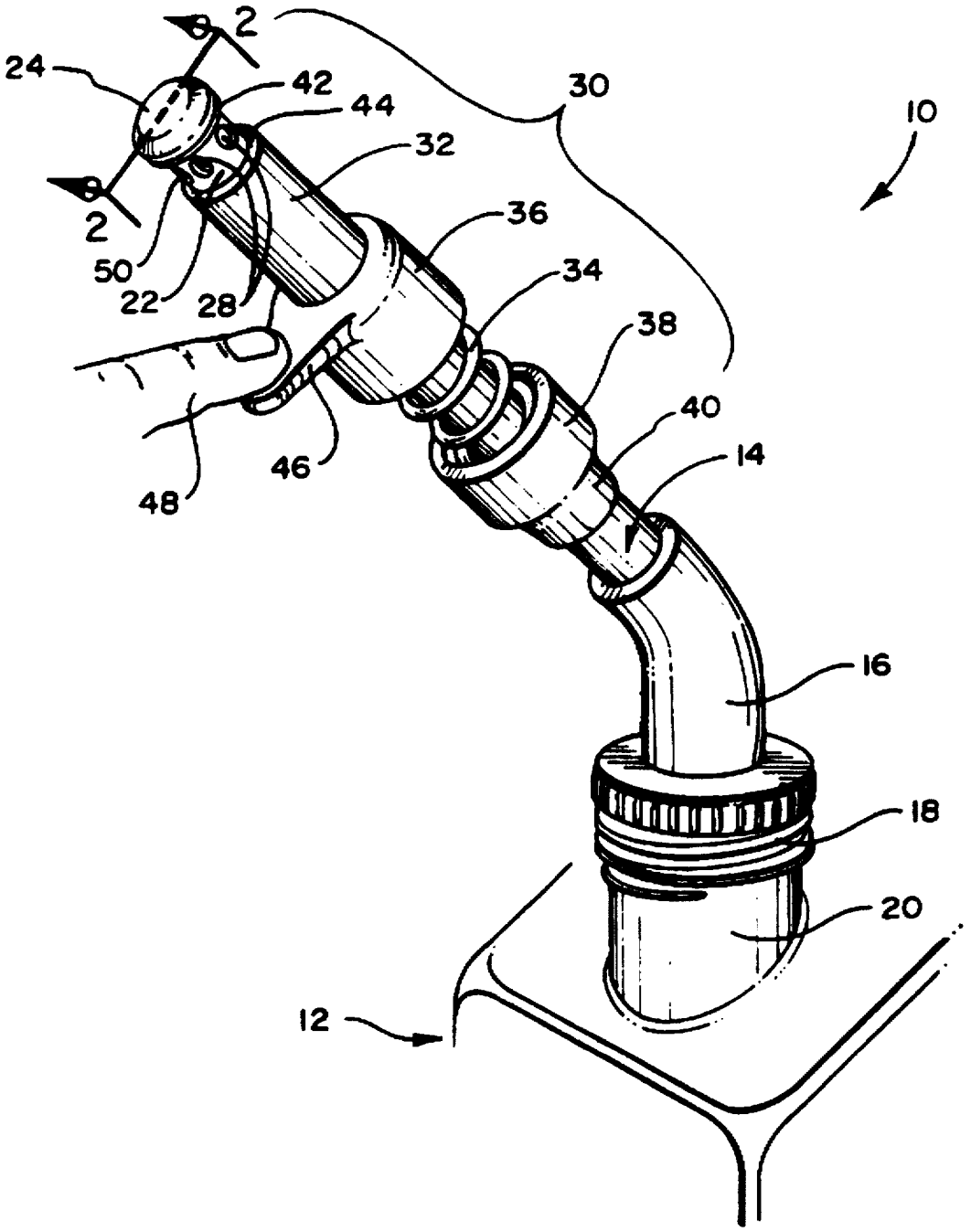
FIG. 1 is a perspective view of one embodiment of a pour spout incorporating the teachings of the present invention.
Figure 2:
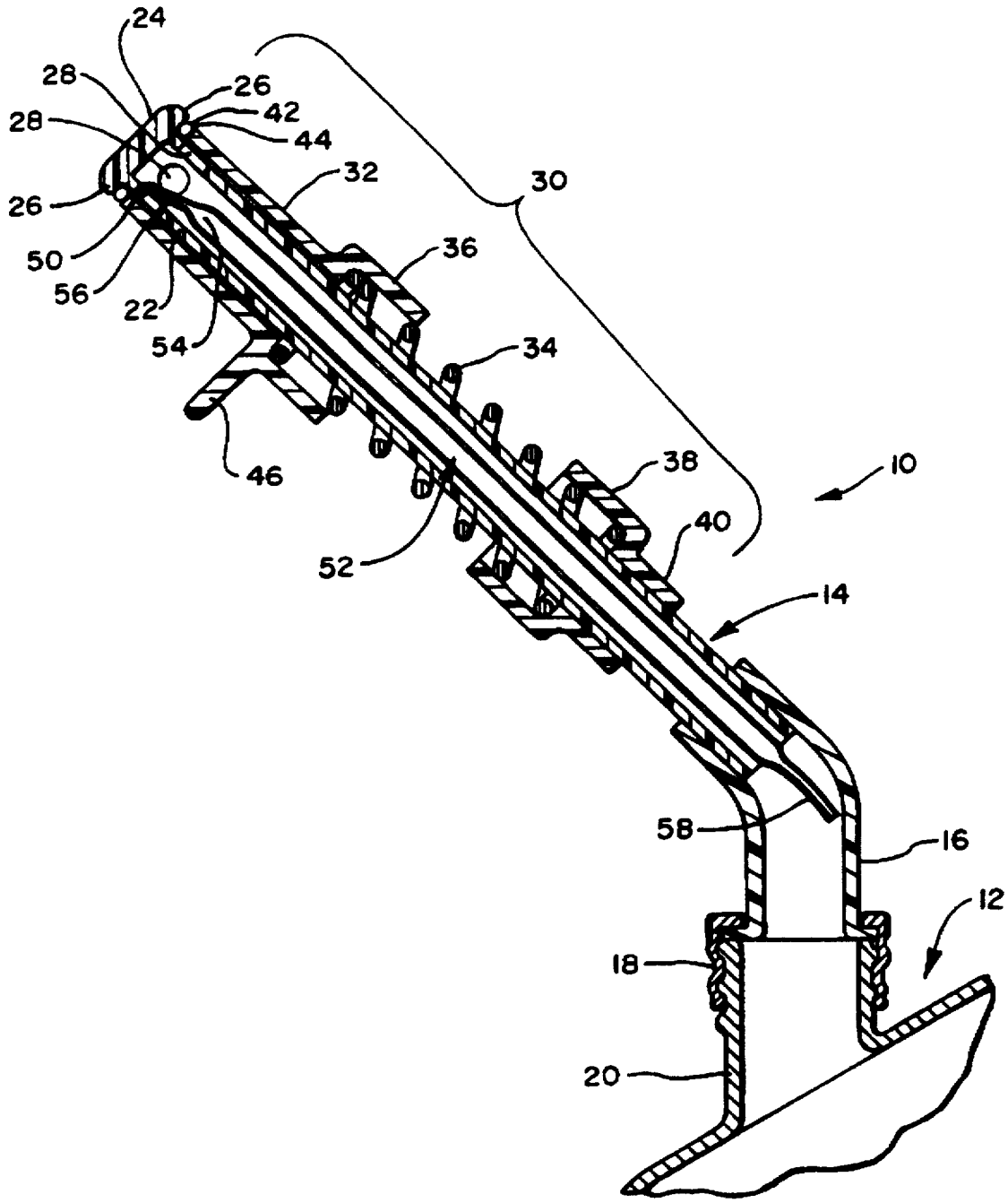
FIG. 2 is a cross-sectional view of the embodiment of the pour spout illustrated in FIG. 1 taken along the section line 2—2 therein.

FIGS. 1 and 2 taken together illustrate one embodiment of a pour spout 10 constructed to permit transfers from a fluid container 12 while minimizing the possibility of spillage and waste. Pour spout 10 comprises a fluid conduit 14 having one end 16 thereof attached to container 12. As used herein, the term "fluid conduit" is intended to refer to any structure, such as fluid conduit 14, through which fluid is transferred from a container, whether or not the fluid conduit is comprised of one or several components, and whether or not the passageway for fluid therethrough is straight, or as in FIGS. 1 and 2, bent at one or more portions thereof.

Pour spout 10 may be fabricated with container 12 as an integral, nonremovable portion thereof by the permanent attachment of end 16 of fluid conduit 14 to container 12. Alternatively, and as shown in FIGS. 1 and 2, pour spout 10 may be removably attached to container 12 by any known structure capable of effecting that result. In FIGS. 1 and 2 this is shown to be possible using an annular, threaded cap 18 which cooperates with a correspondingly threaded neck portion 20 of container 12 to retain end 16 of fluid conduit 14 in selectively removable, fluid-sealing engagement therewith.

In pour spout 10 the extreme end 22 of fluid conduit 14 terminates in a laterally disposed end piece 24 which extends radially outward beyond the exterior of fluid conduit 14 in an overhanging circular lip 26, the function of which will be explained subsequently. At a location on fluid conduit 14 remote from container 12 one or more fluid discharge openings 28 are formed for permitting fluid to exit from fluid conduit 14. In most applications fluid discharge openings 28 will preferably be located near extreme end 22 of fluid conduit 14.

In accordance with one aspect of the present invention, closure means are provided for precluding any flow of fluid from a fluid conduit, such as fluid conduit 14, until the fluid discharge openings through which such fluid can emerge are inside the receiving vessel to which the fluid is being transferred. As shown in FIGS. 1 and 2 by way of example and not limitation, a slide valve 30 located on conduit 14 is biased into a closed position in which the flow of fluid from fluid conduit 14 through fluid discharge openings 28 is precluded. Slide valve 30 may admit of many alternate configurations, but that presently preferred for the purposes of the inventive pour spout, is shown disposed on the exterior of fluid conduit 14.

Slide valve 30 comprises a sleeve 32 closely conforming to the exterior surface of fluid conduit 14 and mounted for sliding motion thereupon. In a fluid conduit 14 dimensioned so as to have an inner diameter of approximately 0.50 inches, a difference in diameter between the outside of fluid conduit 14 and the inside of the slide valve sleeve 32 which is in the range of 0.002 to 0.003 inches has been found to be a workable clearance satisfying the several functional demands placed upon sleeve 32. Not the least of these demands is that sleeve 32 must slide freely upon fluid conduit 14 and have an adequate longitudinal dimension so as to preclude binding thereupon.

Sleeve 32 is urged along fluid conduit 14 in a direction away from container 12 by a bias means, which by way of illustration, is shown in FIGS. 1 and 2 as a spring 34 disposed encircling fluid conduit 14. Spring 34 is held in compression between an enlarged cylindrical spring retainer 36 at the end of sleeve 32 closest to container 12 and a similarly shaped, opposed spring retainer 38 at the facing end of a collar 40 rigidly attached to fluid conduit 14 at a longitudinally fixed point thereupon. In this manner, spring 34 urges sleeve 32 along fluid conduit 14 in a direction away from container 12.

Movement of sleeve 32 off extreme end 22 of fluid conduit 14 is blocked by lip 26 of end piece 24, which functions as the valve seat for slide valve 30. When sleeve 32 is against lip 26, spring 34 is in its state of longest extension but is still in a state of relative compression. To enhance the sealing effect of slide valve 30, a resilient O-ring 42 may be retained encircling fluid conduit 14 between lip 26 and fluid discharge openings 28. The leading edge 44 of sleeve 32 then is forced into sealing engagement with O-ring 42 by spring 34 in the closed position of slide valve 30. With slide valve 30 in its closed position, fluid discharge openings 28 are blocked, precluding any flow of fluid from fluid conduit 14 until the biasing effect of spring 34 is overcome.

In accordance with yet another aspect of the invention, the closure means partially described above is further provided with a slide valve release means for co-acting with a receiving vessel for fluid from container 12 in order to open slide valve 30 and permit fluid to flow from fluid conduit 14 through fluid discharge openings 28, which are otherwise blocked by the slide valve 30 in its closed position. By way of example, a simple form of such a slide valve release means can be seen in FIGS. 1 and 2 to comprise a projection 46 secured to sleeve 32 for catching the lip of a receiving vessel when pour spout 10 is inserted thereinto. As pour spout 10 is advanced into the receiving vessel, sleeve 32 is drawn out of engagement with its valve seat, in this instance with O-ring 42. It is thus the relative motion between a container of fluid, such as container 12, and the inlet to a receiving vessel that serves to open slide valve 30 and permit fluid flow through pour spout 10.

FIG. 1 illustrates the relationship of the parts of pour spout 10 when such relative motion has overcome the bias of spring 34, and sleeve 32 is no longer in the closed position of slide valve 30. In the instance illustrated in FIG. 1, however, the force upon projection 46 necessary to effect such a result is being applied by a finger 48 of an operator. The same operation is nevertheless effected when end 22 of fluid conduit 14 is moved into a receiving vessel so that projection 46 co-acts therewith. Such operation will be described in detail subsequently. In FIG. 2, finger 48 of an operator has been removed from projection 46, and slide 32 can there be seen to be again urged into the closed position of slide valve 30.

In accordance with yet another aspect of the invention, a pour spout, such as pour spout 10, is provided with venting means for admitting air into the interior space within the fluid conduit of the pour spout and the container of fluid with which it is employed to facilitate an even-flowing transfer of fluid from the discharge opening. The venting means operates in this manner only after an initial period in which fluid transfers through the discharge opening without any air being admitted into the interior space. This transfer reduces the volume of fluid in the container, which in turn reduces the pressure of air in the interior space. The process continues until the pressure of the air in the interior space is sufficiently below atmospheric pressure to result in a back pressure adequate to substantially curtail continued transfer of fluid through the discharge opening.

Thereafter, this back pressure is maintained, but the venting means begins admitting air into the interior space. This allows for a continued even flow of fluid. When the receiving container becomes filled, the surface of the fluid transferred thereinto rises to obstruct the entry into the venting means. The flow of air into that interior space then terminates. This combines with the back pressure already created in the container to promptly curtail the flow of fluid out of the pour spout. In this manner automatic overflow protection is effected.

By way of illustration, and not limitation, one embodiment of such a venting means for use with a pour spout according to the present invention is best seen in FIG. 2 to comprise an air vent opening 50 formed in fluid conduit 14 and an air vent tube 52 preferably disposed within fluid conduit 14 communicating at one end 54 thereof with air vent opening 50. These structures together constitute an example of an air vent passageway according to the teachings of the present invention. While air vent tube 52 is shown in FIG. 2 as being entirely disposed within fluid conduit 14, such an arrangement is merely preferred, but not essential, to the satisfactory functioning of the inventive pour spout.

Air vent opening 50 is so located on fluid conduit 14 as to be within a receiving vessel whenever sleeve 32 is drawn out of sealing engagement with its corresponding valve seat by the co-action of projection 46 with the receiving vessel. Under most circumstances envisioned this would require that air vent opening 50 be in relatively close longitudinal proximity on fluid conduit 14 to fluid discharge openings 28. While such a relative relationship among air fluid discharge openings 28 and vent opening 50 is illustrated in FIGS. 1 and 2, alternate arrangements are workable. One function of air vent tube 52 is to admit air into the interior space within fluid conduit 14 and container 12 to facilitate an even-flowing transfer of the fluid out of container 12 through pour spout 10.

The venting means suitable for use with a pour spout, such as pour spout 10, further comprises an air vent passageway constriction means for retarding the entry of fluid into air vent tube 52 when fluid is being transferred from the pour spout. This results in retaining a column of air in air vent tube 52 during each transfer of fluid from pour spout 10. The utility of this result will be described subsequently. As fluid initially is transferred from container 12 through pour spout 10 without air entering container 12 through air vent tube 52, the pressure of the air in the interior space in container 12 and pour spout 10 is reduced to less than the ambient pressure of the atmosphere outside of container 12. Thereafter, while the interior space becomes vented through air vent tube 52, the back pressure is maintained within container 12 and assists in the fluid flow curtailment function of the venting means.

As shown in FIG. 2, with additional specificity, but by no means by way of limitation, such an air vent passageway constriction means comprises at least one capillary section in air vent tube 52 having an inside diameter less than that of air vent tube 52. In FIG. 2, two such capillary sections 56, 58 are shown integrally formed in air vent tube 52. Capillary section 56 is located at air vent opening 50, while capillary section 58 is located at the end of air vent tube 52 remote therefrom. For optimum functioning of the air vent means of the present invention in all its diverse aspects, it is desirable that the inside diameter of capillary sections 56, 58 be substantially identical. Capillary sections 56, 58 need not, however, be of equal length to ensure optimum functioning of the device. While capillary sections 56, 58 are shown in FIG. 2 as separated from each other, a suitable air-flow constriction means is conceivable for specific combinations of fluid viscosity and lengths of an air vent tube as would require the capillary portions to encompass the entire length of the air vent tube.

Figure 3A:
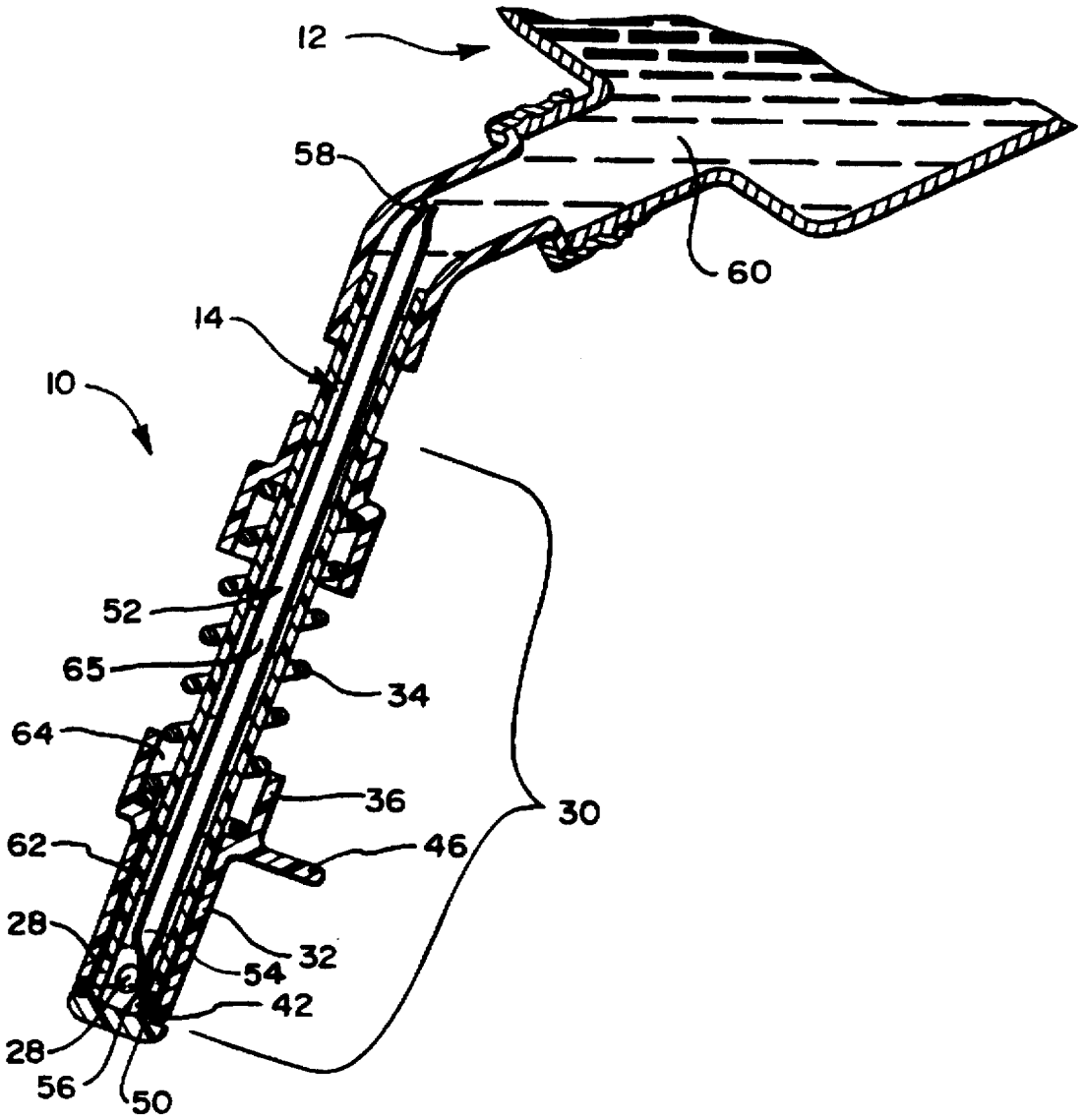
FIG. 3A is a cross-sectional view of the pour spout shown in FIG. 1 in a first stage of operation.

The operation of a pour spout according to the present invention, such as pour spout 10, will now be described in detail in relation to FIGS. 3A, 3B, and 3C in sequence. In FIG. 3A, container 12 holding a reservoir of fluid 60 has been upturned in preparation for transferring a portion of fluid 60 into a receiving vessel. Fluid 60 thus fills the portion of fluid conduit 14 exterior to air vent tube 52. Due to the action of spring 34, sleeve 32 is in the closed position of slide valve 30 urged against O-ring 42, and fluid 60 is precluded from escaping through fluid discharge openings 28 by the inner surface of sleeve 32.

In actual fact, however, unless the fit between sleeve 32 and fluid conduit 14 is exact, a condition which could be predicted to preclude easy sliding of sleeve 32 on fluid conduit 14, fluid does seep through fluid discharge openings 28 into the interstitial space 62 between sleeve 32 and the outer surface of fluid conduit 14.

When container 12 is inverted, fluid initially flows through discharge openings 28, creating a back pressure in container 12 in the space 72 above fluid 60. No air flows through air vent tube 52 for relieving the developing back pressure until such time as that back pressure is sufficiently less than atmospheric pressure to curtail any continued transfers of fluid from fluid drainage discharge 28. At this point, the negative pressure in space 72 is approximately equal to the fluid head pressure developed between the top surface of fluid 60 and fluid discharge openings 28. Under such circumstances, air will begin to enter through air vent tube 52 to permit a continued even-flowing transfer of fluid 60. An arrangement of equipment for demonstrating this sequence of events will be described subsequently.

If air vent opening 50 is located relatively close to the end of fluid conduit 14, then fluid 60 seeping through fluid discharge openings 28 into interstitial space 62 will promptly enter air vent opening 50 and fill capillary section 56 of end 54 of air vent tube 52. This will prevent any air entrapped in air vent tube 52 when container 12 is inverted from escaping through air vent opening 50. The fluid head at the open end of capillary section 58 present due to the reservoir of fluid 60 housed in container 12 in combination with the reduced inner diameter of capillary section 58 will prevent the escape of air from air vent tube 52 through the end thereof remote from air vent opening 50. The result will be a static condition in which an air column 65 is trapped in air vent tube 52 awaiting the next phase of pour spout operation.

The effect of column 65 trapped in air vent tube 52 is critical in two respects to ensuring the prompt flow of fluid during the next stage of operation, when slide 32 is retracted by the co-action of projection 46 with the opening to the receiving vessel for fluid 60. First, column 65 trapped in air vent tube 52 prevents air vent tube from filling up with fluid 60, which would seriously undermine the ability of air vent tube 52 to admit air into the interior space within fluid conduit 14 and container 12. Were air vent tube 52 to fill with fluid 60, like the rest of fluid conduit 14, the fluid head pressure at air vent opening 52 due to the reservoir of fluid 60 thereabove in container 12 would be equal to the fluid head pressure at fluid discharge openings 28. With no differential in head pressure between the fluid discharge openings 28 and the air vent opening 50, no air could enter container 12 to relieve back pressure on fluid 60 even with sleeve 32 retracted. Fluid 60 would not flow, or if it did so, flow would commence on an unpredictable basis.

Air column 65 trapped in air vent tube 52 prevents such venting dysfunctions. The air column 65 creates a head pressure differential between fluid discharge openings 28 and air vent opening 50 due to the difference in head pressure created by air column 65 and the corresponding column of fluid 60 in fluid conduit 14 outside air vent tube 52. The head pressure at fluid discharge openings 28 in the static position depicted in FIG. 3A is that arising due to the full height of the fluid 60 standing above fluid discharge openings 28. On the other hand, the head pressure at air vent opening 50 is in substance equal only to the head pressure developed by the amount of fluid 60 standing above capillary section 58 at the end of air vent tube 52 remote from air vent opening 50.

This is because within air vent tube 52, between capillary section 58 and capillary section 56, no column of fluid 60 is present. Air column 65 adds a negligible amount of head pressure to that exerted on the small quantity of fluid closing capillary section 54 at air vent opening 50. Thus, the head pressure at capillary section 52 is equal to that exerted at capillary section 58, which is transmitted thereto through the compressible air column 65. As the head pressure in fluid 60 at capillary section 58 will always be less than head pressure appearing at fluid discharge openings 28 at the far end of fluid conduit 14, the opening of slide valve 30 will result in fluid flow, promptly, consistently, and continuously through fluid discharge openings 28, while air eventually commences and thereafter continues to be drawn inwardly through air vent tube 52 into the space in container 12 above fluid 60.

Figure 3B:
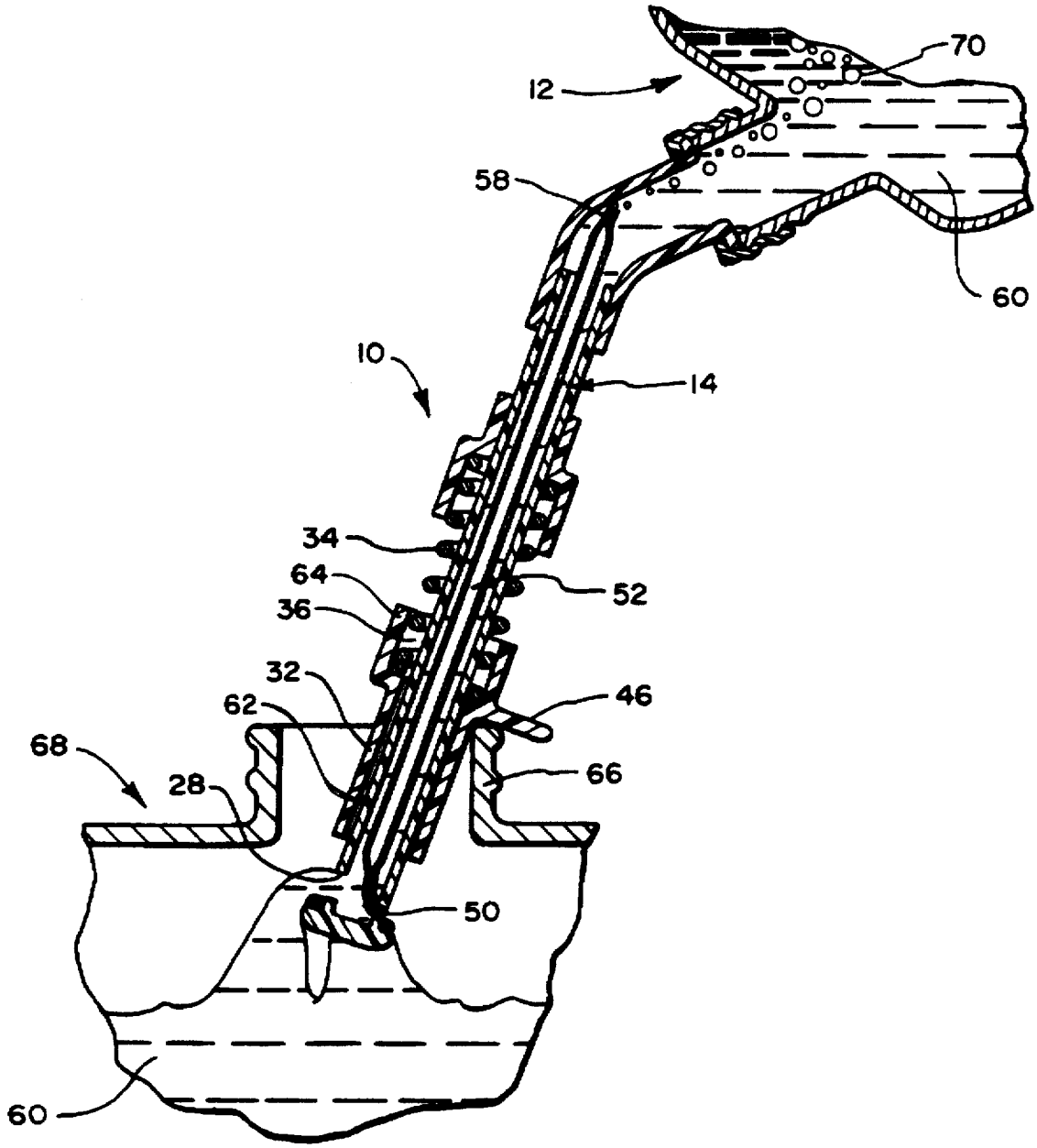
FIG. 3B is a cross-sectional view of the pour spout of FIG. 1 shown in a second stage of operation.

This dynamic state is depicted in FIG. 3B. There, projection 46 secured to sleeve 32 has engaged lip 66 of the opening to a receiving vessel 68 for fluid 60. As container 12 and pour spout 10 attached thereto are further advanced into receiving vessel 68, relative motion between sleeve 32 and fluid conduit 14 occurs, overcoming the bias of spring 34. In this process, it is normally adequate for the operator to merely rest pour spout 10 within receiving vessel 68, so that projection 46 engages lip 66 and then to permit the cumulative weight of container 12 with fluid 60 therein to descend compressing spring 34.

Once sleeve 32 has been drawn toward container 12 exposing fluid discharge openings 28, fluid 60 will flow through these into receiving vessel 68, until sufficient back pressure is developed in space 72 above fluid 60 to substantially curtail continued fluid transfer, and then to induce air flow through air vent tube 52. Air drawn through air vent tube 52 into container 12, is indicated by bubbles 70 emerging from capillary section 58 of air vent tube 52. The back pressure above fluid 60 is maintained during the subsequent even flowing transfer of fluid during which time the volume of fluid flowing out of container 12 is substantially equal to the volume of air flowing thereinto through air vent tube 52. In this position of slide 32, any fluid 60 which seeped through fluid discharge openings 28 into interstitial space 62 or space 64 within spring retainer 36 will drain away into receiving vessel 68.

For the purpose of properly entrapping the bubble of air in air vent tube 52 when fluid container 12 is upturned, it has been found that the inner diameter of air vent tube 52 should be at least 1.5 times, and preferably at least 2.0 times, the inner diameter of any capillary sections therein, such as capillary sections 56, 58. In a pour spout having a fluid conduit 14 with an inner diameter of 0.50 inches and five fluid discharge openings 28 each having an inner diameter of 0.218 inches, capillary sections, such as capillary sections 56, 58, having inner diameters of 0.070 inches have proved entirely satisfactory when used with a container 12 holding gasoline.

The purpose of creating and maintaining back pressure above fluid 60 is to afford enhanced responsiveness in shutting off continued fluid flow when receiving vessel 68 becomes filled. When airflow through air vent tube 52 is terminated, the back pressure above the reservoir of fluid 60 causes fluid flow through fluid discharge openings 28 to cease almost simultaneously. No delay or passage of fluid out of conduit 14 is required in order to generate the back pressure above fluid 60 with which to terminate its flow. This back pressure is present with the pour spout of the present invention, even in the dynamic pouring state illustrated in FIG. 3B.

Figure 3C:
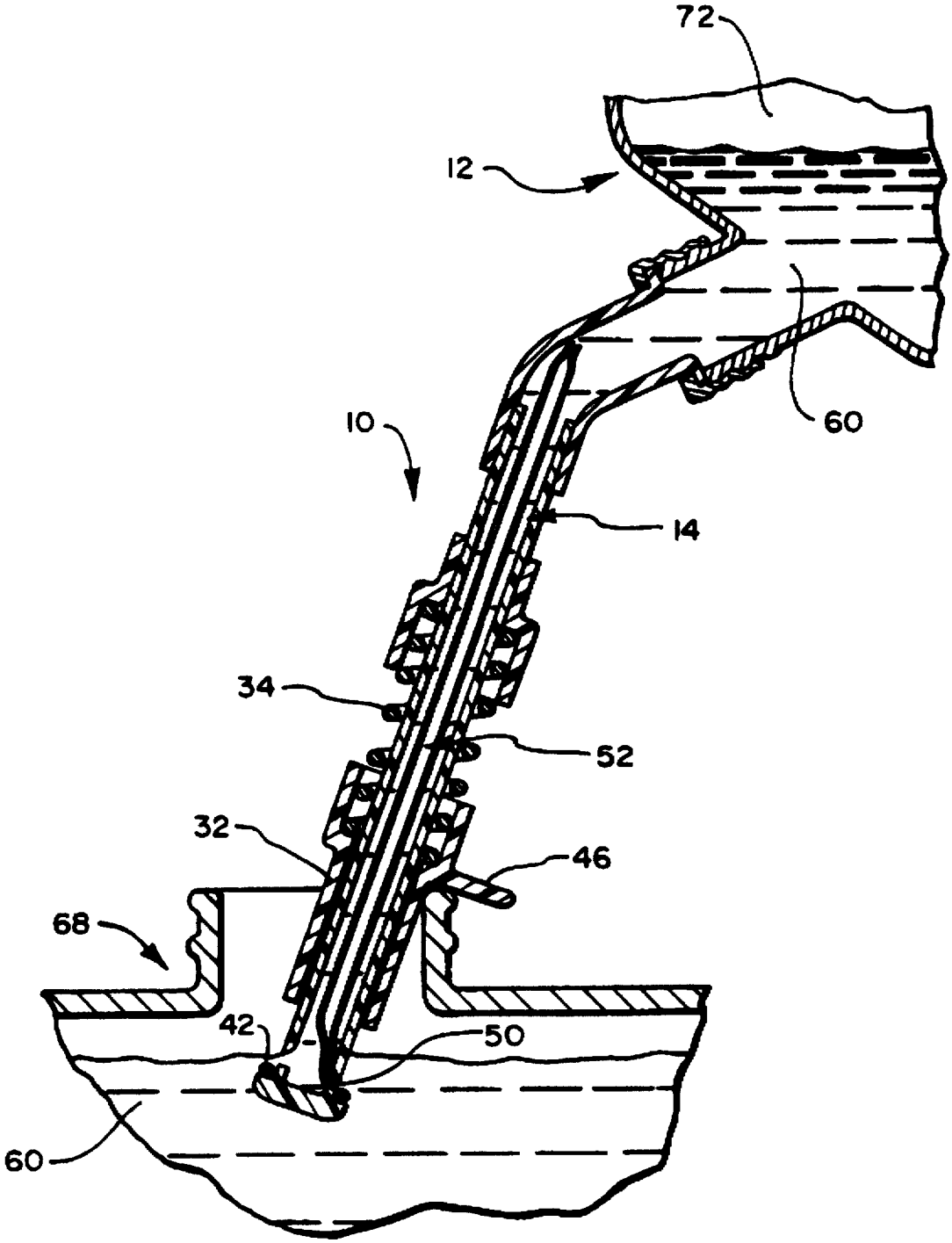
FIG. 3C is a cross-sectional view of the pour spout of FIG. 1 shown in a third stage of operation.

The stoppage of fluid flow is depicted in FIG. 3C. There, the level of fluid 60 in receiving vessel 68, has risen, due to the transfer of fluid 60, to a point at which fluid 60 obstructs air vent opening 50, thereby terminating air flow through vent tube 52 into the interior of container 12. The partial vacuum in space 72 above fluid 60 in container 12 exerts back pressure upon the further flow of fluid 60 from fluid conduit 14, and a condition of fluid stasis again results.

The operator of a pour spout, such as pour spout 10, need not peer into the opening into receiving vessel 68, or anxiously await the overflow of fluid 60 therefrom. Instead, after inserting pour spout 10 into receiving vessel 68, the operator can be secure in the knowledge that when receiving vessel 68 has filled with fluid 60 to the point that air vent opening 50 at the end of pour spout 10 is covered by fluid 60, all flow will stop. Thereafter, lifting of container 12 will remove pour spout 10 from receiving vessel 68, and the bias of spring 34 will return sleeve 32 into sealing engagement with O-ring 42. This thereafter prevents any loss of fluid from fluid discharge openings 28 during the time that container 12 is being returned to the upright.

Thus, the venting means of the present invention is one that not only admits air into the interior space within the container from which fluid is being dispensed after a negative pressure is developed thereabove, but the venting means also terminates air flow into the interior space when the receiving container for that fluid becomes filled. This effects a prompt curtailment of fluid flow through the fluid conduit into the receiving vessel. This overflow protection keeps excess fluid from emerging as overflow out of the receiving container.

The operation of an air vent tube, such as air vent tube 52, in conjunction with at least one capillary section, such as capillary sections 56 or 58, is so advantageous in venting of a container of fluid and in preventing overflow when fluid is transferred from that container into a receiving vessel, that such an air vent tube has utility in pour spouts, apart from the inclusion therein of any slide valve, such as slide valve 30. Under such circumstances, the air vent tube communicates between the space exterior to fluid conduit 14 at a location adjacent fluid discharge openings 28 and the interior space within container 12. Satisfactory venting and a limited form of overflow protection would then be available, provided that the end of fluid conduit 14 were located within the receiving vessel during the transfer of fluid and withdrawn therefrom in a quick motion simultaneously upturning container 12 once flow from container 12 had terminated. While a device of this type would not provide the complete spill protection afforded in pour spout 10 with slide valve 30, it would nevertheless be an improvement over some existing pour spout devices and is accordingly considered to be part of the inventive pour spout. In such a configuration, air vent tube 52 could for a substantial portion of its length also be located on the exterior of fluid conduit 14.

Figure 4:
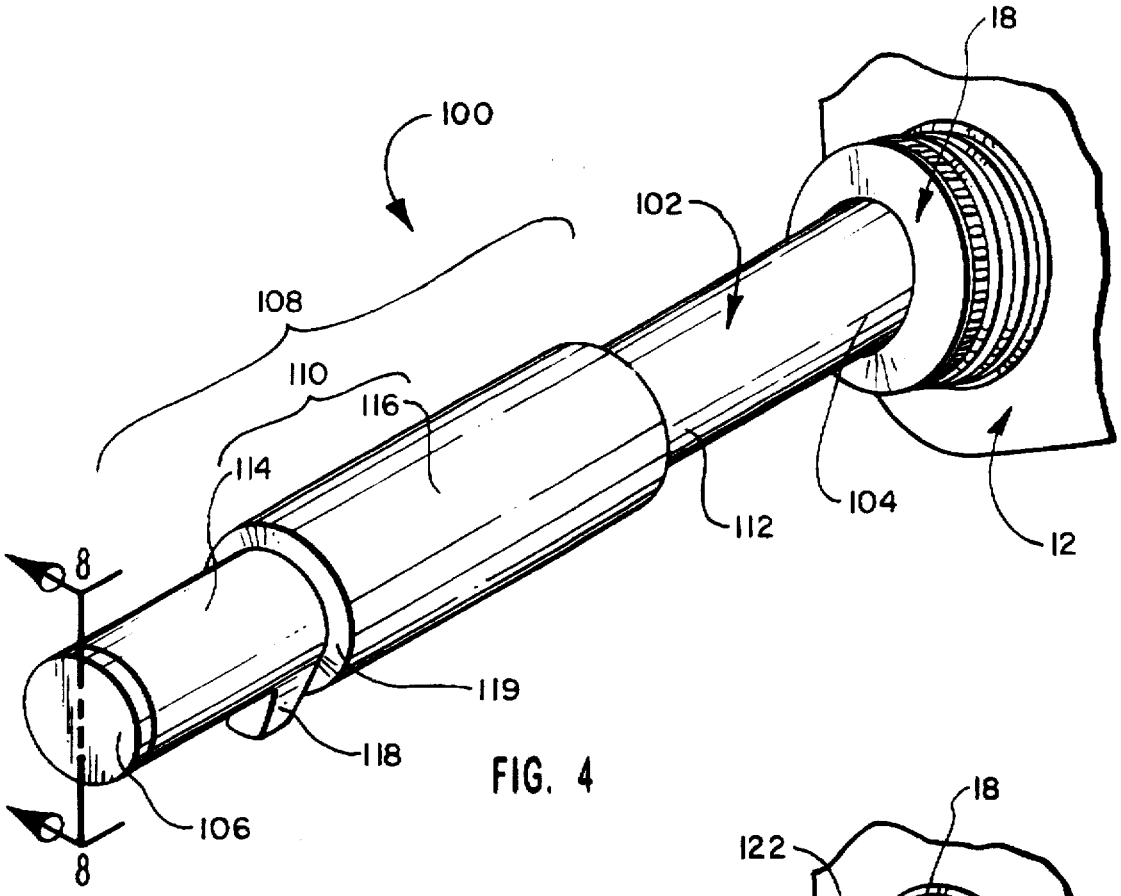
FIG. 4 is a perspective view of a second embodiment of a pour spout incorporating teachings of the present invention with the slide valve thereof in its closed position.

FIG. 4 depicts a second embodiment of a pour spout 100 incorporating teachings of the present invention. Pour spout 100 comprises a fluid conduit 102 having one end 104 thereof attached to container 12 using an annular, threaded cap 18. Alternatively, pour spout 100 may be fabricated with container 12 as an integral, non-removable portion thereof.

Remote end 106 of fluid conduit 102 is provided with a fluid discharge opening not shown in FIG. 4, but disclosed in detail subsequently. Through this fluid discharge opening, the fluid in container 12 can be transferred into a receiving vessel. In accordance with one aspect of the present invention, a closure means is provided for precluding any such transfer of the fluid from fluid conduit 102, until the fluid discharge opening thereof is inside the receiving vessel. The exterior of such a closure means is shown by way of example in FIG. 4 as comprising a slide valve 108 taking the form of a sleeve 110 closely conforming to the exterior surface 112 of fluid conduit 102 and mounted for sliding motion thereupon. In FIG. 4, slide valve 108 is shown in the closed position thereof in which transfer of fluid from fluid conduit 102 is precluded.

The end of sleeve 110 remote from container 12 takes the form of a tubular portion 114 which effects actual sliding contact with exterior surface 112 of fluid conduit 102 and in the closed position slide valve 108 terminates in sealing engagement with remote end 106 thereof. Integrally formed with tubular portion 114 at the end thereof closest to container 12 is a cylindrical skirt portion 116 of sleeve 110, which has a diameter enlarged in relation to that of tubular portion 114. As will be disclosed in relation to further figures, skirt portion 116 encloses and conceals a bias means for urging slide valve 108 into the closed position thereof illustrated in FIG. 4.

In accordance with another aspect of the closure means of the present invention, a slide valve release means is provided for co-acting with a receiving vessel to move slide valve 108 out of the closed position as remote end 106 of fluid conduit 102 and the discharge opening therein enter into the receiving vessel. As shown by way of example and not limitation, a projection 118 is secured to sleeve 110 at a juncture 119 between tubular portion 114 and skirt portion 116. Projection 118 catches the lip of any receiving vessel into which fluid from container 12 is to be transferred. As remote end 106 of fluid conduit 102 is thereafter advanced into the receiving vessel, projection 118 draws sleeve 110 along the exterior of fluid conduit 102 towards container 12 and out of the closed position of slide valve 108.

Figure 5:
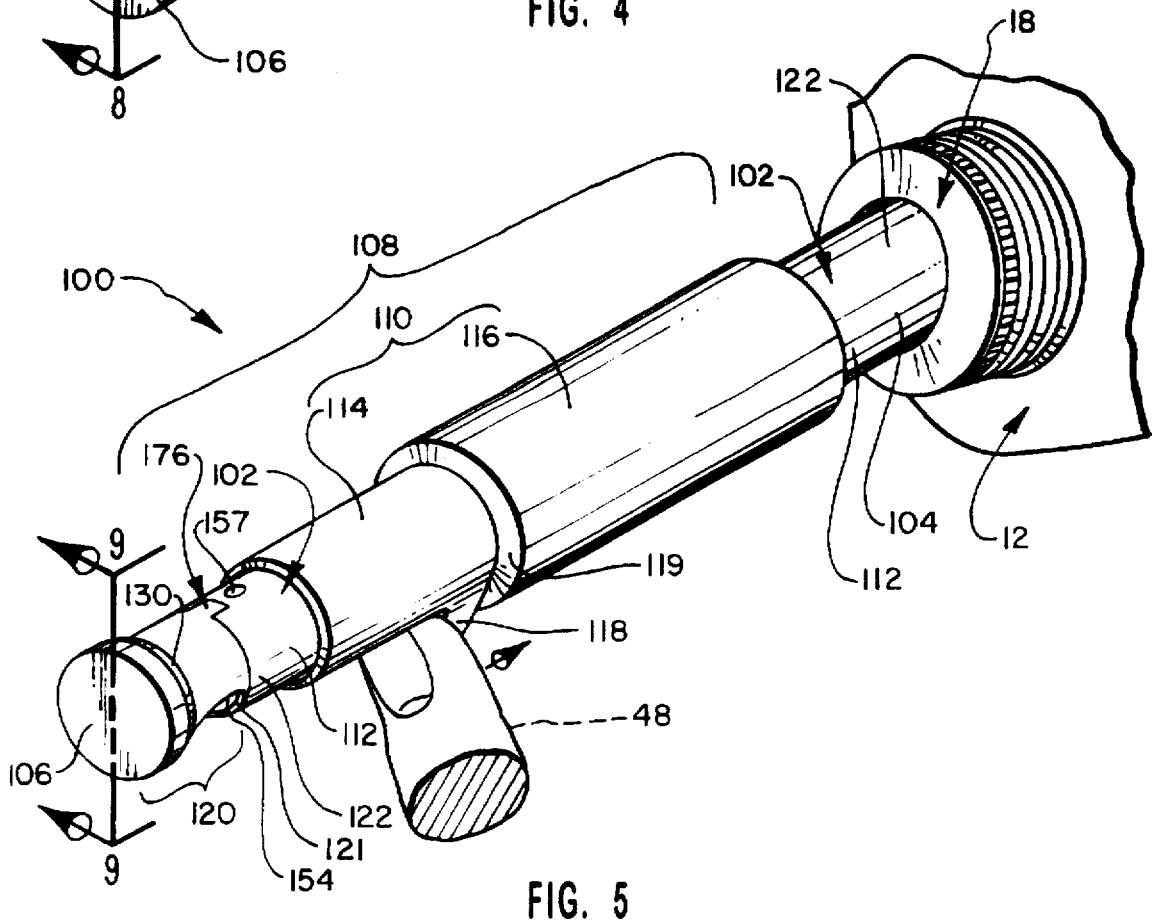
FIG. 5 is a perspective view of the pour spout of FIG. 4, with the slide valve thereof in its open position.

FIG. 5 illustrates the relationship of the parts of pour spout 100 when such relative motion has overcome the bias means normally operative on slide valve 108, and sleeve 110 is no longer in the closed position of slide valve 108. In the instance illustrated in FIG. 5, however, the force upon projection 118 necessary to effect such a result is being applied by a finger 48 of an operator. The same operation is nevertheless effected when remote end 106 of fluid conduit 102 is moved into a receiving vessel, so that projection 118 co-acts therewith.

In FIG. 5, movement of sleeve 110 from the position illustrated in FIG. 4 under the influence of the force applied by finger 48 reveals that remote end 106 of fluid conduit 102 is the terminus of a fluid conduit end cap 120 which is attached to and at least partially closes the free end 121 of a tube 122. Tube 122 comprises substantially most of the length of fluid conduit 102 terminating at cap 18 where tube 122 is secured to container 12 in a conventional manner.

Figures 6, 7:
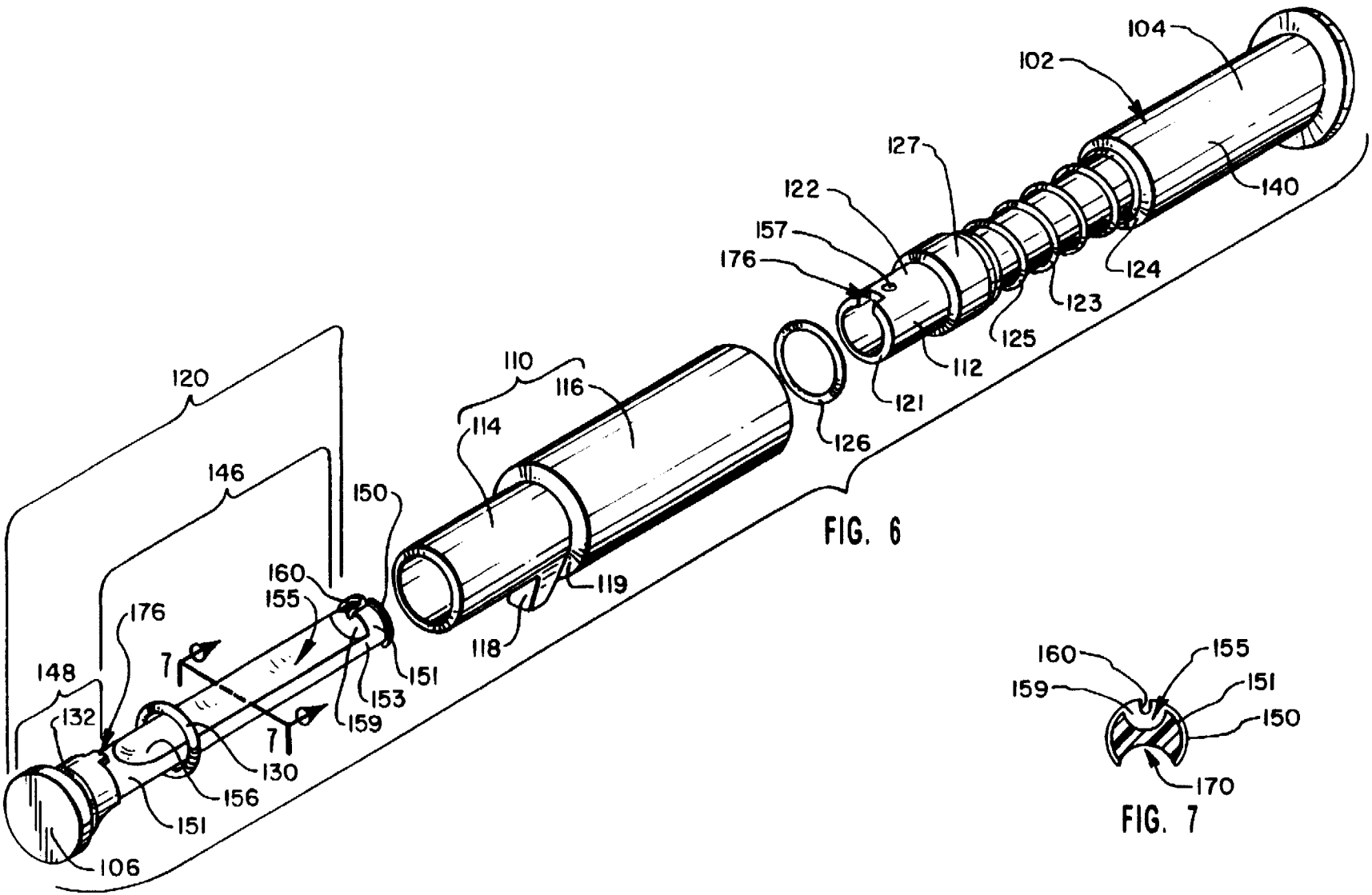
FIG. 6 is an exploded perspective view of the components of the pour spout of FIGS. 4 and 5.
FIG. 7 is a cross-sectional view of the end cap of the pour spout of FIG. 6 taken along section line 7—7 therein.

The internal elements of pour spout 100 will be better appreciated by reference to FIGS. 6 and 7 which illustrate those elements in exploded disassembly. In conjunction therewith, reference will be made as required to the cross-sectional views of structures shown in FIGS. 4 and 5 which appear in FIGS. 8 and 9, respectively.

The structures of slide valve 108 of the present invention will be investigated initially. These include a spring 123 which encircles fluid conduit 102 inside of skirt portion 116 of sleeve 110. Spring 123 is held in compression between sleeve 110 and a spring-retaining collar 124 longitudinally fixed to exterior surface 112 of fluid conduit 102. End 125 of spring 123 is disposed remote from container 12.

Slide valve 108 further includes a resilient, sleeve overflow seal 126 which slidably encircles exterior surface 112 of fluid conduit 102 on the side of the fluid discharge opening adjacent the container of fluid. Sleeve overflow seal 126 is designed to slide along fluid conduit 102 with sleeve 110. In addition, a sleeve overflow seal protection washer 127 encircles fluid conduit 102 on the side of sleeve overflow seal 126 opposite from the fluid discharge opening.

Figure 8:
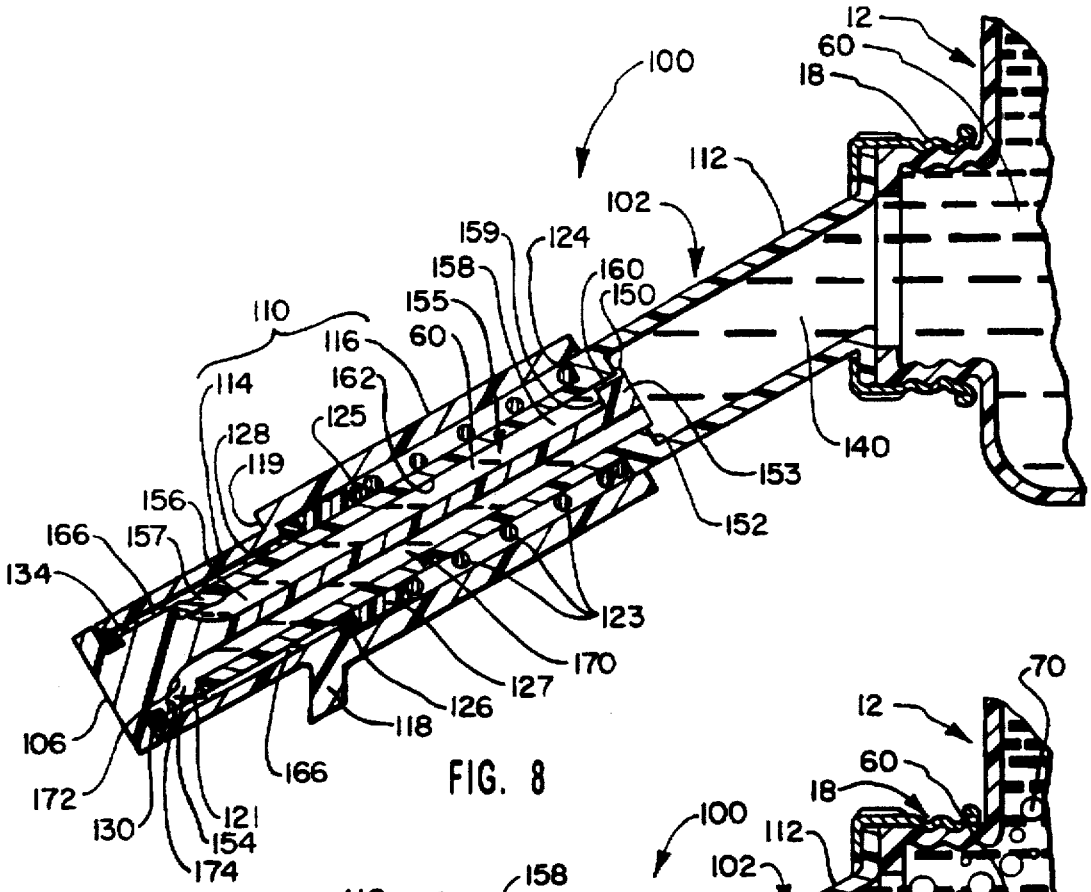
FIG. 8 is a cross-sectional elevation view of the full length of the pour spout shown in FIG. 4 taken along section line 8—8 therein.
Figure 9:
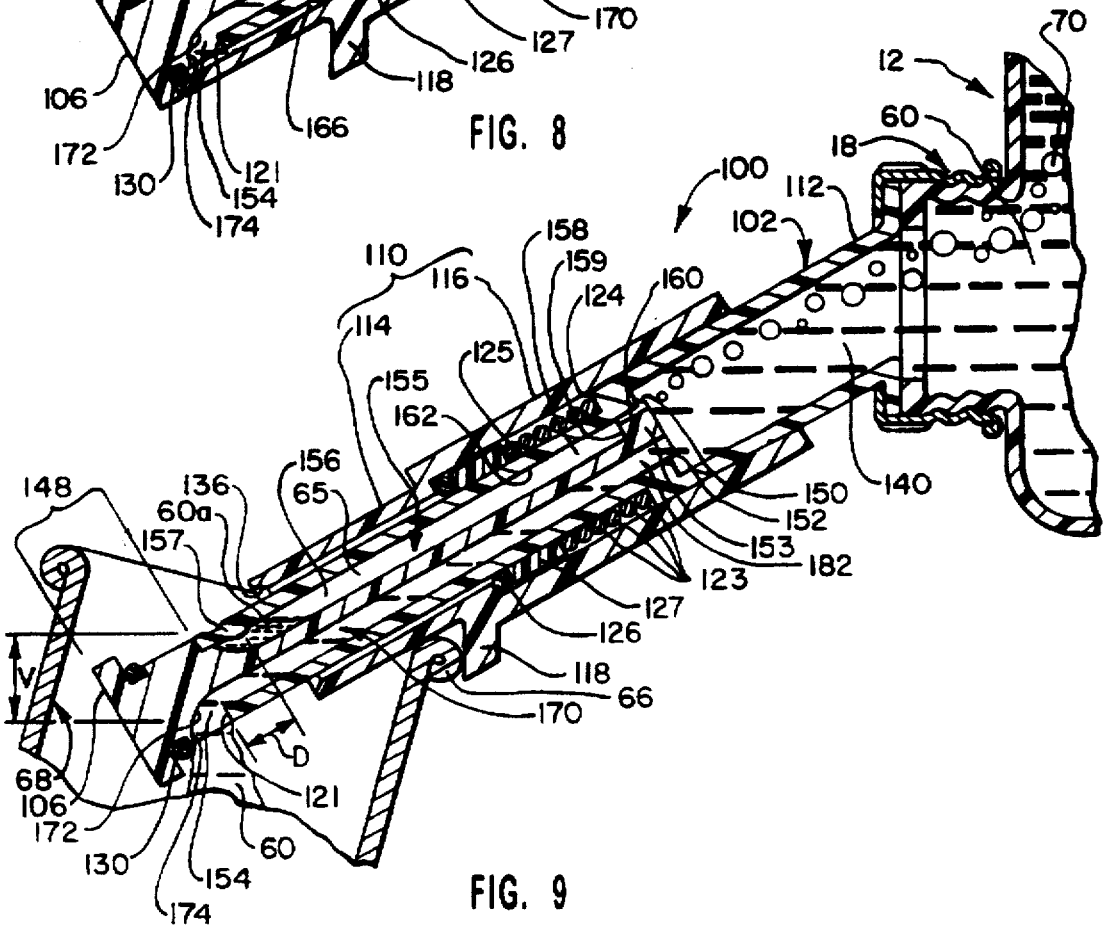
FIG. 9 is a cross-sectional elevation view of the full length of the pour spout shown in FIG. 5 taken along section line 9—9 therein.

As is more fully appreciated by reference to the cross-sectional views contained in FIGS. 8 and 9, end 125 of spring 123 bears against sleeve overflow seal protection washer 127, which in turn bears against sleeve overflow seal 126. In this manner, sleeve overflow seal 126 is urged into sealing engagement with inner surface 128 of sleeve 110 at juncture 119 thereof. As will be disclosed in additional detail subsequently, these structures combine to function as an inversion protection means for precluding overflow of fluid from the end of sleeve 110 adjacent container 12 when sleeve 110 is in the closed position of sleeve 110 of slide valve 108 and container 12 with pour spout 100 attached thereto is inverted into the position shown in FIG. 8.

According to another aspect of the present invention, the closure means thereof further comprises a valve seat on fluid conduit 102 on the side of the fluid discharge opening thereof remote from container 12. As shown by way of example in FIG. 6, a resilient, slide valve seal 130 is retained on fluid conduit 102 in a recessed groove 132 encircling fluid conduit 102 near the tip of remote end 106 thereof. Slide valve seal 130 may comprise a lathe-cut seal, a square-ring seal, or even an O-ring seal made of a material that resists degradation from the type of fluid contemplated for use with pour spout 100 and container 12.

Fluid conduit 102 may be fabricated as a unitary structure. As shown in FIG. 8, however, fluid conduit 102 advantageously comprises an open-ended tube 122 having a first end 140 opening into container 12 and a second or free end 121 terminating within sleeve 110. Attached to and at least partially closing second end 121 of tube 122 is a fluid conduit end cap 120 which is preferably formed from a plastic material by a precision injection-molding technique. As best understood from FIG. 6, end cap 120 comprises an elongated first portion 146 which is inserted into second or free end 121 of tube 122 and a second portion 148 which remains exterior thereto.

End cap 120 is retained in tube 122 by a cooperating retention means for snappingly retaining first portion 146 of end cap 120 in second or free end 121 of tube 122. As best understood by reference to FIGS. 6 and 7, a retention lip 150 extends radially from the outer surface 151 of the end 153 of first portion 146 of end cap 120 adjacent container 12. Correspondingly, as seen in FIGS. 8 and 9, a retention shoulder 152 is formed on the interior of tube 122. Retention lip 150 resiliently engages retention shoulder 152 when first portion 146 of end cap 120 is fully inserted into second end 121 of tube 122.

Naturally, a structure such as retention lip 150 need not be located at end 153 of first portion 146, but may be positioned at such a location on first portion 146 as to cooperatively engage a structure such as retention shoulder 152 on the interior of tube 122. In addition, retention lip 150 need not fully encircle first portion 146 of end cap 120, but may be a circumferentially abbreviated projection, such as a tab or post. Alternatively, however, end cap 120 can be secured in tube 122 by other means, including diverse forms of bonding.

In accordance with another aspect of the present invention, venting means are provided for admitting air into the interior space within fluid conduit 102 and container 12 during transfers of fluid from container 12, thus enabling an even-flowing transfer of fluid out of container 12. The admission of air begins, however, only after an initial transfer of fluid through the discharge opening of pour spout 100 has taken place without air being admitted into the interior space. This reduces the pressure of air in container 12 below atmospheric pressure.

Thus, back pressure is initially developed in container 12 while some fluid is transferred therefrom. As that back pressure increases to the point that continued fluid transfer would cease or involve surges and gulps, the venting means of the present invention commences to admit air into container 12. This enables an even outflow of fluid to continue. This situation persists either until fluid conduit 102 is removed from the receiving vessel, closing slide valve 108, or until fluid in the receiving vessel rises to a level that blocks the entry of air into the venting means. Thereupon, air flow into the interior space through the venting means of the present invention is terminated and fluid outflow from container 12 is promptly curtailed.

The abrupt stoppage of fluid outflow is essential if overflow of the receiving vessel is to be avoided. This object is attained through the cooperative action of airflow termination through the venting means and the existence of back pressure in container 12 throughout the entire pouring process. Were the back pressure to begin to be developed only at the time that the receiving vessel was approaching fullness, overflow protection would be uncertain. Before the cessation of fluid transfer could be achieved, the requisite back pressure would have to be developed inside container 12. For this to occur, an additional quantity of fluid would necessarily be transferred from fluid conduit 102. This additional quantity of fluid could cause the receiving container to overflow.

The venting means of the present invention as embodied in pour spout 100 comprises an air vent passageway communicating between the interior space and the exterior of fluid conduit 102 at a location which is inside the receiving vessel when the closure means described above ceases to preclude transfer of fluid from fluid conduit 102. This is the situation illustrated in FIG. 9, where the capture of projection 118 on lip 66 of receiving vessel 68 and the subsequent advancement of container 12 theretoward has moved slide valve 108 out of the closed position thereon, revealing second or free end 121 of tube 122 and end cap 120 secured therein. Discharge opening 154, which is visible in FIG. 9, is then free of obstruction, and fluid 60 begins to be transferred from container 12. The structure of discharge opening 154 will be investigated in some detail below after a disclosure of the structure of the embodiment of the venting means utilized with pour spout 100.

For this latter purpose, reference should first be made to FIG. 6, showing end cap 120 with first portion 146 thereof removed from second or free end 121 of tube 122. An elongated air vent recess 155 oriented parallel to the longitudinal axis of fluid conduit 102 is formed in outer surface 151 of first portion 146 of end cap 120. Air vent recess 155 extends neither to second portion 148 of end cap 120, nor to end 153 of first portion 146 intended to be adjacent to container 12. Instead, the end 156 of air vent recess 155 remote from container 12 terminates at a location within tube 122 that is inside a receiving vessel when the closure means described above ceases to preclude transfer of fluid from discharge opening 154.

At such a location, an outer air vent aperture 157 is formed through tube 122 so as to communicate with end 156 of air vent recess 155. Outer air vent aperture 157 is formed through fluid conduit 102 at a location which is on the opposite side of fluid conduit 102 from discharge opening 154 and which is disposed longitudinally along fluid discharge conduit at a distance D toward container 12 from discharge opening 154. Advantageously, the cross-sectional area of air vent recess 155 is greater than that of outer air vent aperture 157. In this manner outer air vent aperture 157 can function as a capillary section, such as capillary section 58 of pour spout 10 shown in FIG. 2.

The cross-sectional area of air vent recess 155 may, for example, be greater than or equal to 1.5 times the cross sectional area of outer air vent aperture 157. More preferably, the cross-sectional area of air vent recess 155 is two times that of outer air vent aperture 157.

As seen to best advantage in FIGS. 8 and 9, at end 158 of air vent recess 155 and adjacent container 12, air vent recess 155 terminates in a wall 159, the top of which comprises a portion of outer surface 151 of first portion 146 of end cap 120. Through wall 159 and in outer surface 151 is formed groove or inner air vent aperture 160 which communicates between end 158 of air vent recess 155 and the interior space within fluid conduit 102 and container 12. As best illustrated in FIGS. 8 and 9, inner air vent aperture 160 can be seen to be defined by the groove formed through wall 159 and by the inner surface 162 of tube 122 when first portion 146 of end cap 120 is inserted into second end 121 of tube 122. Inner air vent aperture 160 has a cross-sectional area which is less than the cross-sectional area of air vent recess 155. In this manner inner air vent aperture 160 can function as a capillary section, such as capillary section 58 of pour spout 10 shown in FIG. 2.

Thus, the cross-sectional area of air vent recess 155 may be greater than or equal to two times that of air vent aperture 160, or more preferably, three times the cross-sectional area of air vent aperture 160.

When first portion 146 of end cap 120 is inserted into second or free end 121 of tube 122, air vent recess 155 in combination with inner surface 162 of tube 122 defines an air vent passageway that communicates between the interior space within container 12 and pour spout 100 and the exterior of fluid conduit 102 at a location that is inside a receiving vessel when the closure means described above ceases to preclude the transfer of fluid from fluid conduit 102. Located in the air vent passageway are a pair of capillary sections having cross-sectional areas less than that of the air vent passageway itself. The capillary sections take the form of outer air vent aperture 157 and inner air vent aperture 160.

For a better understanding of the operation of the venting means of the present invention, reference should be made to FIG. 8 showing sleeve 110 of slide valve 108 in the closed position thereof in combination with FIG. 9 showing the same structure, but with sleeve 110 of slide valve 108 out of the closed position thereof.

As seen in the latter of these figures, outer air vent aperture 157 is formed through second or free end 121 of tube 122 at a location which is inside receiving vessel 68 when slide valve 108 ceases to preclude transfer of fluid therefrom. The mechanism of fluid transfer will be investigated in detail subsequently. The air vent passageway defined by air vent recess 155 and inner surface 162 of tube 122 communicates at end 156 with the exterior of tube 122 through outer air vent aperture 157. Outer air vent aperture 157 has a cross-sectional area that is less than that of the air vent passageway, thus functioning as a first capillary section interposed in the air vent passageway.

End 156 of air vent recess 155 in turn communicates with the interior space inside fluid conduit 102 and container 12 through a second capillary section taking the form of inner air vent aperture 160 defined by the groove in outer surface 151 at the top of wall 159 and the inner surface 162 of tube 122. Alternatively, a structure equivalent to air vent recess 155 could take the form of an aperture formed through wall 159.

End cap 120 may be made of injection molded plastic in a known manner, while outer air vent aperture 157 can be formed through tube 122 in any known conventional manner. By the air vent passageway and associated capillary sections which result from the cooperating structure formed by the insertion of first portion 146 of end cap 120 into second or free end 121 of tube 122 can thus be precisely controlled in size without recourse to complicated machining. In addition, only two components are involved, resulting in a pour spout ventilation system which is extremely simple and efficient to manufacture. Inner air vent aperture 160, and outer air vent aperture 157 to a more limited extent, together function as a constriction means for retarding the entry of fluid into the disclosed air vent passageway when fluid is being transferred from container 12 to a receiving vessel.

The manner in which this phenomena occurs and the advantages thereof are similar to those disclosed in relation to the retention of an air column in air vent tube 52 in FIGS. 3A, and 3B above. As also discussed earlier, in relation to FIG. 3A, when container 12 with pour spout 10 attached thereto is inverted preparatory to pouring, fluid therefrom enters interstitial space 166 between sleeve 110 and fluid conduit 102. As the fluid in interstitial space 166 increases, the level thereof will rise until the fluid reaches the end of sleeve 110 adjacent container 12. This offers the undesirable potential for overflowing of fluid from skirt portion 116 of sleeve 110 when container 12 is inverted for any substantial amount of time. Accordingly, the pour spout of the present invention further comprises inversion protection means for precluding overflow of fluid accumulating in interstitial space 166 from the end of sleeve 110 adjacent container 12.

As shown, for example, in FIG. 8, one embodiment of such an inversion protection means takes the form of sleeve overflow seal 126 which is urged into sealing engagement with inner surface 128 of sleeve 110 at juncture 119 by the action of compressed spring 123 in urging sleeve overflow seal protection washer 127 against sleeve overflow seal 126. These structures prevent fluid in interstitial space 166 from even entering the interior of skirt portion 116.

FIGS. 8 and 9 lend a fuller appreciation of the structure and functioning of discharge opening 154. Discharge opening 154 communicates with the interior of fluid conduit 102 through a discharge passageway formed in end cap 120 as an elongated fluid recess 170 oriented parallel to the longitudinal axis of fluid conduit 102. Fluid recess 170 traverses the full length of first portion 146 of end cap 120 and a section of second portion 148 contiguous therewith. That part of fluid recess 170 formed in second portion 148 of end cap 120 terminates in discharge opening 154.

Advantageously, at the end of fluid recess 170 remote from container 12 the wall 172 of discharge passageway closest to the center of fluid conduit 102 turns outwardly from the center of end cap 120 and intersects the exterior thereof to form the edge 174 of discharge opening 154 remote from container 12. In this manner, fluid transferred through fluid recess 170 and discharge opening 154 is imparted a substantial component of momentum away from container 12 and parallel to the longitudinal axis of fluid conduit 102. This eliminates splashing of the fluid from the receiving vessel 68 by insuring that fluid being transferred from container 12 does not impact the walls or lip 66 of the receiving vessel 68 in a direction normal thereto.

End cap 120 is inserted into second or free end 121 of tube 122 and snapped into place by the action of retention lip 150 and retention shoulder 152. To assist in the correct rotational placement of end cap 120 in second or free end 121 of tube 122, a slot-and-key system 176 shown by way of example in FIG. 5 may be adopted. In this manner, the assembly of end cap 120 into second or free end 121 of tube 122 will be insured to place air vent recess 155 in communication with outer air vent aperture 157.

Typical sizes for elements of a pour spout 100 having an inside diameter of 0.50 inches include a fluid recess 170 having a cross-sectional area of 0.30 square inches in combination with an air vent recess having a cross-sectional area of 0.15 square inches. In such a structure, inner air vent aperture 160 would have a cross-sectional area of approximately 0.050 square inches, while outer air vent aperture would have a cross-sectional area of approximately 0.07 square inches. Advantageously, the longitudinal distance D shown in FIG. 9 between outer air vent aperture 157 and discharge opening 154 should be at least 0.25 inches. A pour spout 100 having elements thereof provided with such dimensions will produce acceptable functioning when used with a container for gasoline having a volume in the range of from approximately 1.0 gallons to approximately 2.5 gallons.

It will prove useful relative to the subsequent discussion of yet additional embodiments of vented pour spouts to discuss briefly the variation by location within pour spout 100 of the pressure in fluid 60 during static conditions and during an assortment of dynamic conditions in which fluid 60 is being dispensed from discharge opening 154.

With container 12 inverted as in FIG. 8 and with slide valve 108 in the closed position thereof, fluid 60 gives rise to head pressure which is maximized at the lowest point in pour spout 100. Preferably, this is at discharge opening 154. The head pressure caused by fluid 60 decreases upwardly therefrom through fluid 60 to the surface thereof in container 12. When slide valve 108 is drawn out of the closed position thereof shown in FIG. 8 into the open position illustrated in FIG. 9, fluid 60 flows out of container 12 through pour spout 100, and this is no longer the case.

First, a period ensues in which fluid 60 flows out of container 12 while no air is admitted thereinto. This causes a back pressure to be developed in container 12 above the surface of fluid 60. This back pressure increases directly relative to the total volume of fluid 60 that has flowed out of container 12 through pour spout 100. In the process, the fluid head pressure within fluid 60 itself is progressively offset by the effect of the back pressure created thereabove in container 12. Eventually, the back pressure becomes sufficiently strong enough to offset the head pressure of fluid 60 at outer air vent aperture 157, whereupon the venting of air therethrough into container 12 commences.

As discussed above, this ingress of air through outer air vent aperture 157 reestablishes air column 65 in air vent recess 155 and a dynamic state results in which fluid 60 flows out of discharge opening 154 and a corresponding volume of air enters container 12 through air vent recess 155. In this dynamic state of vented fluid flow, the highest head pressure produced by fluid 60 is located well upstream from discharge opening 154 or fluid recess 170, inside first end 140 of tube 122 above entry 182 into fluid recess 170.

In the dynamic state of vented fluid flow the point of highest head pressure produced in fluid 60 defines the location of what will be referred to hereinafter as an "effective fluid outlet". Downstream of this effective fluid outlet fluid 60 flows with ever increasing freedom, and therefore decreasing head pressure toward, into, and out of fluid recess 170 through fluid discharge opening 154. At some point along the path of outflow the static head pressure in the fluid disappears altogether. This is the so-called "point of zero head pressure" in the fluid flow. The precise position of the effective fluid outlet and the point of zero head pressure during dynamic flow will vary according to a number of factors, a few of which will be discussed subsequently.

During the dynamic state of vented outflow of fluid 60, the amount of back pressure developed above fluid 60 in container 12 will remain in a range that is greater than the amount of head pressure produced in fluid 60 at inner air vent aperture 160, but less than the amount of maximum head pressure produced in fluid 60 at the effective fluid outlet. Whenever the back pressure deviates from this range, uniform vented outflow of fluid 60 is impaired.

When the back pressure above fluid 60 in container 12 becomes less than the amount of head pressure produced in fluid 60 at inner air vent aperture 160, the inflow of air bubbles 70 ceases. The outflow of fluid 60 then slows, and the operation of the pour spout reverts temporarily to one of fluid outflow without any air venting. Eventually, through the outflow of fluid 60 under these conditions the amount of back pressure above fluid 60 in container 12 will again increase to a degree that it is equal to or greater than the head pressure produced in fluid 60 at inner air vent aperture 160. Then desirable vented fluid outflow will resume.

The result is a first type of operational cycling between vented and unvented fluid outflow. While a pour spout, such as pour spout 100, producing such a first type of operational cycling is still considered to be within the scope of the present invention, cycling represents a less than optimum arrangement of the size of the components of pour spout 100 for the type of container 12 and fluid 60 to be dispensed.

On the other hand, when the back pressure above fluid 60 in container 12 exceeds the maximum of head pressure produced in fluid 60 at the effective fluid outlet, air will be drawn up fluid recess 170 producing gulping flow. The air drawn up above fluid 60 and permit the system to temporarily resume the desired vented fluid outflow. The result is a second type of operational cycling between vented and gulping fluid outflow.

While a pour spout, such as pour spout 100, producing such a second type of operational cycling is still considered to be within the scope of the present invention, cycling represents a less than optimum arrangement of the size of the components of pour spout 100 for the type of container 12 and fluid 60 to be dispensed.

If the cross section of fluid recess 170 is overly large relative to the cross section of the smaller of outer air vent aperture 157 and inner air vent aperture 160, then fluid 60 will flow through fluid recess 170 at a volumetric rate in excess of the rate at which air can be vented through air vent recess 155 into container 12. Whenever this occurs, the back pressure above fluid 60 in container 12 will increase to an extent that is capable of overcoming even the maximum head pressure in fluid 60 at the effective fluid outlet in fluid recess 170. Then, air will be drawn up fluid recess 170, producing gulping flow. This will occur on a periodic basis, whereby undesirable splashing of fluid 60 into receiving container 68 will be produced.

Any combination of the physical parameters just discussed may be appropriate in any given situation. Such variations in the relative sizes and positions of structural elements of pour spout 100 are considered to be within the scope of the present invention.

Pour spout performance is influenced in addition by the volume and tallness of container 12, the relative fullness of container 12, the viscosity and density of the fluid therein, and the diameter and length of fluid conduit 102.

The series of FIGS. 10A, 10B, 10C, and 10D illustrate selected of these features of fluid flow through vented pour spouts, such as pour spout 10 in FIG. 1, pour spout 100 in FIG. 4, and even the additional embodiments of pour spouts to be disclosed hereinafter.

Figure 10A:
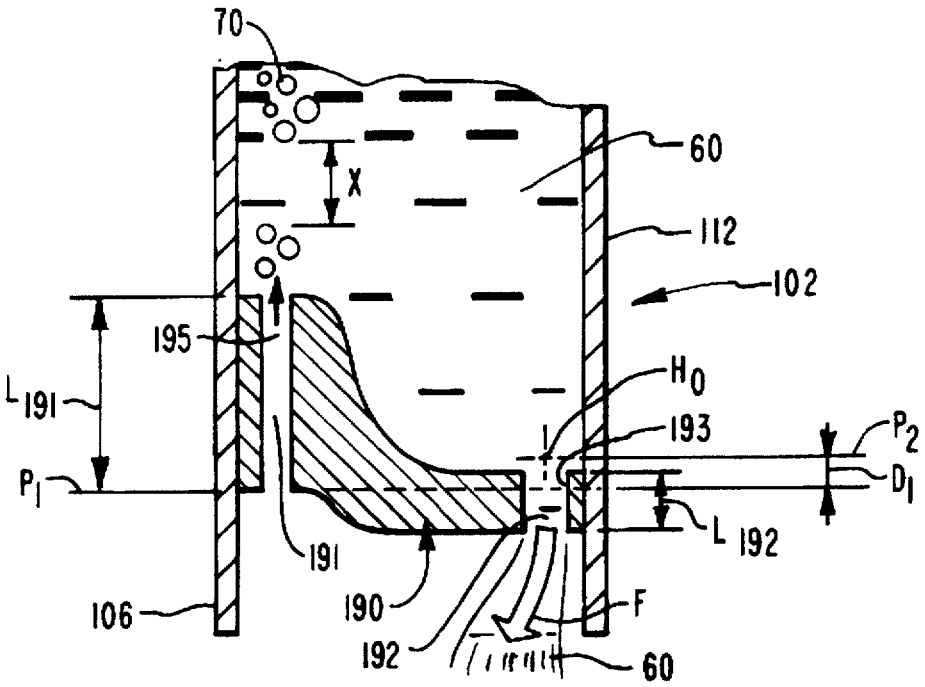
FIG. 10A is a schematic diagram of selected functions operative during the pouring of fluid from a pour spout.
Figure 10B:
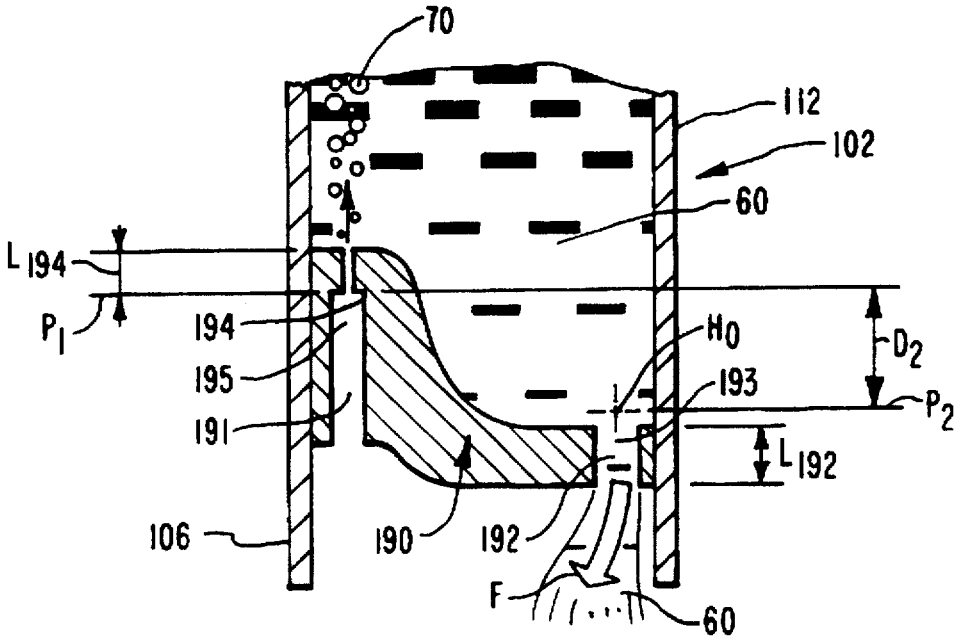
FIG. 10B is a schematic diagram of additional selected functions operative during pouring of a fluid from the pour spout of FIG. 1.

In FIG. 10A, a stylized barrier 190 is illustrated disposed across the interior of fluid conduit 102, thereby impeding the outflow therethrough of fluid 60. Stylized barrier 190 contains a relatively elongated air vent passageway 191 through which bubbles 70 of air pass upwardly into the interior space within fluid conduit 102 and thereabove within fluid container 12. Air vent passageway 192 has a length $L_{192}$, the lowest point of which is disposed at a first longitudinal position $P_1$ along the length of fluid conduit 102. It is not absolutely certain when a bubble 70 of air can actually enter the interior space within fluid conduit 102 and fluid container 12. Nonetheless, throughout the analysis contained hereinafter, it will be assumed that the longitudinal position along conduit 102 at which a bubble 170 of air enters that interior space is the position $P_1$, which will for various structural reasons associated with the shape and size of air vent passageway 191 be assigned to differing positions in each of the schematic diagrams that follows. In FIG. 10B, lowermost portion of air vent passageway 190, which is the form in diameter should be considered the first longitudinal point $P_1$ at which air enters the interior space within conduit 102 and fluid container 12.

Correspondingly, form through stylized barrier 190 is a fluid outlet passageway 192 having a length $L_{192}$. Fluid 60 passes through the passageway 192 as indicated by arrow F. In doing so, however, fluid 60 in the space above stylized barrier 190 experiences an ever decreasing head pressure in the direction of the upper entrance 193 to fluid outlet passageway 192. Eventually, the static head pressure in flowing fluid 60 reaches the point of zero static head pressure $H_0$ in FIG. 10A. In FIG. 10A and in schematic diagrams that follow, the longitudinal position $P_2$ along fluid conduit 102 corresponding to the point $H_0$ static head pressure will be significant. As seen in FIG. 10A, and as consistent with experience, second longitudinal position $P_2$ is located somewhat above entrance 193 to fluid outlet passageway 192.

Nonetheless, in FIG. 10A, due to the configuration of stylized barrier 190 and the passageways therethrough, longitudinal position $P_1$ is further by a distance $D_1$ from fluid container 12 than is longitudinal position $P_2$. Under these conditions, distance $D_1$ will be considered a negative distance.

It has been found that when the distance between longitudinal position $P_1$ and longitudinal position $P_2$ is negative, venting of the flow of fluid 160 through stylized barrier 190 is characterized by undesirable gulping and cycling fluid flow. Undesirable time intervals occur between the intake of air through air vent passageway 191 resulting in occasional large separation A therebetween.

To improve the functioning of stylized barrier 190 illustrated in FIG. 10A, two alternative structural specifications can be considered. These are illustrated in FIGS. 10B and 10C, respectively.

In FIG. 10B, a capillary section 194 has been entered into the upper end 195 of air vent passageway 191. As a result, it has been concluded that the effective length $L_{191}$ of air vent passageway 191 is reduced to a length $L_{194}$ corresponding to the length of capillary section 194. Correspondingly, the longitudinal position $P_1$ at which air bubbles 70 are considered to enter the interior space within fluid conduit 102 and fluid container 12 has moved substantially closer to fluid container 12. As a result, longitudinal position $P_1$ is closer than longitudinal position $P_2$ corresponding to the point $H_0$ of zero static head pressure by a distance $D_2$ that is positive. Under such conditions it has been found that desirable, uniform vented flow of fluid 60 will occur.

Figure 10C:
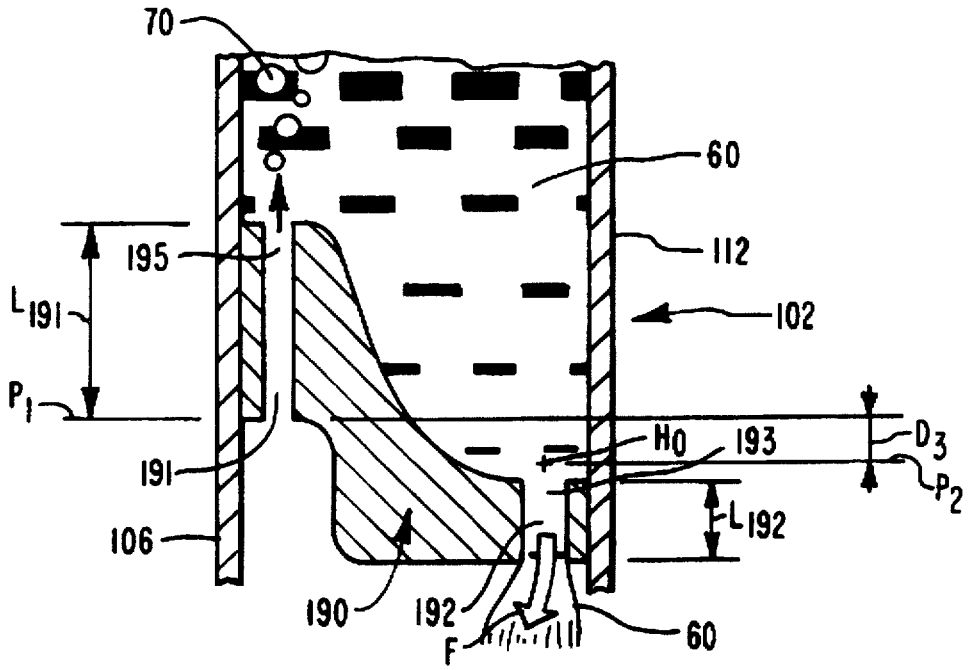
FIG. 10C is a schematic diagram of selected functions operative during pouring of a fluid from the pour spout of FIG. 4.

Alternatively, however, in the reference to FIG. 10C, stylized barrier 190 has been modified so as to move further from fluid container 12, entrance 193, to fluid outlet passageway 192. Correspondingly, longitudinal position $P_2$ corresponding to point $H_0$ of static fluid pressure in flowing fluid 60 has correspondingly been moved further from fluid container 12. As a result, longitudinal position $P_1$ in FIG. 10C is closer than longitudinal position $P_2$ to fluid container 12 by a distance $D_3$ that is now positive. Accordingly, vented fluid flow of fluid 60 will occur. It should be noted, however, that the positive distance $D_3$, in FIG. 10C is less than the positive distance $D_2$ in FIG. 10B, leading predictively to a stability in the uniformity of fluid outflow in the form of the device illustrated in FIG. 10C.

In view of the use of capillary section 194 with stylized barrier 190 in FIG. 10B, FIG. 10B can, in some respects, be understood to be similar to the arrangement of structures utilized relative to pour spout 10 illustrated in FIG. 1. On the other hand, the form of stylized barrier 190 shown in FIG. 10C there is a closer functional correspondence to the type of structure utilized in pour spout 100 shown in FIG. 4.

Figure 10D:
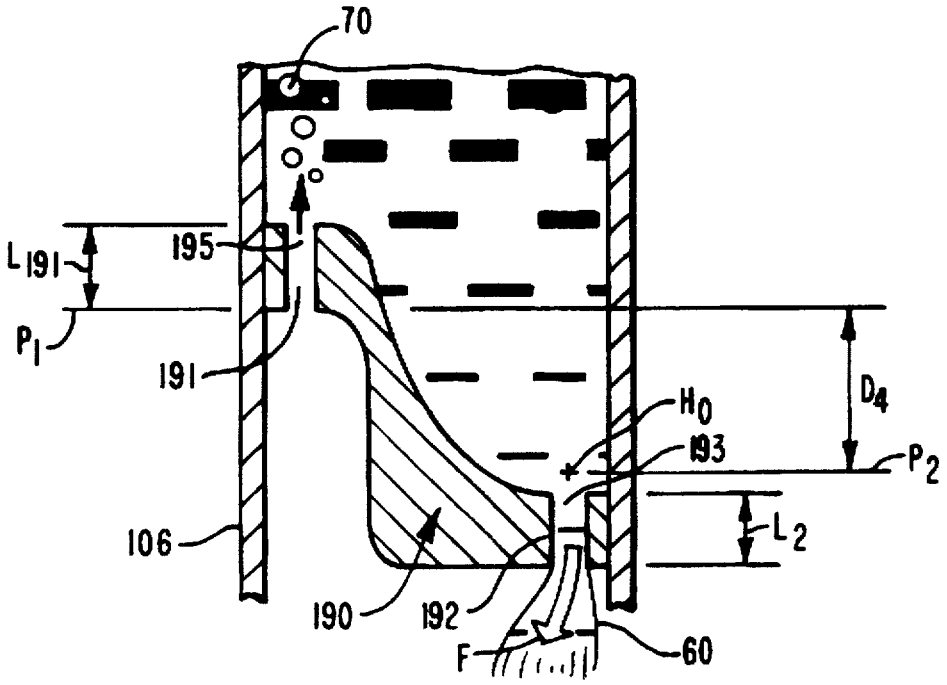
FIG. 10D is a schematic diagram of additional selected functions operative during pouring of a fluid from the pour spout of FIG. 4.

Finally, it can be noted by reference to FIG. 10D that without the addition of a capillary section to fluid outlet passageway 192, the relatively modest positive distance $D_3$ shown in FIG. 10C can be increased to enhance the stability of the outflow of fluid 60. In FIG. 10D, stylized barrier 190 has been so constructed that the lower entrance to air vent passageway 192 corresponding to first location $P_1$ has been moved toward fluid container 12. The closeness of longitudinal section $P_1$ to container 12 relative to longitudinal position $P_2$ has been correspondingly increased resulting in a larger positive difference $D_4$ therebetween.

The relatively short length $L_{191}$ of air vent passageway 191 and length $L_{192}$ of fluid outlet passageway 192 suggests that uniform vented fluid flow of fluid 60 can be achieved in a barrier disposed across a fluid conduit, such as fluid conduit 102, utilizing a barrier that is relatively thin in the region of air vent passageway and the fluid outlet passageway therethrough. Stylized barrier 190, as configured in FIG. 10D, tends to suggest that the structure of the barrier between longitudinal position $P_1$ associated with the entry of air into the interior space between the fluid conduit and associated fluid container and longitudinal position $P_2$ associated with the point $H_0$ of zero static head pressure in the outflowing fluid is of relatively minor consequence to the stability of vented fluid flow achievable therewith. This observation will serve as an appropriate introduction to the pour spout embodiments disclosed hereinafter.

Figure 11:
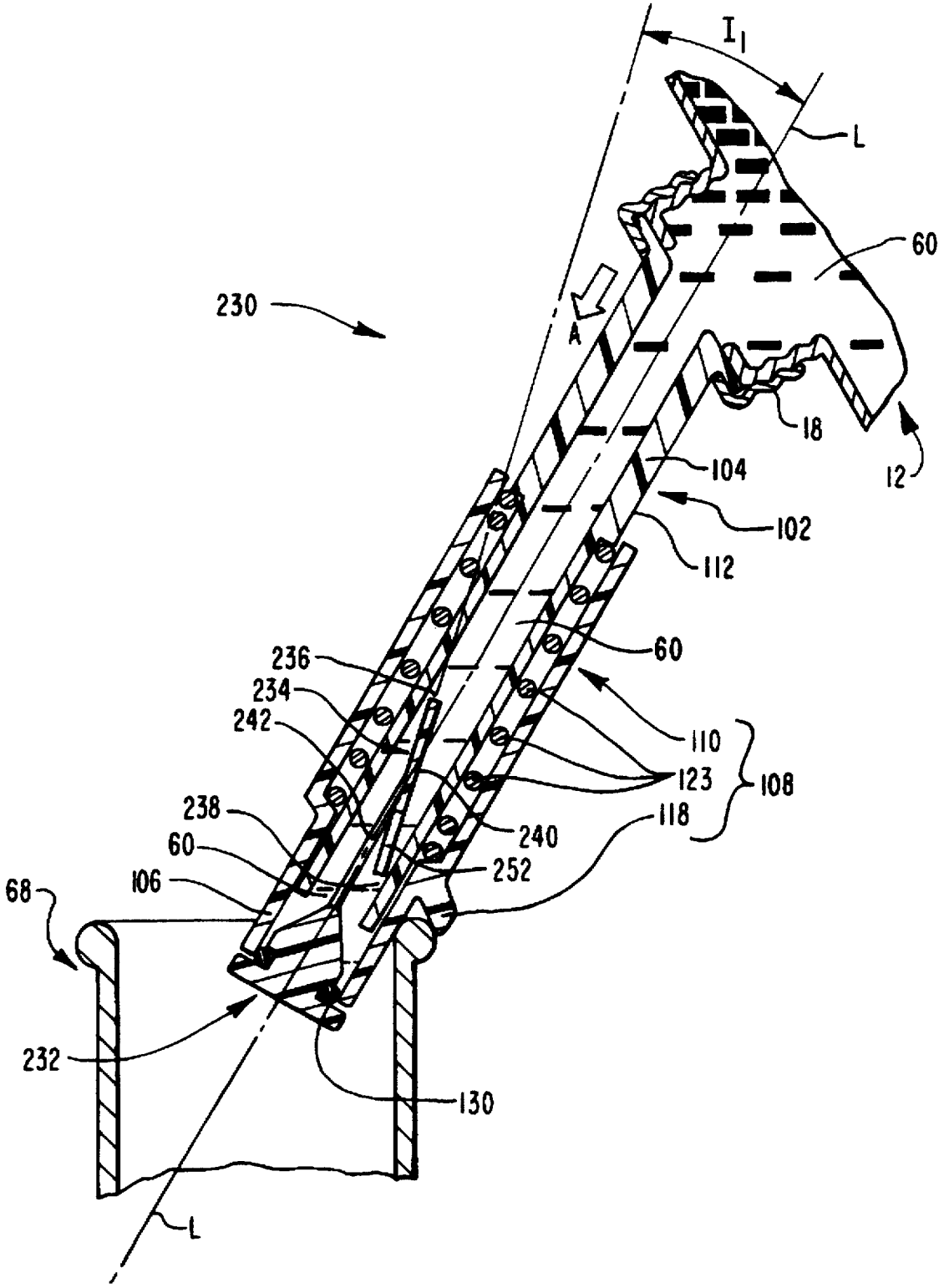
FIG. 11 is a cross-sectional elevation view of the full length of a third embodiment of a pour spout incorporating teachings of the present invention with the slide valve thereof in its closed position.

FIG. 11 illustrates a third embodiment of a pour spout 230 similar in many respects to pour spout 100 discussed above. Accordingly, identical reference characters as used relative to pour spout 100 will be used in the following discussion to identify components of pour spout 230. In FIG. 11 pour spout 230 can be seen to comprise a fluid conduit 102 having one end 104 thereof attached to container 12 using an annular threaded cap 18. Alternatively, pour spout 230 may be fabricated with container 12 as an integral, non-removable portion thereof.

Remote end 106 of fluid conduit 102 is provided with a fluid discharge opening not shown in FIG. 11, which is disclosed in detail subsequently. Through this fluid discharge opening, the fluid in container 12 can be transferred into a receiving vessel 68 and air enters fluid conduit 102 from the exterior thereof.

In accordance with one aspect of the present invention, a closure means is provided for precluding any such transfer of the fluid from fluid conduit 102 until the fluid discharge opening thereof is inside receiving vessel 68. Such a closure means is shown by way of example in FIG. 11 as comprising a slide valve 108 taking the form of a sleeve 110 closely conforming to the exterior surface 112 of fluid conduit 102 and mounted for sliding motion thereupon. In FIG. 11, slide valve 108 is shown in the closed position thereof in which transfer of fluid 60 from container 12 through fluid conduit 102 is precluded.

In accordance with another aspect of the closure means, a slide valve release means is provided for coacting with receiving vessel 68 to move slide valve 108 out of the closed position as remote end 106 of fluid conduit 102 and the discharge opening therein enter into receiving vessel 68. As shown by way of example and not limitation, a projection 118 is secured to sleeve 110. Projection 118 catches the lip of receiving vessel 68 into which fluid container 12 is to be transferred. As remote end 106 of fluid conduit 102 is thereafter advanced into receiving vessel 68 in a direction indicated by arrow A, projection 118 draws sleeve 110 along the exterior of fluid conduit 102 towards container 12 and out of the closed position of slide valve 108. As seen in FIG. 11, a spring 123 is held in compression between sleeve 110 and a fixed position on exterior surface 112 of fluid conduit 102. Spring 123 thus urges sleeve 110 into the closed position thereof illustrated in FIG. 11.

In the closed position of slide valve 108, the end of sleeve 110 remote from container 12 is urged into sealing engagement with a slide valve seal 130 that encircles a fluid conduit termination disk 232 supported at and separated from the end of fluid conduit 102 remote from container 12. As is shown in FIG. 11, fluid conduit 102 is possessed of a longitudinal axis L along which fluid conduit termination disk 232 is concentrically disposed.

In accordance with one aspect of the present invention, a pour spout, such as pour spout 230, is provided with baffle means located in fluid conduit 102 for simultaneously performing a pair of cooperating and mutually accommodating functions. The baffle means of the present invention is both for (1) admitting air into the interior space within fluid conduit 102 and container 12 at a first longitudinal position $P_1$ in conduit 102, as well as for (2) maintaining to a second longitudinal position $P_2$ in conduit 102 the point of zero static head pressure in fluid 60 flowing through the baffle means with second longitudinal position $P_2$ located further from fluid container 12 than first longitudinal position $P_1$.

The significance of the cooperating functions of the baffle means of the present invention will be more fully appreciated relative to subsequent figures. For the present, however, as shown in FIG. 11 by example and not limitation, one form of a structure performing the dual functions of the baffle means of the present invention is a barrier 234 disposed across the interior of fluid conduit 102 at an inclination $I_1$ relative to longitudinal axis L of fluid conduit 102. Barrier 234 does not absolutely preclude passage of fluid 60 therethrough. Formed through barrier 234 is an air vent aperture 236 and at least one elongated fluid aperture 238 that will be discussed in additional detail subsequently.

Therefore, fluid 60 can be seen in FIG. 11 to fill remote end 106 of fluid conduit 102 on the side of barrier 234 opposite from container 12. Fluid 60 in remote end 106 of fluid conduit 102 is, however, prevented from discharge from pour spout 230 due to the sealing engagement of slide valve 108 with slide valve seal 130.

Fluid conduit termination disk 232 is supported in the position shown in FIG. 11 from a medial portion 240 of barrier 234 on a support shaft 242.

With projection 118, engaged receiving vessel 68, it is possible to open slide valve 108 by advancing the assembly of pour spout 100 and container 12 toward receiving vessel 68 in the direction shown by arrow A in FIG. 11. Doing so will advance fluid conduit 102 against the biasing effect of spring 123 within sleeve 110 of slide valve 108, bringing the components illustrated in FIG. 11 into the positions shown in FIG. 12.

Figure 12:
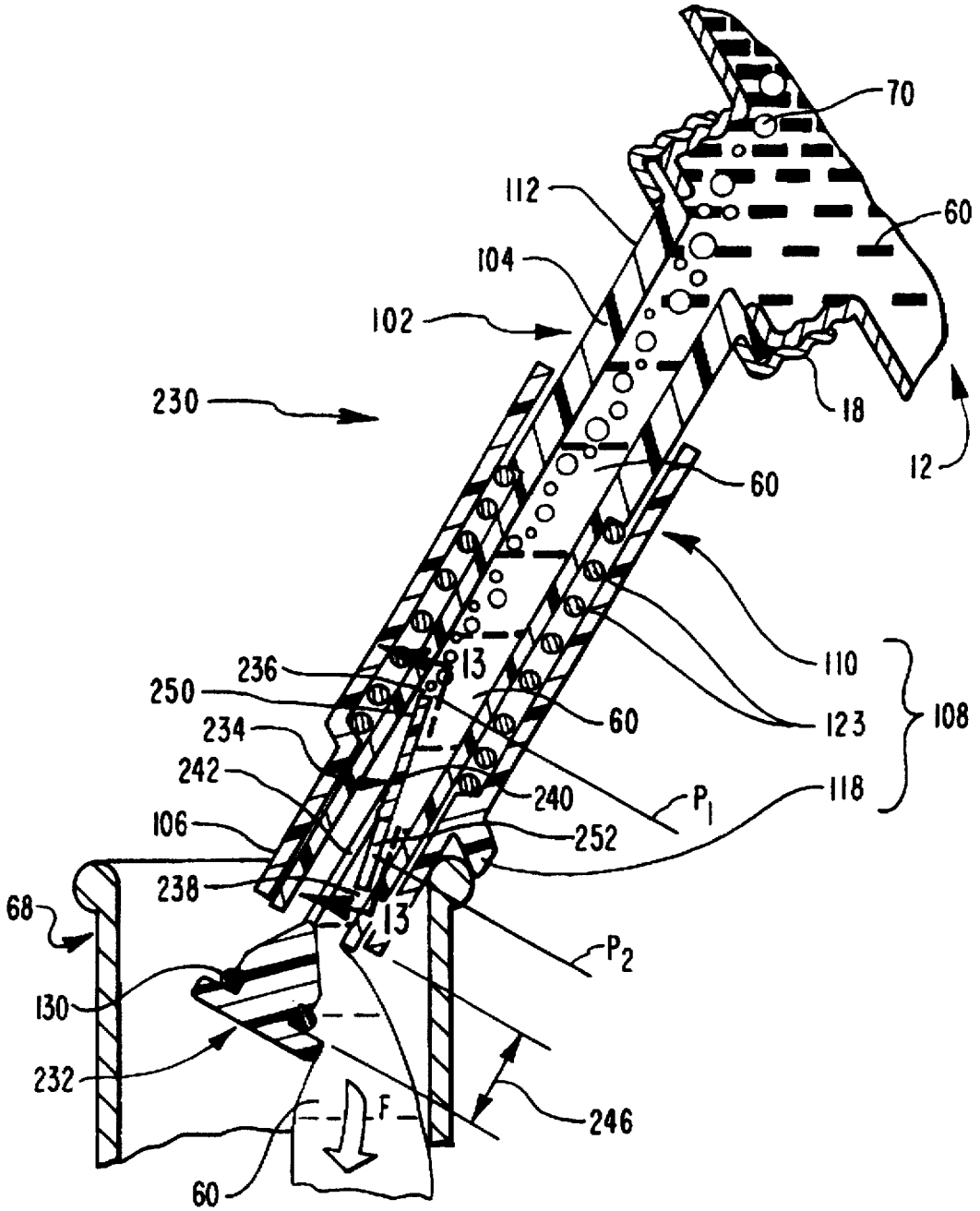
FIG. 12 is a cross-sectional elevation view of the full length of the pour spout shown in FIG. 11 with the slide valve thereof in its open position.

FIG. 12 thus illustrates the open position of slide valve 108, wherein the advancement of fluid conduit 102 within sleeve 110 of slide valve 108 has caused the end of sleeve 110 remote from container 12 to separate from slide valve seal 130 producing a fluid discharge opening 246 between fluid conduit termination disk 232 and remote end 106 of fluid conduit 102.

As a result, fluid 60 emerges from remote end 106 of fluid conduit 102 through fluid discharge opening 246 and flows into receiving vessel 68 as indicated by arrow F. As barrier 234 does not completely obstruct the fluid flow, fluid 60 in end 104 of fluid conduit 102 begins to drain therefrom through barrier 234, into remote end 106 of fluid conduit 102, and out of pour spout 230 through fluid discharge opening 246.

In the process, negative pressure begins to be created in container 12 above fluid 60. The negative pressure in container 12 induces air bubbles 70 to enter the interior space within fluid conduit 102 and container 12 through air vent aperture 236 formed in uppermost portion 250 of barrier 234. This ensures continued smooth outflow of fluid 60 through pour spout 100. Uppermost portion 250 of barrier 234 corresponds to a first longitudinal position $P_1$ in conduit 102 through which air is admitted into that interior space.

Correspondingly, fluid 60 flows through barrier 234 by way of fluid aperture 238 below medial portion 240 thereof. Fluid aperture 238 terminates remotely from uppermost portion 250 at a lowermost portion 252 of barrier 234. In this manner, fluid 60 and air bubbles 70 pass in opposite directions through barrier 234.

Lowermost portion 252 of barrier 234 thus corresponds relatively closely to the point of zero head pressure in the flowing fluid 60 and thus to a second longitudinal position $P_2$ in fluid conduit 102 located further from container 12 than the first longitudinal position $P_1$ in fluid conduit 102 corresponding to uppermost portion 250 of barrier 234. By virtue of the positioning of barrier 234 in and close to the terminus of remote end 106 of fluid conduit 102, both of first longitudinal position $P_1$ and second longitudinal position $P_2$ are positioned relatively far from fluid container 12. These physical features can, however, be altered by positioning a barrier, such as barrier 234, closer in fluid conduit 102 to fluid container 12 than is shown in FIG. 12, or by varying the inclination I, while one of the first longitudinal position $P_1$ or the second longitudinal position $P_2$ is held constant. Embodiments illustrating such variations will appear subsequently.

Figure 13:
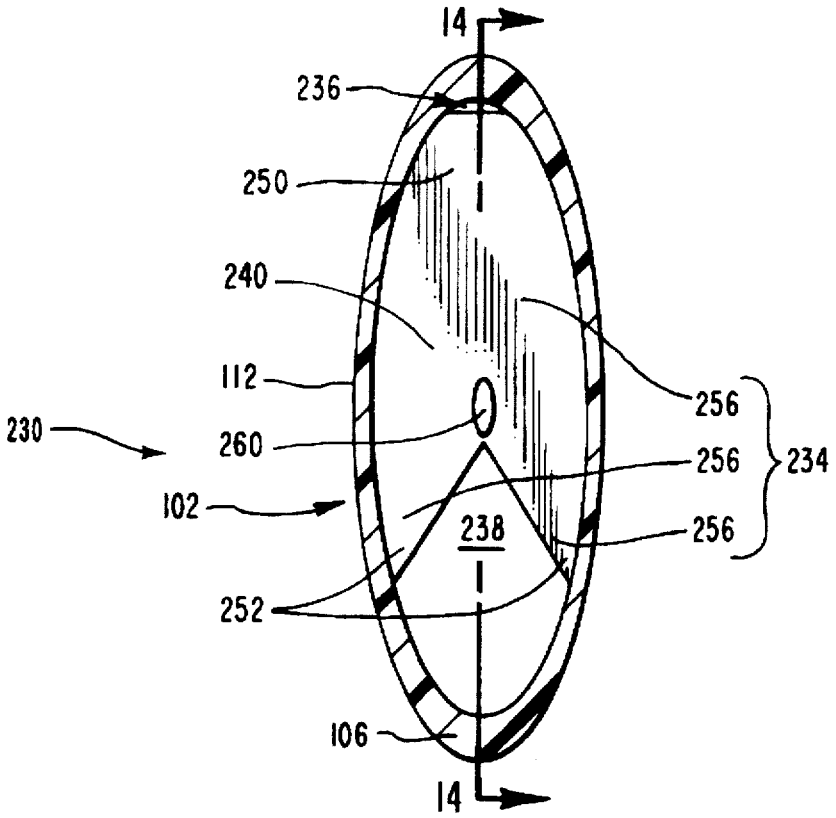
FIG. 13 is a plan view of the barrier in the pour spout of FIG. 12 as seen along section line 13—13 shown therein.

FIG. 13 is a view taken normal to the plane of barrier 234 showing that structure disposed within the walls of fluid conduit 102 in essentially a plan view. Barrier 234 can there be seen in FIG. 14 to comprise a plate 256 disposed in fluid conduit 102 at an inclination $I_1$ to longitudinal axis L thereof.

At uppermost portion 250 of barrier 234, plate 256 terminates short of making contact with the interior surface of the walls of fluid conduit 102. This results in a small air vent aperture 236 through which air bubbles 70 as seen in FIG. 12 can enter fluid conduit 102 and container 12.

At the opposite, lowermost portion 252 of barrier 234 elongated fluid aperture 238 formed through plate 256 assumes a wedge-shaped configuration. As a result, the widest portion of fluid aperture 238 is positioned at lowermost portion 252 of barrier 234. The narrowest portion of fluid aperture 238 terminates at medial portion 240 of barrier 234.

Figure 14:
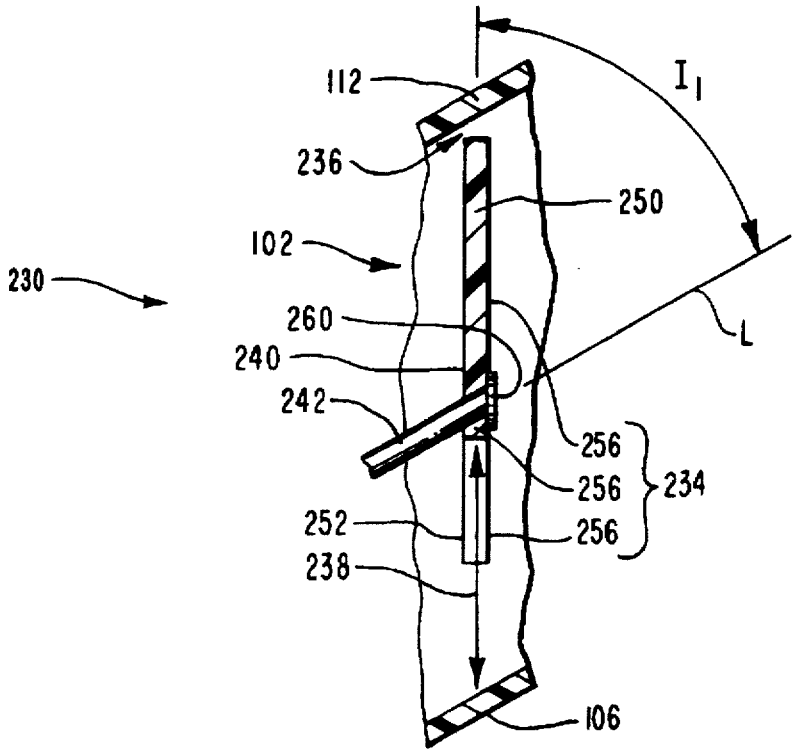
FIG. 14 is a cross-sectional view of the barrier illustrated in FIG. 13 taken along section line 14—14 shown therein and corresponding as a result to an enlarged cross-sectional view of the barrier illustrated in FIG. 13 as seen in FIGS. 11 and 12.
Figure 16:
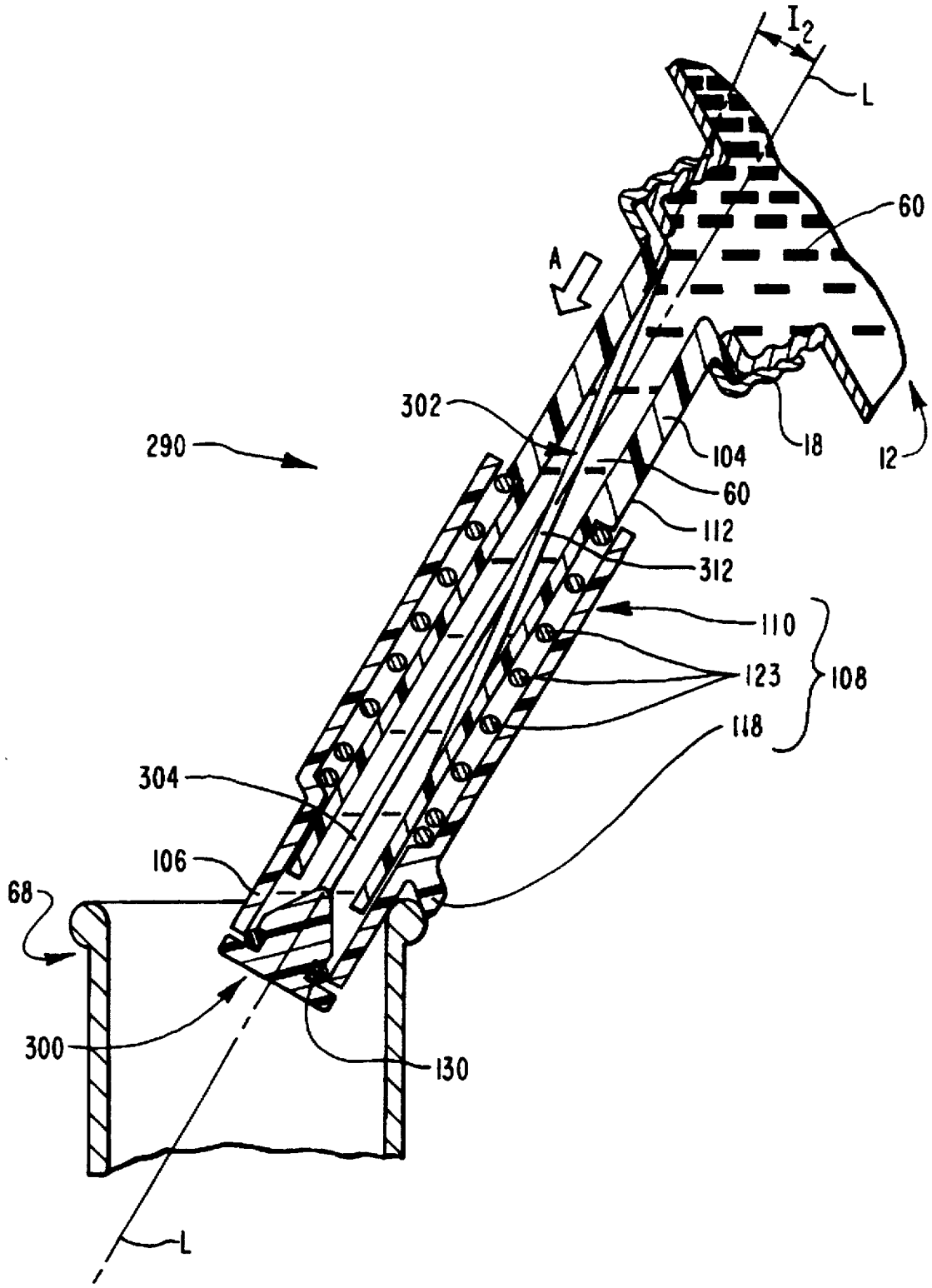
FIG. 16 is a cross-sectional elevation view of the full length of a fourth embodiment of a pour spout utilizing therein a first embodiment of a barricade incorporating teachings of the present invention with the slide valve of the fourth embodiment of the pour spout in its closed position.

Also observable in FIGS. 13 and 14 is an attachment site 260 for support shaft 242 with which fluid conduit termination disk 232 shown in FIG. 16 is cantilevered beyond remote end 106 of fluid conduit 102. This arrangement for the support of fluid conduit termination disk 232 is, however, only exemplary, as other arrangements for the support thereof are equally within the contemplation of the present invention.

In view of the surprising effectiveness of an inclined barrier, such as barrier 234, in facilitating stable, vented fluid outflow in a pour spout, such as pour spout 230, resort will now be made to the series of FIGS. 15A, 15B, 15C, and 15D to illustrate schematically the understood nature of the outflow of fluid 60 in pour spout 230 when fluid 60 assumes ever increasing degrees of viscosity.

Figure 15A:
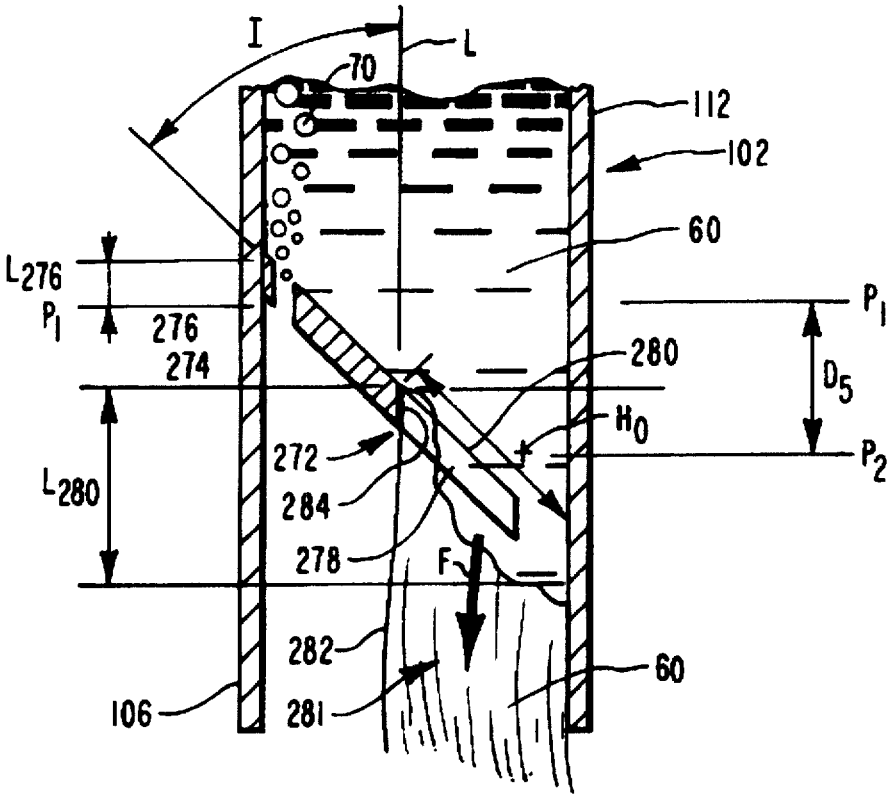
FIG. 15A is a schematic diagram of selected functions operative during pouring of a fluid of low viscosity from the pour spout of FIG. 11.

Thus, in FIG. 15A a stylized barrier 272 is illustrated that is disposed within fluid conduit 102 at an inclination I to the longitudinal axis L thereof. Form through stylized barrier 272 at uppermost portion 274 thereof is an air vent aperture 276 having a corresponding length $L_{276}$. The lower entry to air vent passageway 276 is associated with a first longitudinal position $P_1$ along fluid conduit 102 at which bubbles of air 170 are considered to enter the interior space within fluid conduit 102 and fluid container 12. Also formed through stylized barrier 272 in lowermost portion 278 thereof, it is an elongated fluid outlet aperture 280, which is distinct from air vent passageway 276. Although fluid outlet aperture 280 like stylized barrier 272 is disposed at an inclination I to the longitudinal axis L of fluid conduit 102, a length $L_{280}$ measured parallel to longitudinal axis L of fluid conduit 102 can be associated with fluid outlet aperture 280. Somewhere in the vicinity of, but probably above fluid aperture 180 in the column of fluid 60 above stylized barrier 272 a point $H_0$ of zero static fluid pressure results a fluid 60 flows through fluid outlet aperture 280. A point $H_0$ corresponds to a second longitudinal position $P_2$ that is advantageously located further from fluid container 12 that first longitudinal position $P_1$ by a distance $D_5$ shown in FIG. 15A.

The above physical parameters associated with stylized barrier 272 will be held constant throughout the series of FIGS. 15A, 15B, 15C, and 15D, so as to observe the understood difference in function of stylized barrier 272 for a fluid, such as fluid 60, that may assume different viscosities. FIG. 15A illustrates a fluid 60 having a relatively low viscosity. As shown herein, a column 281 of fluid 60 flows through fluid outlet aperture 280 relatively directly downwardly into remote end 106 of fluid conduit 102. As a result, the edge 282 of column 281 immediately below stylized barrier 272 is aligned with and in all likelihood disposed upon the upper edge 284 of fluid outlet aperture 282.

Figure 15B:
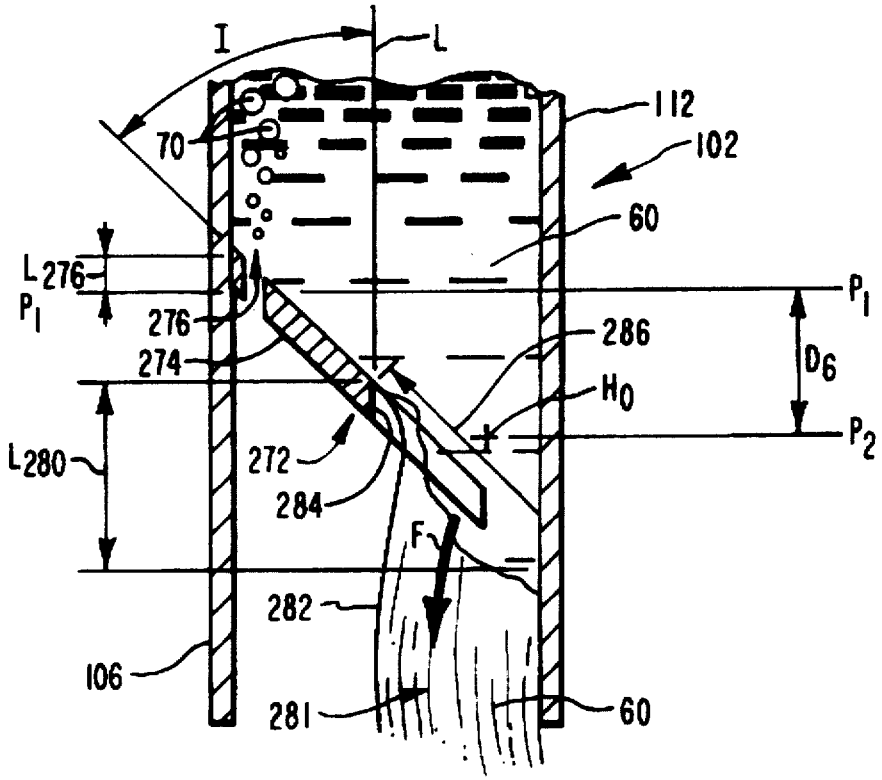
FIG. 15B is a schematic diagram of selected functions operative during pouring of a fluid of medium viscosity from the pour spout of FIG. 11.

In FIG. 15B, however, a fluid 60 of medium viscosity is shown flowing into fluid conduit 102 through stylized barrier 272. As a result of the increased viscosity, edge 282 of column 281 of fluid 60 below stylized barrier 272 arches away from upper edge 282 of fluid outlet aperture 280, in effect narrowing the cross section of fluid passing through fluid aperture 280. Correspondingly, it is believed that the point $H_0$ of zero static head pressure in the flow of fluid 60 is displaced away from container 12 as compared to the position of point $H_0$ shown in FIG. 15A. Consequently, the second longitudinal position $P_2$ associated therewith moves further from fluid container 12 than FIG. 15A and a larger positive distance $D_6$ is produced between first position $P_1$ and second position $P_2$.

Figure 15C:
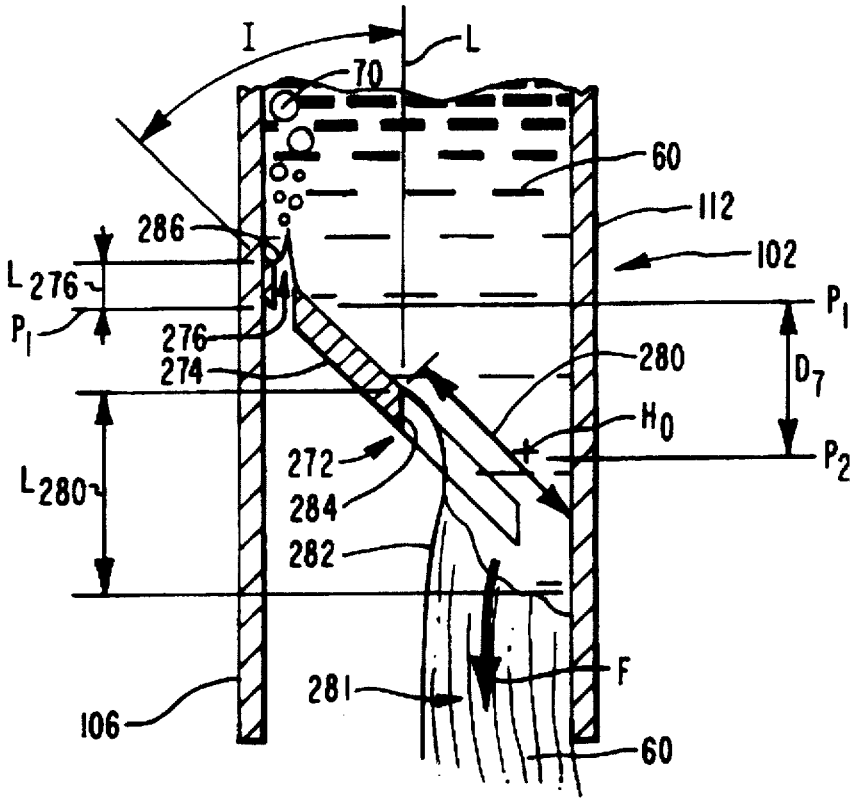
FIG. 15C is a schematic diagram of selected functions operative during pouring of a fluid of high viscosity from the pour spout of FIG. 11.

FIG. 15C illustrates a fluid 60 of heavy viscosity flowing in fluid conduit 102 through stylized barrier 272. By comparison with the flow illustrated in FIG. 15B, edge 282 of column 281 of fluid 60 arches further away from upper edge 284 of fluid outlet aperture 280. This produces a cross-sectional fluid flowing through fluid outlet aperture 280 that is smaller in area than that associated with the flow depicted in FIG. 15B, and correspondingly is believed to move further from fluid container 12 to point $H_0$ of static head pressure in the flow of fluid 60. Correspondingly, the positive distance $D_7$ from second longitudinal position $P_2$ to first longitudinal position $P_1$ is increased relative to distance $D_6$ shown in FIG. 15B.

Figure 15D:
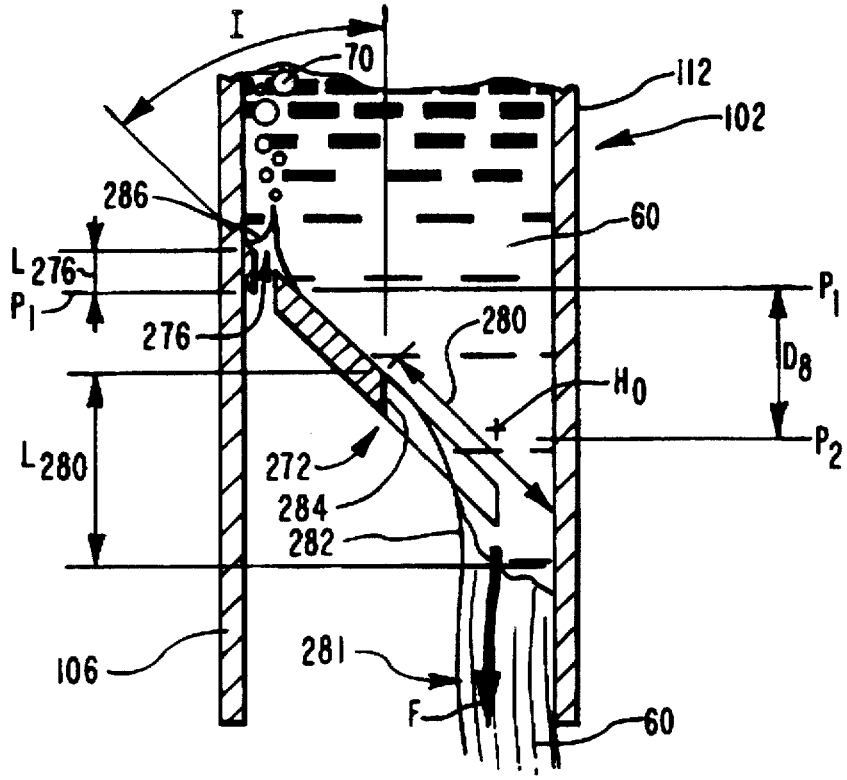
FIG. 15D is a schematic diagram of selected functions operative during pouring of a fluid of very high viscosity from the pour spout of FIG. 11.

In FIG. 15D a fluid 60 of very heavy viscosity is shown flowing in fluid conduit 102 through stylized barrier 272. By comparison with the flow depicted in FIG. 15C, edge 282 of column 281 of fluid 7 in remote end 106 of fluid conduit below stylized barrier 272 arches far from upper edge 284 of fluid outlet aperture 280. The cross section of fluid outflow through fluid outlet aperture 280 is reduced relative to that of FIG. 15C, and the point $H_0$ of zero static fluid pressure in the flow of fluid 60 is moved further away from fluid container 12, resulting in a larger positive distance $D_8$ between first position $P_1$ and second position $P_2$ along the length of fluid conduit 102. Of interest also is the effect of increased fluid viscosity on the form of fluid structure at the top of air vent passageway 276. There, a cone 286 of incipient air bubbles 70 extends upwardly from stylized barrier 272 at an increasing distance increased in fluid viscosity.

The insights into fluid behavior arrive from pour spout 230, and FIGS. 15A, 15B, 15C, and 15D serve as an appropriate introduction to the pour spout embodiments disclosed hereinafter.

FIG. 16 illustrates a fourth embodiment of a pour spout 290 similar in many respects to pour spout 230 discussed above. Accordingly, identical reference characters as used relative to pour spout 230 will be used to identify components of pour spout 290, but those common components will not be again discussed.

Remote end 106 of fluid conduit 102 is provided with a fluid discharge opening not shown in FIG. 16, which is disclosed in detail subsequently. Through this fluid discharge opening, the fluid 60 in container 12 can be transferred into a receiving vessel 68, and air can enter fluid conduit 102.

In the closed position of slide valve 108 illustrated in FIG. 16, the end of sleeve 110 remote from container 12 is urged into sealing engagement with a slide valve seal 130 that encircles a fluid conduit termination disk 300 supported at and separated from remote end 160 of fluid conduit 102. As is shown in FIG. 16, fluid conduit 102 is possessed of a longitudinal axis L along which fluid conduit termination disk 300 is concentrically disposed.

Disposed across the interior of fluid conduit 102 at an inclination $I_2$ relative to longitudinal axis L of fluid conduit 102 is a barricade 302 that obstructs the flow of fluid 60 from container 12 through fluid conduit 102. Inclination $I_2$ of barricade 302 is less than inclination $I_1$ of barrier 234 shown in FIG. 11. Thus, as the inner diameter of fluid conduit 102, both in pour spout 230 and in pour spout 290 are identical, barricade 302 is longer than barrier 234. In addition, however, barricade 302 is located within fluid conduit 102 at a position that has been translated along longitudinal axis L thereof toward fluid container 12.

In accordance with one aspect of the present invention, a pour spout, such as pour spout 290 that includes a barricade, such as barricade 302, is provided with viscosity accommodating transfer means formed in the barricade for smoothly and continuously exchanging through the barricade air in the fluid conduit from the fluid discharge opening and fluid from the container at a rate determined by the viscosity of the fluid. In the operation of the viscosity accommodating transfer means, air is admitted into the interior space within fluid conduit 106 and container 12 at a first longitudinal position $P_1$ in fluid conduit 106 shown in FIG. 17, while the point of negative static head pressure in the flowing fluid 60 is maintained at a second longitudinal position $P_2$ in fluid conduit 102 that is further from container 12 than first longitudinal position $P_1$.

The significance of the function of the viscosity accommodating transfer means of the present invention will be more fully appreciated relative to subsequent figures. As can be appreciated from FIG. 16, barricade 302 does not preclude passage of fluid 60 therethrough, as fluid 60 can be seen in FIG. 16 to fill remote end 106 of fluid conduit 102 on the side of barricade 302 opposite from container 12. Fluid 60 in remote end 106 of fluid conduit 102 is, however, prevented from discharge from pour spout 290 due to the sealing engagement of slide valve 108 with slide valve seal 130.

Fluid conduit termination disk 300 is supported in the position shown in FIG. 16 from barricade 302 on a support shaft 304.

Figure 17:
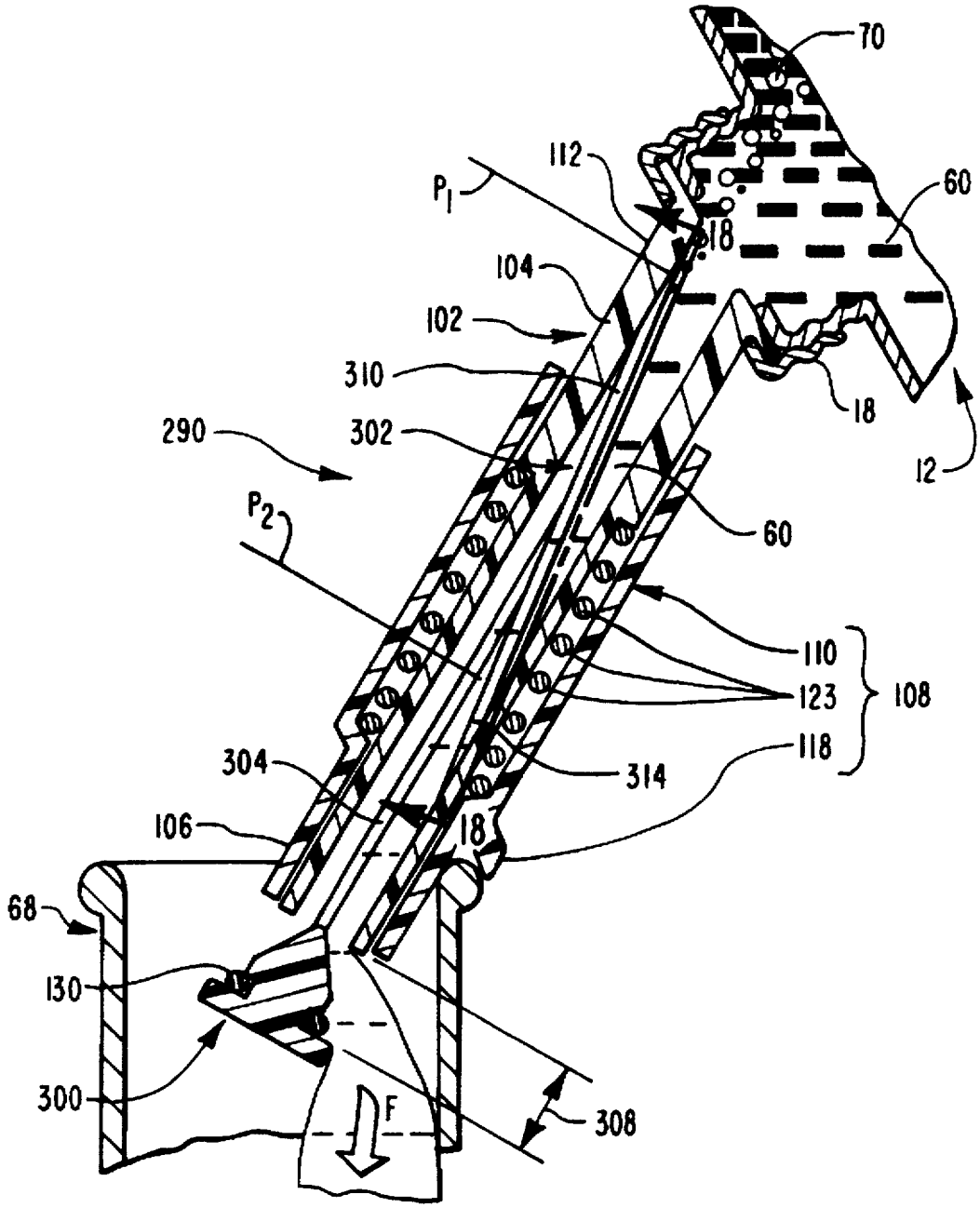
FIG. 17 is a cross-sectional elevation view of the full length of the pour spout shown in FIG. 16 with the slide valve thereof in its open position.

FIG. 17 illustrates the open position of slide valve 108, wherein the advancement of fluid conduit 102 within sleeve 110 of slide valve 108 in the direction shown by arrow F has caused the end of sleeve 110 remote from container 12 to separate from slide valve seal 130, producing a fluid discharge opening 308 between fluid conduit termination disk 300 and remote end 106 of fluid conduit 102.

As a result, fluid 60 emerges from remote end 106 of fluid conduit 102 through fluid discharge opening 308 and flows into receiving vessel 68 as shown by arrow F. As barricade 302 is not completely obstructive to fluid flow, fluid 60 in end 104 of fluid conduit 102 begins to drain therefrom through barricade 302, into remote end 106 of fluid conduit 102, and out of pour spout 290 through fluid discharge opening 308.

In the process, negative pressure begins to be created in container 12 above fluid 60. The negative pressure in container 12 induces air bubbles 70 to enter the interior space within fluid conduit 102 and container 12 through uppermost portion 310 of barricade 302. This ensures continued smooth outflow of fluid 60 through pour spout 290. Uppermost portion 310 of barricade 302 thus corresponds to a first longitudinal position $P_1$ in conduit 102 through which air is admitted into that interior space.

One effect of barricade 302 on the outflow of fluid 60 from pour spout 290 is to maintain the point of zero static head pressure in fluid 60 flowing through fluid conduit 102 somewhere in the vicinity of the second longitudinal position $P_2$ in conduit 102 defined by lowermost portion 314 of barricade 302. Fluid 60 flows through a portion of barricade 302 from medial portion 312 to lowermost portion 314. In this manner, fluid 60 and air bubbles 70 pass in opposite directions through barricade 302, mutually adjusting according to the viscosity of the fluid portion of the passageways through barricade 302 required to maintain a continued, even fluid outflow. Second longitudinal position $P_2$ in fluid conduit 102 is located further from container 12 than first longitudinal position $P_1$.

Various embodiments of barricades, such as barricade 302, will be explored in detail subsequently.

The orientation of barricade 302 at inclination $I_2$ relative to longitudinal axis L, as shown in FIG. 16 ensures that the second longitudinal position $P_2$ in fluid conduit 102 discussed above is more remote from container 12, than is the first longitudinal position $P_1$ in conduit 102 at which air bubbles 70 pass through barricade 302. Under such condition a stable, vented transfer of fluid 60 outwardly and air bubbles 70 inwardly will continue, until such time as fluid 60 fills receiving vessel 68 to a level that will close fluid discharge opening 308. Thereupon, as with the embodiments of pour spouts already discussed, the outflow of fluid 60 is promptly curtailed, and the assembly of container 12 with pour spout 290 attached thereto may be withdrawn from receiving vessel 68 without any overflow by fluid 60 thereof. In this withdrawal process, spring 123 urges slide valve 108 into the closed position thereof also preventing leakage from pour spout 290.

Figure 18:
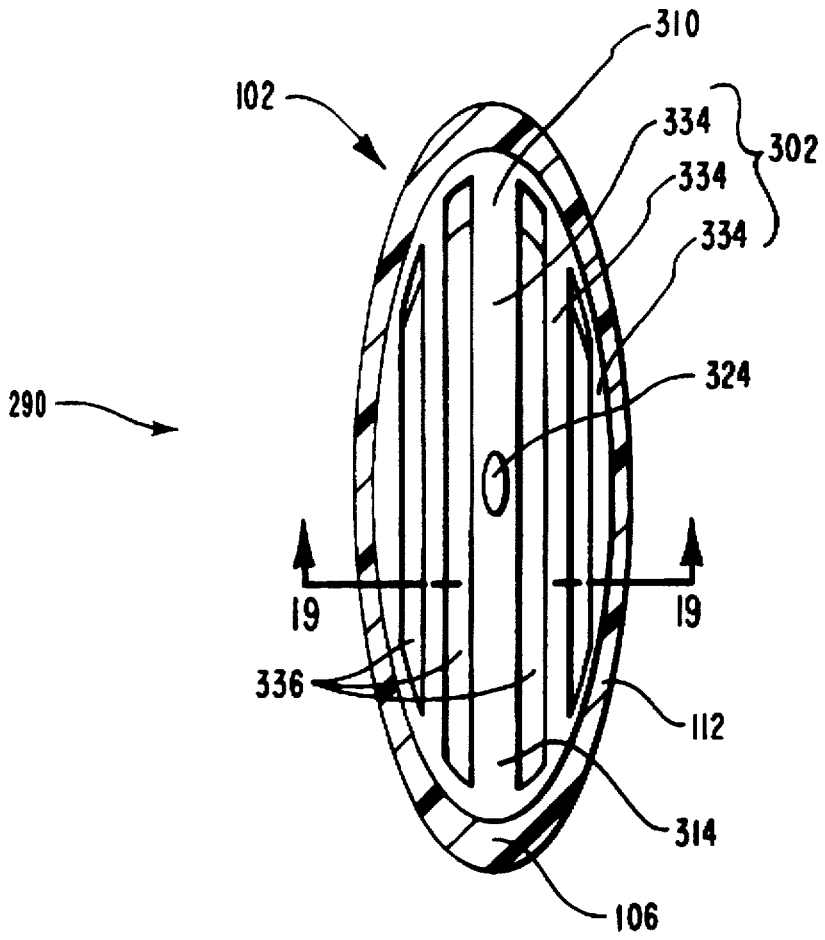
FIG. 18 is a plan view of a first embodiment of the barricade in the pour spout of FIG. 17 as seen along section line 18—18 shown therein.

Illustrated in FIG. 18 is a view taken normal to the plane of barricade 302. Barricade 302 is illustrated comprising a plate 334 disposed in fluid conduit 102 at an inclination $I_2$ to the longitudinal axis L thereof shown only in FIG. 16. A plurality of generally longitudinal apertures 336 are formed through plate 334 at an inclination $I_2$ to the longitudinal axis L of fluid conduit 102 shown. The portions of plate 334 between apertures 336 thus comprise a plurality of elongated obstacles secured in planar, spaced-apart relationship within fluid conduit 102 at an inclination $I_2$ relative to the longitudinal axis L of fluid conduit 102.

Figure 20:
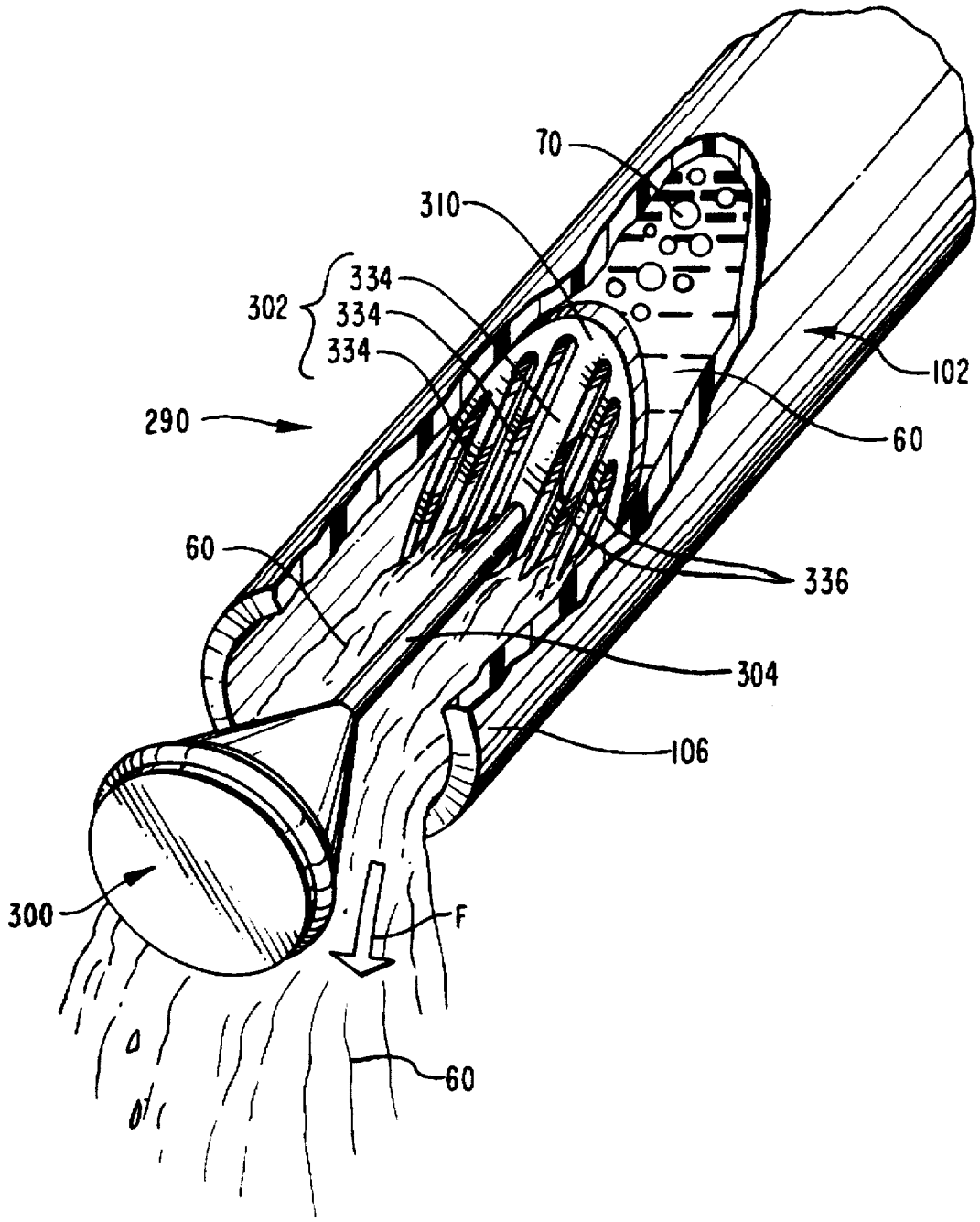
FIG. 20 is a perspective view in partial break away of the pour spout of FIG. 17 illustrating fluid being exchanged for air through the barricade thereof.

The outflow of fluid 60 from the pour spout, such as pour spout 290, that is provided with an inclined barricade, such as barricade 302, is illustrated in perspective in FIG. 20. There, the exchange of fluid 60 and air bubbles 70 through apertures 36 of barricade 302 can be clearly seen. Fluid 60 falls from remote end 106 of fluid conduit 102 through fluid discharge opening 308 in a column 281. The volume of column 281 of fluid 60 varies inversely with the viscosity of fluid 60 in a manner to be explored in general terms immediately below.

Nonetheless, it is a significant feature of the viscosity accommodating transfer means of the present invention that the variation in the volume of the outflow of fluid 60 occurs on behalf of sustaining a steady, vented outflow thereof, thereby avoiding gulping and cycled fluid flow that can contribute to splashing and to the overflow of a receiving vessel.

The understood mechanics by which this accommodation for variable fluid viscosity occurs will be discussed relative to FIGS. 21A, 21B, 21C, and 21D.

Figure 21A:
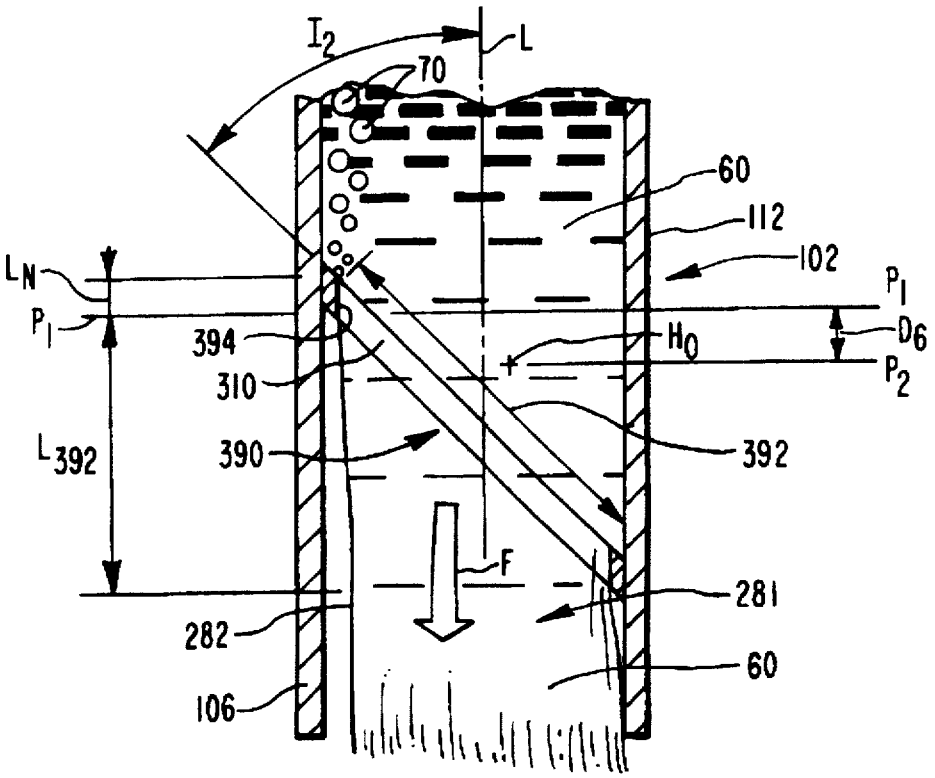
FIG. 21A is a schematic diagram of selected functions operative during pouring of a fluid of low viscosity from the pour spout of FIG. 16.

In FIG. 21A, a stylized barrier 390 is disposed across the interior of fluid conduit 102 at an inclination $I_2$ to the longitudinal axis $L_2$ of conduit 102. Stylized barrier 390 includes at least a single elongated aperture 392 that functions both to admit bubbles 70 of air and passage into remote end 106 of fluid conduit 102 of a column 281 of fluid 280. Aperture 392 is thus also disposed at an inclination $I_2$ to the longitudinal axis L of fluid conduit 102. As such, aperture 392 is an exemplary embodiment of a structure performing the function of the viscosity accommodating transfer means of the present invention. Although aperture 392 disposed at inclination $I_2$ to the longitudinal axis $L_2$ of fluid conduit 102, aperture 392 has a corresponding length $L_{392}$ taken parallel to longitudinal axis L of fluid conduit 102. Stylized barrier 390 does not, in fact, contain a dedicated air vent passageway intake. Accordingly, the nominal length $L_N$ of any such air vent passageway associated with stylized barrier 390 is considered negligible and coincident with a first longitudinal position $P_1$ along fluid conduit 102 at which air bubbles 70 enter the interior space within fluid conduit 102 and container 12. In this regard, it is as if the viscosity accommodating transfer means of the present invention produces from fluid 60 itself a capillary section at the uppermost portion 10 of stylized barrier 390.

Correspondingly, the point $H_0$ of zero static head pressure in flowing fluid 60 is located somewhere in the column of fluid 60 above aperture 392. Point $H_0$ corresponds to a second longitudinal position $P_2$ along fluid conduit 102 that is a distance $D_6$ further from container 12 than first longitudinal position $P_1$.

As shown in FIG. 21A for a fluid of low viscosity, distance $D_6$ is relatively small. Nonetheless, as distance $D_6$ is positive, stable vented outflow of fluid 60 in column 281 can be expected. In doing so, the edge 282 of column 281 of fluid 60 in remote end 106 of fluid conduit 102 is directly below and possibly coincident with upper edge 394 of aperture 392.

Figure 21B:
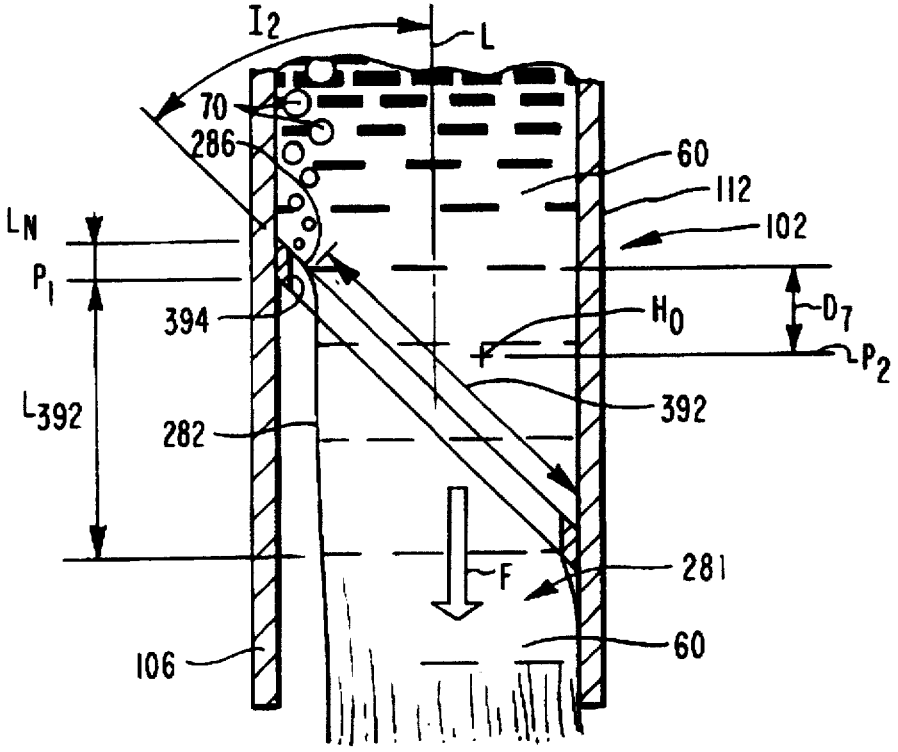
FIG. 21B is a schematic diagram of selected functions operative during pouring of a fluid of medium viscosity from the pour spout of FIG. 16.

By contrast, however, in FIG. 21B, a fluid 60 of a medium viscosity is illustrated flowing in fluid conduit 102 through stylized barrier 390. There it can be seen that the point $H_0$ of zero static fluid pressure in flowing fluid 60 is moved further from container 12 with corresponding second longitudinal position $P_2$. As a result, the distance $D_7$ from second position $P_2$ to first position $P_1$ is increased. This would suggest that the viscosity accommodating transfer means of the present invention introduces enhanced stability in fluid outflow with increased fluid viscosity.

As a result, edge 282 of column 281 of fluid 60 in remote end 106 of fluid conduit 102 arches away from upper edge 394 of aperture 392. And a cone 286 of incipient air bubbles 70 begins to form above upper edge 394 of aperture 392.

Correspondingly, it could be observed that the effective length of aperture 392 is reduced in the process.

Figure 21C:
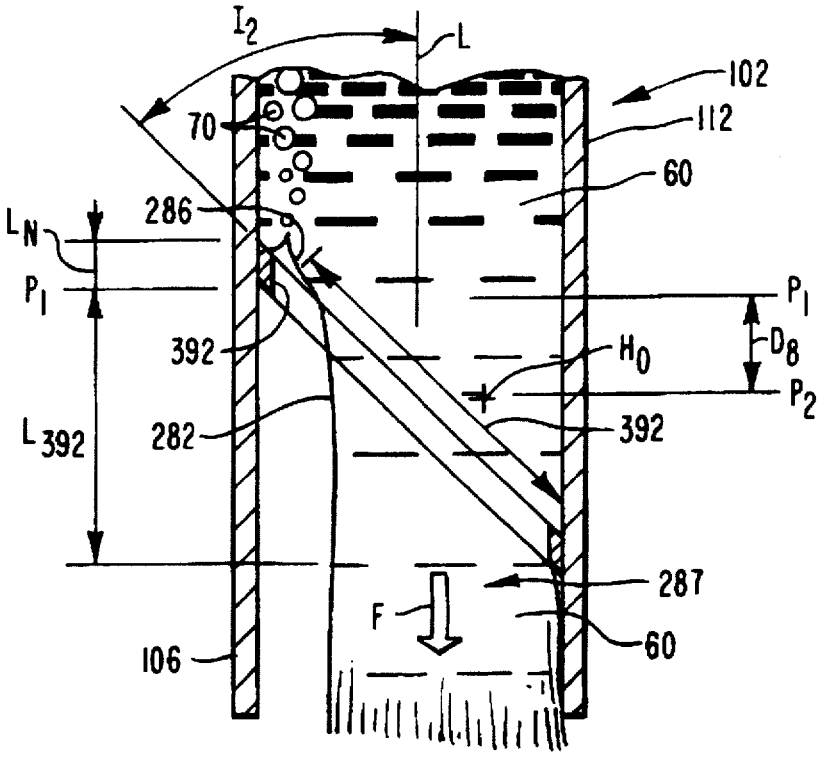
FIG. 21C is a schematic diagram of selected functions operative during pouring of a fluid of high viscosity from the pour spout of FIG. 16.

FIG. 21C illustrates the effect on the outflow of fluid 60 of a fluid of high viscosity. Edge 282 of column 281 of fluid 60 in remote end 106 of fluid conduit 106 is drawn far away from upper edge 394 of aperture 392 reducing in effect the length of aperture 392 utilizing fluid outflow and resulting in an increasing cone 286 of incipient air bubbles 70 above upper edge 394 of aperture 392. In addition, the point $H_0$ of zero static head pressure in flowing fluid 60 moves further from container 12 resulting in a positive distance $D_8$ between second position $P_2$ and first position $P_1$ that is larger than positive distance $D_7$ shown in FIG. 21B.

Figure 21D:
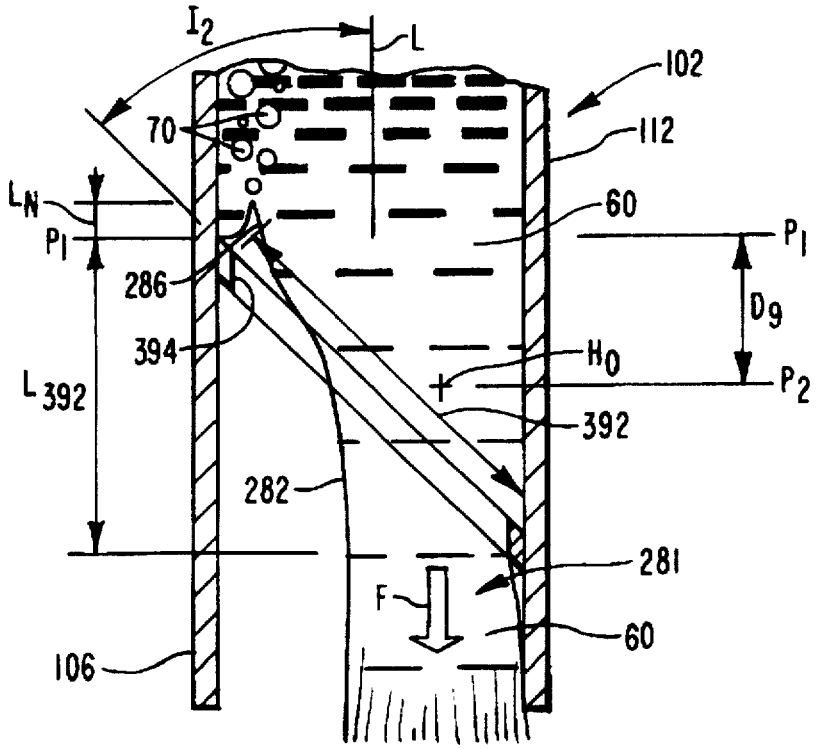
FIG. 21D is a schematic diagram of selected functions operative during pouring of a fluid of very high viscosity from the pour spout of FIG. 16.

Finally, illustrated in FIG. 21D, the outflow through fluid conduit of a fluid 60 of heavy viscosity produces a column 281 of fluid 60 in remote end 106 of fluid conduit 102 that is quite contracted relative to the column of fluid illustrated in FIGS. 21A, 21B, and 21C. Edge 282 of column 281 of fluid 60 is drawn far from upper edge 394 of aperture 392. Additionally, the cone 286 of incipient air bubbles 70 above upper edge 392 becomes quite pronounced correspondingly reducing the portion of aperture 392 used for the outflow of fluid 60. It is possible, in fact, that the development of cone 286 of incipient air bubbles 70 actually move first longitudinal position $P_1$ corresponding to the point of entry of air to the interior space in fluid conduit 106 and fluid container 12 closer to container 12 than is illustrated in FIGS. 21A, 21B, and 21C. Correspondingly, the point $H_0$ of zero static head pressure in the flow of fluid 60 is moved further from fluid container 12. These factors together produce a positive distance $D_9$ that is larger than the distance $D_8$ created in FIG. 21C.

Figure 22:
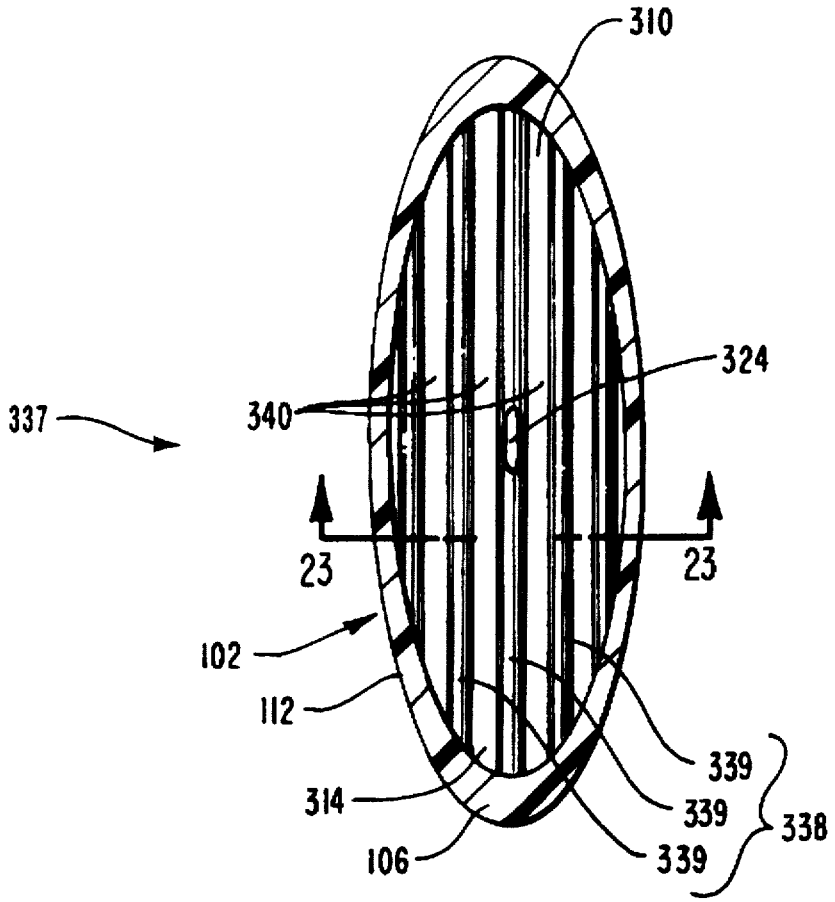
FIG. 22 is a plan view of a second embodiment of a barricade of the type illustrated in FIG. 18.
Figure 23:
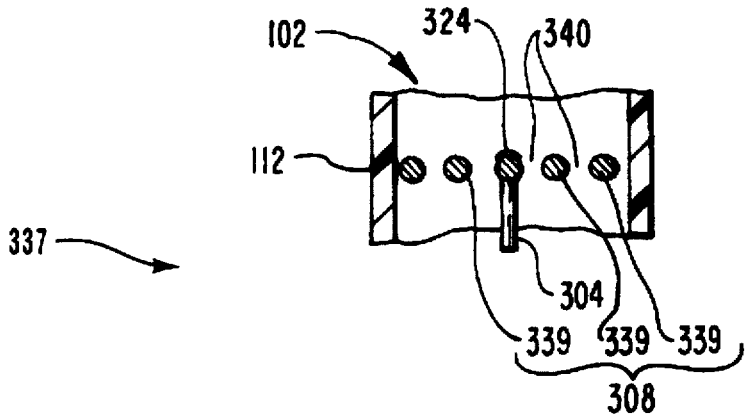
FIG. 23 is a cross-sectional view of the barricade illustrated in FIG. 22 taken along section line 23—23 shown therein.

FIGS. 22 and 23 illustrate a second embodiment of a barricade 338. FIG. 22 is a view taken normal to the plane of barricade 338 showing that structure disposed within the walls of fluid conduit 102. Barricade 338 can there be seen to comprise a plurality of elongated obstacles 339 secured in planar, spaced-apart relationship within fluid conduit 102 at inclination $I_2$ to the longitudinal axis L thereof. Between each adjacent pair of obstacles 339 is accordingly formed an elongated aperture 340, at least one of which extends continuously from a first longitudinal position in fluid conduit 102 corresponding to uppermost portion 310 of barricade 302 to a second longitudinal position therein located further from fluid container 12 and corresponding to lowermost portion 314 of barricade 302.

Figure 19:
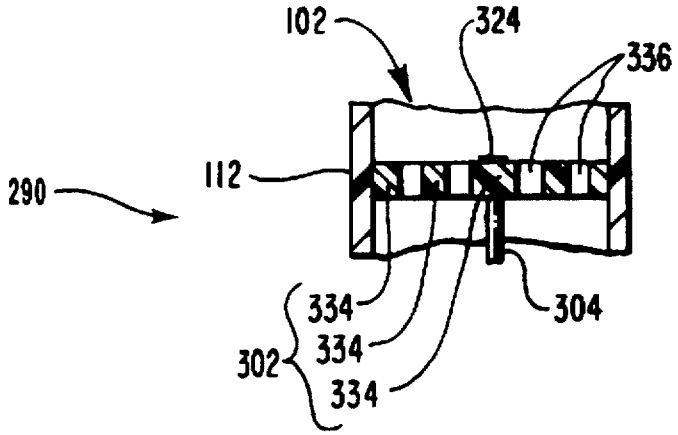
FIG. 19 is a cross-sectional view of the barricade illustrated in FIG. 18 taken along section line 19—19 shown therein.

Obstacles 339 of a barricade, such as barricade 338, can assume any cross-sectional shape desired. As shown in FIG. 23, however, each of obstacles 339 comprises a cylindrical rod secured at the ends thereof to the inner surface of the walls of fluid conduit 102. The profile and the cross-section of each of the apertures, such as apertures 340, can vary dramatically. In the embodiment illustrated in FIGS. 19 and 22, apertures 336 and 340 respectively have an elongated, generally uniform profile and a cross-section that tapers to a minimum width at the center thereof. Other profiles and cross-sections are within the contemplated scope of the present invention, as will be illustrated by the further embodiments disclosed herein.

Obstacles 339 may be integrally formed with fluid conduit 102 or with equal effectiveness bonded thereto by adhesive, by ultrasonic techniques, or by welding.

It has been found, for example, that in a pour spout having a fluid conduit with an inner diameter of 0.75 inches, a barricade, such as barricade 338 comprised of a spaced-apart array of rod-like obstacles, has produced exceedingly satisfactory effects for fluids of low viscosity, such as water and gasoline and satisfactory fluid control for fluids of higher viscosity, such as cooking oil. The rod-like obstacles of the barrier were disposed with the lower end thereof at the extreme open end of the fluid conduit. The longest rod in the array had a length of 2.50 inches. All rods had an outer diameter of 0.063 inches.

To achieve enhanced flow capability relative particularly to fluids of high viscosity, rods of the same size and shape were disposed in a fluid conduit of the same diameter, but with the upper end thereof closely proximate to the end thereof adjacent the fluid container. Continued excellent performance was experienced with fluids of low viscosity, while satisfactory vented fluid flow occurred for fluids as dense as 90-weight motor oil at room temperature.

In the discussion which follows, wherever possible, like structures will be referred to by identical reference characters as utilized above.

Figure 24:
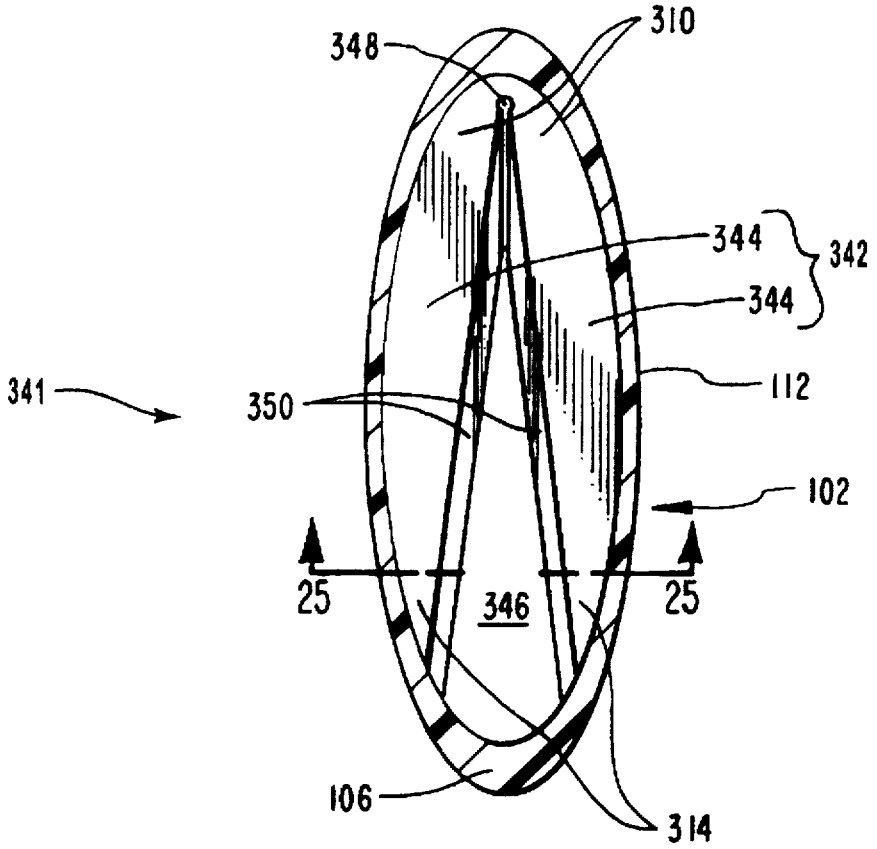
FIG. 24 is a plan view of a third embodiment of a barricade of the type illustrated in FIG. 18.
Figure 25:
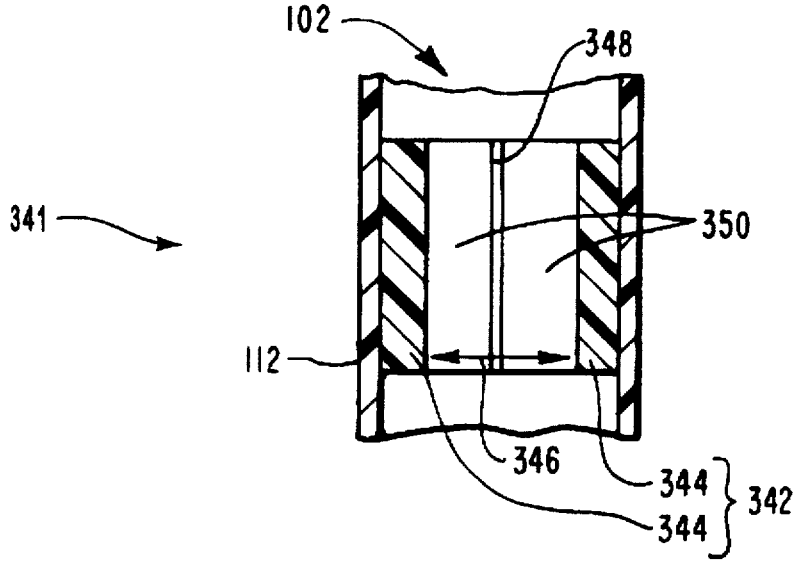
FIG. 25 is a cross-sectional view of the barricade illustrated in FIG. 24 taken along section line 25—25 shown therein.

FIGS. 24 and 25 illustrate a third embodiment of a barricade 342 incorporating teachings of the present invention. Barricade 342 also comprises a plate 344 having formed centrally therein a single elongated aperture 346 extending from lowermost portion 314 of barricade 342 to uppermost portion 310 thereof. In use, air bubbles 70 will pass through barricade 342 at uppermost portion 310 thereof, where an eyelette 348 is formed. Fluid 60 passes in the opposite direction through the medial portion and lowermost portion 314. As best appreciated by reference to FIG. 25, barricade 342 is substantially thicker than the other barricades disclosed above, having expansive walls 350 bounding each side of aperture 346.

This feature in the barricade, such as barricade 342, has been found to advantageously contribute to the effective functioning of the viscosity accommodating transfer means of the present invention when utilized with fluids having high viscosity. For example, in a fluid conduit having an inner diameter of 0.75 inches, a barrier having a maximum length of 2.50 inches, but a thickness of 1.0 inches, was disposed close to remote end 106 of fluid conduit 102. The resulting structure proved not only excellent in producing vented flow of fluids with low viscosity, but controlled, albeit slow, even, vented flow of fluids having heavy viscosity.

In FIGS. 24 and 25 no provision is illustrated for supporting fluid conduit termination disk 300, as the latter structure can alternately be supported from remote end 106 of fluid conduit 102.

Figure 26:
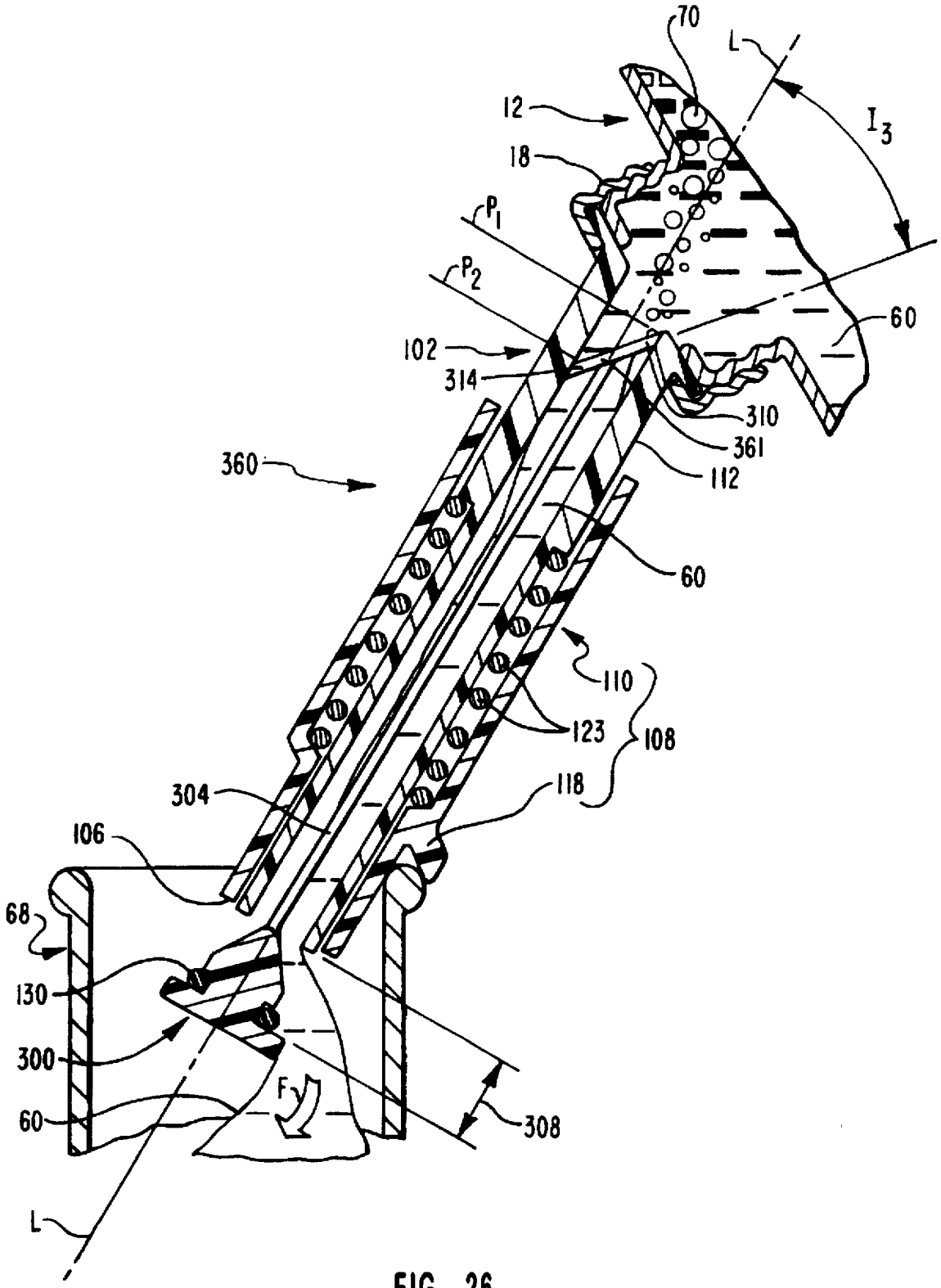
FIG. 26 is a cross-sectional elevation view of the full length of a fifth embodiment of a pour spout incorporating teachings of the present invention and any of the first, second, or third embodiments of barricades illustrated in the preceding FIGS. 16–25 with the slide valve thereof in its open position.

FIG. 26 illustrates a fourth embodiment of a pour spout 360 similar in many respects to pour spout 230 discussed above. Accordingly, identical reference characters as used relative to pour spout 230 will be used in the following discussion to identify components of pour spout 360.

In FIG. 26, slide valve 108 of pour spout 360 is shown in the open position thereof. As a result, fluid discharge opening 308 is disclosed between remote end 106 of fluid conduit 102 and fluid conduit termination disk 300.

In accordance with one aspect of the present invention, a pour spout, such as pour spout 360, is provided with a barricade 361 disposed in fluid conduit 102 at an inclination $I_3$ to longitudinal axis L of fluid conduit 102. The inclination $I_3$ of barricade 361 is greater than the inclination $I_2$ associated, for example, with barricade 302 of FIG. 16. As a result, the longitudinal position $P_1$ at which air bubbles 70 enter the interior of fluid conduit 102 and container 12 is close longitudinally to the second longitudinal position $P_2$ just above the portion or portion of barricade 361 at which a point of zero static head pressure in the flow of fluid 60 is developed. Although uppermost portion 310 of barricade 361 is disposed on the same side of fluid conduit 102 as projection 118 of slide valve 108, air bubbles 70 pass through barricade 361 at uppermost portion 310 as in other embodiments disclosed above of such barricades. Any of the variety of apertures already disclosed relative to barricades can be utilized for permitting the exchange of fluid and air through barricade 361.

Figure 27:
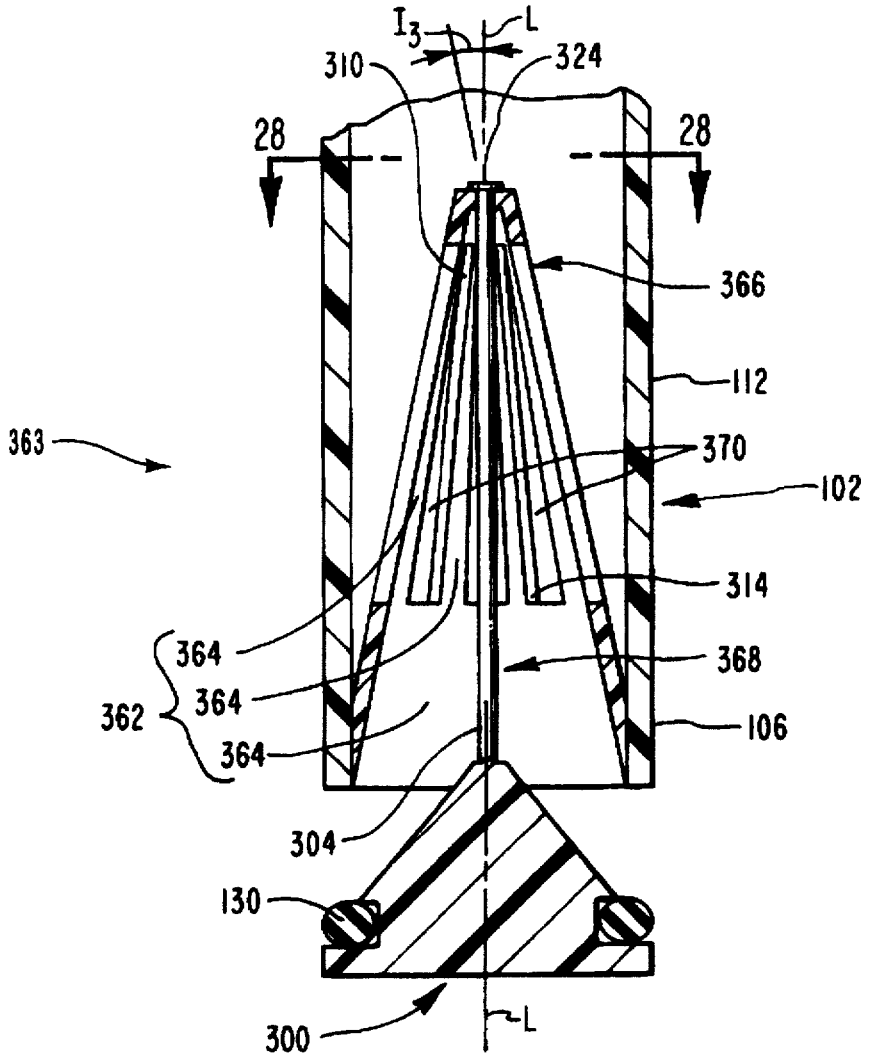
FIG. 27 is a cross-sectional elevation view of the end of a pour spout, such as the pour spout depicted in FIGS. 16 and 17, illustrating a fourth embodiment of a barricade for use therein.
Figure 28:
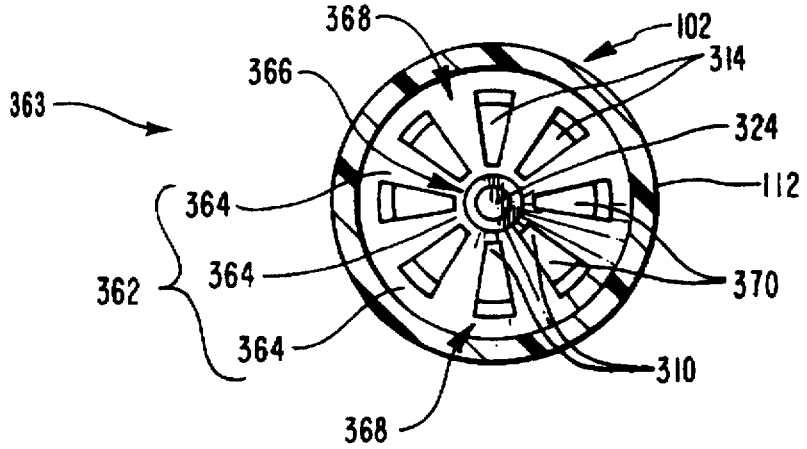
FIG. 28 is a cross-sectional view of the pour spout illustrated in FIG. 27 taken along section line 28—28 shown therein.

FIGS. 27 and 28 illustrate a fourth embodiment of a barricade 362 incorporating teachings of the present invention. Barricade 362 comprises a cone 364 having the small end 366 thereof oriented toward container 12 and the large end 368 thereof engaging the interior surface of the walls of fluid conduit 102.

Cone 364 has a plurality of elongated apertures 370 formed therethrough extending in general alignment with the longitudinal axis of cone 364, which is coincident with longitudinal axis L of fluid conduit 102 shown. In this manner, apertures 370 extend continuously from lowermost portion 314 of barricade 362 to uppermost portion 310 thereof.

The sides of cone 364 are disposed at an inclination $I_3$ to the longitudinal axis L of fluid conduit 102. The portions of cone 364 between each of apertures 370 comprise a plurality of elongated obstacles secured in spaced-apart relationship within fluid conduit 102, each disposed at an inclination $I_3$ relative to the longitudinal axis L thereof.

Fluid 60 can thus pass through barricade 362 at the medial and at the lowermost portion 314 thereof, while air bubbles 70 pass therethrough in the reverse direction at uppermost portion 310. The relative portions of apertures 370 utilized by air bubbles 70 and fluid 60 in this process is automatically compensating of any viscosity variation in the fluids transferred through pour spout 363.

Figure 29:
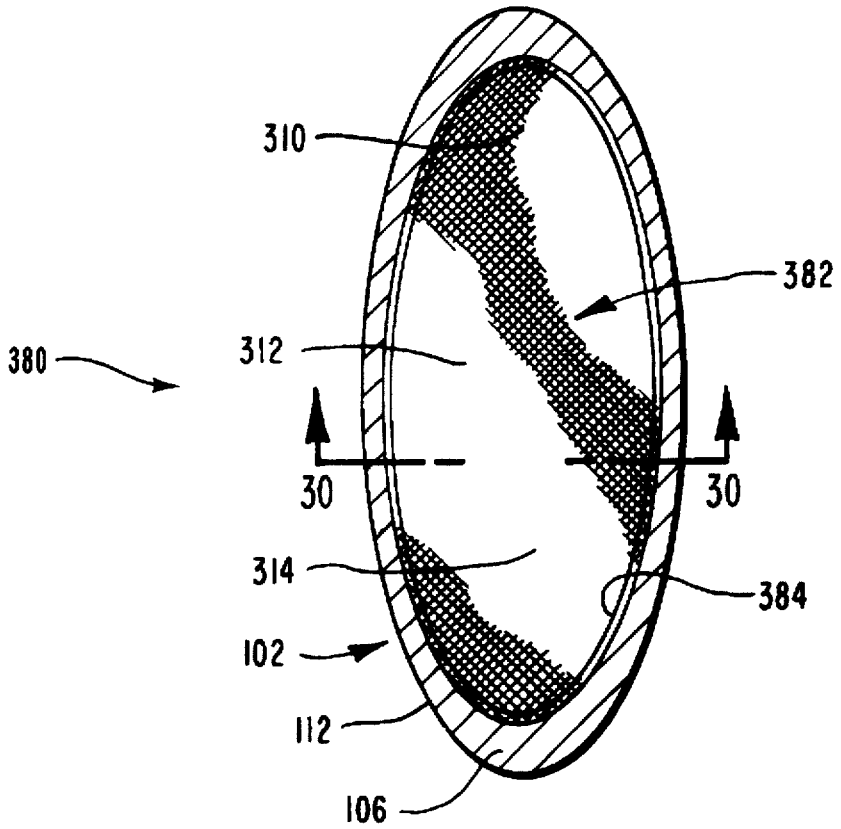
FIG. 29 is a plan view of a fifth embodiment of a barricade of the type illustrated in FIG. 18.
Figure 30:
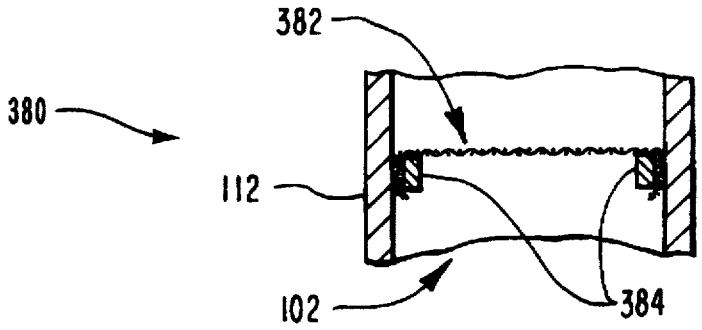
FIG. 30 is a cross-sectional view of the barricade illustrated in FIG. 29 taken along section line 29—29 shown therein.

FIGS. 29 and 30 illustrate a fifth embodiment of a barricade 382 comprising a sheet of screen mesh mounted within the interior of conduit 102 at an inclination $I_3$ to the longitudinal axis L thereof. The screen mesh is carried on and bonded to the interior of fluid conduit 102 by a support ring 384. The screen mesh comprises a uniform array of small apertures separated by a network of uniformly or otherwise dimentioned filaments made of wire or other material. When the screen mesh is mounted as illustrated in FIGS. 29 and 30 at an inclination $I_3$ within fluid conduit 102, the uniform array of small apertures therethrough function as the equivalent of a plurality of elongated fine apertures disposed at inclination $I_3$ to longitudinal axis L of fluid conduit 102. Correspondingly, the filaments of the screen mesh between the apertures function as the equivalent of a plurality of fine, spaced-apart obstacles also disposed at an inclination $I_3$ to longitudinal axis L of fluid conduit 102.

As a result, fluid 60 in fluid conduit 102 between barricade 382 of screen mesh and fluid container 12 is partially restrained by barricade 382 from passing along fluid conduit 102 for discharge. Instead, that fluid passes through the apertures in lowermost portion 314 and medial portion 312 of barricade 382, while air on the opposite side of barricade 382 from fluid container 12 moves toward uppermost portion 310 thereof and is passed through barricade 382 in the apertures thereat. As a result, the portion of barricade 382 utilized for transferring fluid 60 varies with the viscosity of that fluid.

Thus, the disclosed structures result in a pour spout that precludes the overflow of any receiving vessel and is conducive to the uniform, even flow of fluid thereinto. Spills are eliminated during fluid transfers, and the salutary results achieved are available regardless of the viscosity of the fluid being transferred.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A pour spout for permitting transfer of a fluid from a container of the fluid to a receiving vessel, the pour spout comprising:

(a) a fluid conduit opening at a first end thereof into the container of fluid, said fluid conduit being provided at a location remote from the container with a fluid discharge opening through which fluid from the container is transferred into the receiving vessel and through which air enters said fluid conduit;

(b) a barricade fixed in said fluid conduit intermediate said fluid discharge opening and said first end of said fluid conduit, said barricade extending across the interior of said fluid conduit obstructing the flow of fluid through said fluid conduit from the container; and (c) viscosity accommodating transfer means formed in said barricade for smoothly and continuously exchanging through said barricade air in said fluid conduit from said fluid discharge opening and fluid from the container by varying both the cross-sectional area of fluid flow and the cross-sectional area of air flow through said barricade with the viscosity of the fluid.

2. A pour spout as recited in claim 1, wherein said barricade is disposed across the interior of said fluid conduit at an inclination relative to the longitudinal axis thereof, and said transfer means comprises an elongated aperture formed through said barricade extending continuously from an upper portion of said barricade to a lower portion of said barricade.

3. A pour spout as recited in claim 2, wherein said barricade comprises a planar structure.

4. A pour spout as recited in claim 3, wherein said planar structure comprises a plate.

5. A pour spout as recited in claim 4, wherein a plurality of elongated apertures are formed through said plate parallel generally to the longitudinal axis of said plate.

6. A pour spout as recited in claim 3, wherein said planar structure has a uniform thickness.

7. A pour spout as recited in claim 2, wherein said upper portion of said barricade is disposed closer to said one end of said fluid conduit than said lowermost portion of said barricade.

8. A pour spout as recited in claim 2, wherein said transfer means comprises a plurality of parallel elongated apertures formed through said barricade.

9. A pour spout as recited in claim 2, wherein said barricade comprises a plurality of elongated obstacles secured in a planar spaced-apart relationship within said fluid conduit at an inclination relative to the longitudinal axis thereof, said elongated aperture being defined between an adjacent pair of said plurality of elongated obstacles.

10. A pour spout as recited in claim 2, wherein said elongated aperture tapers in width in a direction from said lower to said upper portion of said barricade.

11. A pour spout as recited in claim 1, further comprising closure means for precluding any transfer of the fluid through said discharge opening into the receiving vessel until said fluid discharge opening is inside the receiving vessel.

12. A pour spout as recite in claim 1, wherein said barricade comprises a plate.

13. A pour spout as recited in claim 12, wherein said plate has a uniform thickness.

14. A pour spout as recited in claim 1, wherein said transfer means mutually varies the cross-sectional area of the fluid flow through said barricade and the cross-sectional area of the air flow through said barricade with the viscosity of the fluid.

15. A pour spout as recited in claim 1, wherein said barricade is disposed in said fluid conduit at a location proximal to the container of the fluid.

16. A pour spout as recited in claim 1, wherein said barricade is disposed in said fluid conduit at a location remote from the container of the fluid.

17. A pour spout as recited in claim 1, wherein said barricade has a peripheral edge that is secured to the interior surface of said fluid conduit.

18. A pour spout for permitting transfer of a fluid from a container of the fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel and through which air enters said fluid conduit;

(b) closure means for precluding any transfer of the fluid through said discharge opening into the receiving vessel until said fluid discharge opening is inside the receiving vessel, said closure means comprising:

(i) a slide valve having a closed position in which transfer of the fluid through said discharge opening is precluded;

(ii) a spring urging said slide valve into said closed position thereof; and (iii) slide valve release means for co-acting with the receiving vessel to move said slide valve out of said closed position when said fluid discharge opening on said fluid conduit enters into the receiving vessel;

(c) a barricade disposed across the interior of said fluid conduit obstructing the flow of fluid through said fluid conduit from the container; and (d) viscosity accommodating transfer means formed in said barricade for smoothly and continuously exchanging through said barricade air in said fluid conduit from said fluid discharge opening and fluid from the container by varying both the cross-sectional area of fluid flow and the cross-sectional area of air flow through said barricade with the viscosity of the fluid.

19. A pour spout as recited in claim 18, further comprising a fluid conduit termination disk supported at a distance from the end of said fluid conduit remote from the container of fluid, thereby to form said fluid discharge opening between said fluid conduit termination disk and the end of said fluid conduit remote from the container of fluid.

20. A pour spout as recited in claim 19, wherein said slide valve is in a sealing engagement with said fluid conduit termination disk when said slide valve is in said closed position.

21. A pour spout as recited in claim 19, further comprising a slide valve seal encircling said fluid conduit termination disk, said slide valve seal and said slide valve being in a sealing engagement when said slide valve is in said closed position.

22. A pour spout as recited in claim 19, wherein said fluid conduit termination disk is concentrically disposed about the longitudinal axis of said fluid conduit.

23. A pour spout as recited in claim 19, wherein said fluid conduit termination disk is supported from said barricade.

24. A pour spout as recited in claim 23, wherein said fluid conduit termination disk is supported from said barricade by a support shaft.

25. A pour spout as recited in claim 24, wherein said fluid conduit termination disk is attached to one end of said support shaft, said support shaft having an opposite end attached to said barricade, said support shaft and said fluid conduit termination disk being in a cantilever arrangement with said barricade.

26. A pour spout as recited in claim 23, wherein said fluid conduit termination disk is supported from said barricade at the medial portion of said barricade.

27. A pour spout for permitting transfer of a fluid from a container of the fluid to a receiving vessel, the pour spout comprising:

(a) a fluid conduit opening at a first end thereof into the container of fluid, said fluid conduit being provided at a location remote from the container with a fluid discharge opening through which fluid from the container is transferred into the receiving vessel and through which air enters said fluid conduit; and (b) a plurality of elongated obstacles fixed in said fluid conduit intermediate said fluid discharge opening and said first end of said fluid conduit in a proximate, spaced-apart relationship at an inclination relative to the longitudinal axis of said fluid conduit, thereby defining a plurality of elongated apertures between adjacent of said obstacles said plurality of obstacles defining a barricade disposed across the interior of said fluid conduit obstructing the flow of fluid through said fluid conduit from the container, and said plurality of apertures defining viscosity accommodating transfer means formed in said barricade for smoothly and continuously exchanging through said barricade air in said fluid conduit from said fluid discharge opening and fluid from the container by varying both the cross-sectional area of fluid flow and the cross-sectional area of air flow through said barricade with the viscosity of the fluid.

28. A pour spout as recited in claim 27, further comprising closure means for precluding any transfer of the fluid through said discharge opening into the receiving vessel until said fluid discharge opening is inside the receiving vessel.

29. A pour spout as recited in claim 27, wherein said elongated obstacles are disposed so as to form a planar structure.

30. A pour spout as recited in claim 29, wherein said plurality of elongated obstacles comprise filaments in a screen mesh sheet.

31. A pour spout as recited in claim 29, wherein said plurality of elongated obstacles comprises a pair of adjacent obstacles, and said pair of adjacent obstacles define therebetween an elongated aperture that tapers in width.

32. A pour spout as recited in claim 29, wherein said plurality of elongated obstacles are integrally formed with each other.

33. A pour spout as recited in claim 29, wherein said elongated obstacles are secured within said fluid conduit to the interior of said fluid conduit.

34. A pour spout as recited in claim 27, wherein said elongated obstacles are disposed so as to form a cone.

35. A pour spout for permitting transfer of a fluid from a container of the fluid into a receiving vessel, the pour spout comprising:

(a) a fluid conduit opening at one end thereof into the container of fluid;

(b) a fluid conduit termination disk supported at a distance from the end of said fluid conduit remote from the container of fluid, thereby to define between said fluid conduit termination disk and the end of said fluid conduit remote from the fluid container a fluid discharge opening through which fluid from the container is transferred into the receiving vessel;

(c) closure means for precluding any transfer of the fluid through said discharge opening into the receiving vessel until said fluid discharge opening is inside the receiving vessel; and (d) a barricade disposed across the interior of said fluid conduit at an inclination relative to the longitudinal axis thereof, said barricade having formed therethrough an elongated aperture extending continuously from an upper portion of said barricade to a lower portion of said barricade, whereby the cross-sectional area of fluid flow through said elongated aperture in said barricade varies with the viscosity of the fluid.

36. A pour spout as recited in claim 35, wherein said barricade comprises a plate disposed in said fluid conduit at an inclination to said longitudinal axis thereof.

37. A pour spout as recited in claim 36, wherein said plate has a uniform thickness.

38. A pour spout as recited in claim 35, wherein said barricade comprises a plurality of elongated obstacles secured in planar, spaced-apart relationship within said fluid conduit at an inclination relative to the longitudinal axis thereof.

39. A pour spout as recited in claim 35, wherein the cross-sectional area of air flow through said elongated aperture in the barricade varies with said viscosity of said fluid.

40. A pour spout as recited in claim 39, wherein the cross-sectional area of the fluid flow through said elongated aperture in said barricade and the cross-sectional area of the air flow through said elongated aperture in said barricade mutually varies with the viscosity of the fluid.

41. A pour spout as recited in claim 35, wherein said closure means comprises:

(a) a slide valve having a closed position in which transfer of fluid through said discharge opening is precluded;

(b) a spring urging said slide valve into said closed position thereof, and (c) slide valve release means for co-acting with the receiving vessel to move said slide valve out of said closed position when said fluid discharge opening on said fluid conduit enters into the receiving vessel.

42. A pour spout as recited in claim 41, wherein said slide valve is in a sealing engagement with said fluid conduit termination disk when said slide valve is in said closed position.

43. A pour spout as recited in claim 41, further comprising a slide valve seal encircling said fluid conduit termination disk, said slide valve seal and said slide valve being in a sealing engagement when said slide valve is in said closed position.

44. A pour spout as recited in claim 35, wherein said fluid conduit termination disk as supported from said barricade.

45. A pour spout as recited in claim 44, wherein said fluid conduit termination disk is supported from said barricade by a support shaft.

46. A pour spout as recited in claim 35, wherein said barricade is disposed in said fluid conduit at a location proximal to the container of the fluid.

47. A pour spout as recited in claim 35, wherein said barricade is disposed in said fluid conduit at a location remote from the container of the fluid.

48. A pour spout as recited in claim 35, wherein said barricade comprises a cone disposed in said fluid conduit with the small end of said cone oriented toward the container of fluid and the large end of said cone engaging the interior of said fluid conduit, said cone having at least one elongated aperture formed therethrough extending continuously from said upper portion to a lower portion of said cone.

49. A pour spout for permitting transfer of a fluid from a container of the fluid into a receiving vessel, the pour spout comprising:

(a) a fluid conduit opening at one end thereof into the container of fluid;

(b) a fluid conduit termination disk supported at a distance from the end of said fluid conduit remote from the container of fluid, thereby to define between said fluid conduit termination disk and the end of said fluid conduit remote from the fluid container a fluid discharge opening through which fluid from the container is transferred into the receiving vessel;

(c) closure means for precluding any transfer of the fluid through said discharge opening into the receiving vessel until said fluid discharge opening is inside the receiving vessel; and (d) a barricade comprising a planar structure disposed across the interior of said fluid conduit at an inclination relative to the longitudinal axis thereof and having formed therethrough an elongated aperture extending continuously from an upper portion of said planar structure to a lower portion of said planar structure.

50. A pour spout as recited in claim 49, wherein said planar structure comprises a plate.

51. A pour spout as recited in claim 49, wherein said planar structure comprises a plurality of elongated obstacles disposed in a planar, spaced-apart relationship in said fluid conduit at an inclination relative to the longitudinal axis thereof.

52. A pour spout as recited in claim 49, wherein said planar structure comprises a screen mesh sheet disposed in said fluid conduit at an inclination relative to the longitudinal axis thereof.

53. A pour spout as recited in claim 49, wherein said planar structure comprises a plate having formed therethrough an elongated aperture tapering in width.

54. A pour spout for permitting transfer of a fluid from a container of the fluid to a receiving vessel, the pour spout comprising:

(a) a fluid conduit opening at a first end thereof into the container of fluid, said fluid conduit being provided at a location remote from the container with a fluid discharge opening through which fluid from the container is transferred into the receiving vessel and through which air enters said fluid conduit;

(b) a barricade extending across the interior of said fluid conduit intermediate said fluid discharge opening and said first end of said fluid conduit at an inclination relative to the longitudinal axis of said fluid conduit, said barricade thereby obstructing the flow of fluid through said fluid conduit from the container; and (c) viscosity accommodating transfer means formed in said barricade for smoothly and continuously exchanging through said barricade air in said fluid conduit from said fluid discharge opening and fluid from the container at a rate determined by the viscosity thereof, said transfer means comprising an elongated aperture formed through said barricade extending continuously from an upper portion of said barricade to a lower portion of said barricade, said elongated aperture having an upper edge at said upper portion of said barricade, a lower edge at said lower portion of said barricade, and a pair of longitudinal edges extending between said upper edge and said lower edge, air in said fluid conduit passing through said elongated aperture doing so at said upper edge thereof, and fluid from said container passing through said elongated aperture doing so at said lower edge thereof.

55. A pour spout as recited in claim 54, wherein said longitudinal edges of elongated aperture are continuous.

56. A pour spout as recited in claim 54, further comprising a filament extending between said longitudinal edges of said elongated aperture, the thickness of said filament measured in a direction parallel to the length of said elongated aperture being substantially less than the length of said aperture.

57. A pour spout for permitting transfer of a fluid from a container of the fluid to a receiving vessel the pour spout comprising:

(a) a fluid conduit opening at one end thereof into the container of fluid, said fluid conduit being provided at a location remote from the container with a fluid discharge opening through which fluid from the container is transferred into the receiving vessel and through which air enters said fluid conduit; and (b) a pair of adjacent obstacles secured in a planar, spaced-apart relationship within said fluid conduit at an inclination relative to the longitudinal axis thereof, said pair of obstacles defining a barricade disposed across the interior of said fluid conduit obstructing the flow of fluid through said fluid conduit from the container, and (c) said pair of adjacent obstacles defining therebetween an elongated aperture of tapering width, and said aperture defining viscosity accommodating transfer means formed in said barricade for smoothly and continuously exchanging through said barricade air in said fluid conduit from said fluid discharge opening and fluid from the container by varying both the cross-sectional area of fluid flow and the cross-sectional area of air flow through said barricade with the viscosity of the fluid.

58. A pour spout as recited in claim 57, wherein said elongated aperture narrows in width toward the container.

59. A pour spout as recited in claim 57, wherein said elongated obstacles are secured within said fluid conduit to the interior of said fluid conduit.

60. A pour spout as recited in claim 57, wherein said plurality of elongated obstacles are integrally formed with each other.

61. A pour spout as recited in claim 60, wherein said pair of adjacent obstacles are joined at the upper ends thereof.

62. A pour spout as recited in claim 60, wherein said pair of adjacent obstacles are joined at the lower ends thereof.

63. A pour spout as recited in claim 60, wherein said pair of obstacles are joined at the upper ends thereof respectively and at the lower ends thereof respectively.

64. A pour spout as recited in claim 63, wherein said upper portion of said barricade is disposed closer to said one end of said fluid conduit than said lower portion of said barricade.

65. A pour spout as recited in claim 57, wherein said elongated aperture has an upper edge, a lower edge on the opposite side thereof from the container, and a pair of longitudinal edges extending between said upper edge and said lower edge, air said fluid conduit passing said through said elongated aperture doing so at said upper edge thereof and fluid from said container passing through said elongated aperture doing so at said lower edge thereof.

66. A pour spout as recited in claim 65, wherein said longitudinal edges of said aperture are linear.

67. A pour spout as recited in claim 66, wherein said lower edge of said aperture is linear.

68. A pour spout as recited in claim 65, wherein said upper edge of said elongated aperture comprises a vertex between said longitudinal edges thereof.

69. A pour spout as recited in claim 65, wherein said upper edge of said aperture is shorter than said lower edge of said aperture.

70. A pour spout as recited in claim 65, wherein said upper edge of said aperture corresponds to the inside surface of said conduit.

71. A pour spout as recited in claim 65, wherein said upper edge of said aperture is linear.

72. A pour spout as recited in claim 65, wherein said lower edge of said aperture is linear.

73. A pour spout as recited in claim 65, wherein said lower edge of said aperture corresponds to the interior surface of said conduit.

74. A pour spout for permitting transfer of a fluid from a container of the fluid into a receiving vessel, the pour spout comprising:

(a) a fluid conduit opening at one end thereof into the container of fluid;

(b) a fluid conduit termination disk supported at a distance from the end of said fluid conduit remote from the container of fluid, thereby to define between said fluid conduit termination disk and the end of said fluid conduit remote from the fluid container a fluid discharge opening through which fluid from the container is transferred into the receiving vessel;

(c) closure means for precluding any transfer of the fluid through said discharge opening into the receiving vessel until said fluid discharge opening is inside the receiving vessel;

(d) a plate disposed across the interior of said fluid conduit at an inclination relative to the longitudinal axis thereof; and (e) an elongated aperture formed through said plate extending from an upper portion of said plate to a lower portion of said plate, said elongated aperture comprising an upper edge at said upper portion of said plate, a lower edge at said lower portion of said plate, and a pair of longitudinal edges extending between said upper edge and said lower edge, air in said fluid conduit passing through said elongated aperture doing so at said upper edge thereof and fluid from said container passing through said elongated aperture doing so at said lower edge thereof, whereby the cross-sectional area of fluid flow through said elongated aperture in said plate varies with the viscosity of the fluid.

75. A pour spout as recited in claim 74, wherein a plurality of parallel apertures are formed through said plate.

76. A pour spout as recited in claim 74, wherein the cross-sectional area of air flow through said elongated aperture in said plate varies with said viscosity of the fluid.

77. A pour spout as recited in claim 76, wherein the cross-sectional area of the fluid flow through said plate and the cross-sectional area of the air flow through said plate mutually varies with the viscosity of the fluid.

78. A pour spout as recited in claim 74, wherein said plate is planar.

79. A pour spout as recited in claim 74, wherein said plate has a uniform thickness.

80. A pour spout as recited in claim 74, wherein said fluid conduit termination disk is supported from said plate.

81. A pour spout as recited in claim 74, wherein said upper portion of said plate is disposed closer to said one end of said fluid conduit than said lower portion of said plate.

82. A pour spout as recited in claim 74, wherein said plate has a peripheral edge that is secured to the interior surface of said fluid conduit.

83. A pour spout for permitting transfer of a fluid from a container of the fluid to a receiving vessel, the pour spout comprising:

(a) a fluid conduit opening at a first end thereof into the container of fluid, said fluid conduit being provided at the opposite end with a fluid discharge opening through which fluid from the container is transferred into the receiving vessel;

(b) a barricade fixed in said fluid conduit extending across the interior of said fluid conduit intermediate said fluid discharge opening and said first end of said fluid conduit, said barricade obstructing the flow of fluid through said fluid conduit from the container; and (c) viscosity accommodating transfer means formed in said barricade for smoothly and continuously exchanging through said barricade air in said fluid conduit from said fluid discharge opening and fluid from the container by varying both the cross-sectional area of fluid flow and the cross-sectional area of air flow through said barricade with the viscosity of the fluid.

84. A pour spout as recited in claim 83, wherein said transfer means mutually varies the cross-sectional area of the fluid flow through said barricade and the cross-sectional area of the air flow through said barricade with the viscosity of the fluid.

85. A pour spout as recited in claim 83, wherein said barricade is disposed across the interior of said fluid conduit at an inclination relative to the longitudinal axis thereof, and said transfer means comprises an elongated aperture formed through said barricade extending continuously from an upper portion of said barricade to a lower portion of said barricade.

86. A pour spout as recited in claim 83, wherein said barricade comprises a planar structure.

87. A pour spout as recited in claim 83, wherein said discharge opening is at a location remote from the container of the fluid.

88. A pour spout as recited in claim 83, further comprising closure means for precluding any transfer of the fluid through said discharge opening into the receiving vessel until said fluid discharge opening is inside the receiving vessel.

89. A pour spout as recited in claim 83, wherein said barricade comprises a plate.

90. A pour spout as recited in claim 89, wherein said plate is planar.

91. A pour spout for permitting transfer of a fluid from a container of the fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel and through which air enters said fluid conduit;

(b) a barricade disposed across the interior of said fluid conduit at an inclination relative to the longitudinal axis thereof obstructing the flow of fluid through said fluid conduit from the container; and (c) viscosity accommodating transfer means formed in said barricade for smoothly and continuously exchanging through said barricade air in said fluid conduit from said fluid discharge opening and fluid from the container by varying both the cross-sectional area of fluid flow and the cross-sectional area of air flow through said barricade with the viscosity of the fluid, wherein said transfer means comprises an elongated aperture formed through said barricade extending continuously from an upper portion of said barricade to a lower portion of said barricade, said elongated aperture tapering in width in a direction from said lower portion of said barricade to said upper portion of said barricade.

92. A pour spout as recited in claim 91, wherein said elongated aperture narrows in width toward the container.

93. A pour spout as recited in claim 91, wherein said barricade has a peripheral edge that is secured to the interior surface of said fluid conduit.

94. A pour spout as recited in claim 91, wherein said upper portion of said barricade is disposed closer to said one end of said fluid conduit than said lower portion of said barricade.

95. A pour spout as recited in claim 94, wherein said lower edge of said aperture corresponds to the interior surface of said conduit.

96. A pour spout as recited in claim 94, wherein said elongated aperture has an upper edge, a lower edge on the opposite side thereof from the container, and a pair of longitudinal edges extending between said upper edge and said lower edge, air said fluid conduit passing said through said elongated aperture doing so at said upper edge thereof and fluid from said container passing through said elongated aperture doing so at said lower edge thereof.

97. A pour spout as recited in claim 94, wherein said longitudinal edges of said aperture are linear.

98. A pour spout as recited in claim 94, wherein said upper edge of said elongated aperture comprises a vertex between said longitudinal edges thereof.

99. A pour spout as recited in claim 94, wherein said upper edge of said aperture is shorter than said lower edge of said aperture.

100. A pour spout as recited in claim 94, wherein said upper edge of said aperture is linear.

101. A pour spout as recited in claim 91, wherein said barricade comprises a cone disposed in said fluid conduit with the small end of said cone oriented toward the container of fluid and the large end of said cone engaging the interior of said fluid conduit.

102. A pour spout for permitting transfer of a fluid from a container of the fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel and through which air enters said fluid conduit;

(b) a cone disposed in said fluid conduit with the small end of said cone oriented toward the container of fluid and the large end of said cone engaging the interior surface of said fluid conduit and (c) viscosity accommodating transfer means formed in said cone for smoothly and continuously exchanging through said cone air in said fluid conduit from said fluid discharge opening and fluid from the container by varying both the cross-sectional area of fluid flow and the cross-sectional area of air flow through said cone with the viscosity of the fluid, wherein said transfer means comprises an elongated aperture formed through said cone extending continuously from an upper portion of said cone to a lower portion of said cone.

103. A pour spout as recited in claim 102, wherein said upper portion of said barricade is disposed closer to said one end of said fluid conduit than said lower portion of said barricade.

104. A pour spout as recited in claim 102, wherein said elongated aperture has an upper edge, a lower edge on the opposite side thereof from the container, and a pair of longitudinal edges extending between said upper edge and said lower edge, air said fluid conduit passing said through said elongated aperture doing so at said upper edge thereof and fluid from said container passing through said elongated aperture doing so at said lower edge thereof.

105. A pour spout as recited in claim 102, wherein said longitudinal edges of said aperture are linear.

106. A pour spout as recited in claim 102, wherein said upper edge of said elongated aperture comprises a vertex between said longitudinal edges thereof.

107. A pour spout as recited in claim 102, wherein said upper edge of said aperture is shorter than said lower edge of said aperture.

108. A pour spout as recited in claim 102, wherein said upper edge of said aperture is linear.

109. A pour spout as recited in claim 102, wherein said lower edge of said aperture is linear.

110. A pour spout as recited in claim 102, wherein said lower edge of said aperture corresponds to the interior surface of said conduit.

111. A pour spout for permitting transfer of a fluid from a container of the fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel and through which air enters said fluid conduit; and (b) a screen mesh sheet fixed in said fluid conduit at an inclination to the longitudinal axis of said fluid conduit, said screen mesh sheet exchanging therethrough air in said fluid conduit from said discharge opening and fluid from the container.

112. A pour spout as recited in claim 111, wherein said screen mesh sheet is comprised of wire filaments.

113. A pour spout for permitting transfer of a fluid from a container of the fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel and through which air enters said fluid conduit; and (b) a plurality of elongated obstacles secured in a proximate, spaced-apart relationship within said fluid conduit at an inclination relative to the longitudinal axis thereof, thereby defining a plurality of elongated apertures of tapering width between adjacent of said obstacles, wherein said plurality of obstacles defines a barricade disposed across the interior of said fluid conduit obstructing the flow of fluid through said fluid conduit from the container and wherein said plurality of apertures defines viscosity accommodating transfer means formed in said barricade for smoothly and continuously exchanging through said barricade air in said fluid conduit from said fluid discharge opening and fluid from the container by varying both the cross-sectional area of fluid flow and the cross-sectional area of air flow through said barricade with the viscosity of the fluid.

114. A pour spout as recited in claim 113, wherein each of said elongated apertures narrows in width toward the container.

115. A pour spout as recited in claim 113, wherein said obstacles are disposed in a coplanar relationship.

116. A pour spout as recited in claim 113, wherein said obstacles are disposed in a non-coplanar relationship.

117. A pour spout as recited in claim 113, wherein said obstacles are disposed in a conical configuration.

118. A pour spout as recited in claim 113, wherein said elongated obstacles are secured within said fluid conduit to the interior of said fluid conduit.

119. A pour spout as recited in claim 113, wherein said plurality of elongated obstacles are integrally formed with each other.

120. A pour spout as recited in claim 119, wherein said pair of adjacent obstacles are joined at the upper ends thereof.

121. A pour spout as recited in claim 119, wherein said pair of adjacent obstacles are joined at the lower ends thereof.

122. A pour spout as recited in claim 119, wherein said pair of obstacles are joined at the upper ends thereof respectively and at the lower ends thereof respectively.

123. A pour spout as recited in claim 122, wherein said upper ends of said obstacles are disposed closer to said one end of said fluid conduit than said lower ends of said obstacles.

124. A pour spout as recited in claim 113, wherein each of said elongated apertures comprises:

(a) an upper edge, (b) a lower edge on the opposite side of said upper edge from the container, and (c) a pair of longitudinal edges extending between said upper edge and said lower edge, air in said fluid conduit passing through at least one of said elongated apertures at said upper edge thereof, and fluid from said container passing through said at least one of said elongated apertures at said lower edge thereof.

125. A pour spout as recited in claim 113, wherein said longitudinal edges of said aperture are linear.

126. A pour spout as recited in claim 113, wherein said upper edge of said elongated aperture comprises a vertex between said longitudinal edges thereof.

127. A pour spout as recited in claim 113, wherein said upper edge of said aperture is shorter than said lower edge of said aperture.

128. A pour spout as recited in claim 113, wherein said upper edge of said aperture corresponds to the inside surface of said conduit.

129. A pour spout as recited in claim 113, wherein said upper edge of said aperture is linear.

130. A pour spout as recited in claim 113, wherein said lower edge of said aperture is linear.

131. A pour spout as recited in claim 113, wherein said lower edge of said aperture corresponds to the interior surface of said conduit.

132. A pour spout for permitting transfer of a fluid from a container of the fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel and through which air enters said fluid conduit;

(b) a cone disposed in said fluid conduit with the large end of said cone engaging the interior surface of said fluid conduit; and (c) an elongated aperture formed through said cone extending continuously from an upper portion of said cone to a lower portion of said cone, air in said fluid conduit passing through said elongated aperture at said upper portion of said cone, and fluid from said container passing through said elongated aperture at said lower portion of said cone.

133. A pour spout as recited in claim 132, wherein the small end of said cone is oriented toward the container of fluid.

134. A pour spout as recited in claim 132, wherein said cone is disposed symmetrically about the longitudinal axis of said fluid conduit.

135. A pour spout as recited in claim 132, wherein said elongated aperture tapers in width.

136. A pour spout as recited in claim 135, wherein said elongated aperture narrows in width toward the container.

137. A pour spout as recited in claim 135, wherein said elongated aperture narrows in width toward the small end of said cone.

* * * * *